US011322832B2

(12) United States Patent
Jong et al.

(10) Patent No.: US 11,322,832 B2
(45) Date of Patent: May 3, 2022

(54) ANTENNA STRUCTURE AND ELECTRONIC DEVICE COMPRISING ANTENNA STRUCTURE

(71) Applicant: SAMSUNG ELECTRONICS CO., LTD., Suwon-si (KR)

(72) Inventors: Je Hun Jong, Suwon-si (KR); Se Hyun Park, Suwon-si (KR); Su Min Yun, Suwon-si (KR); Myung Hun Jeong, Suwon-si (KR); Jae Hoon Jo, Suwon-si (KR); Jin Woo Jung, Suwon-si (KR); Jae Bong Chun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 430 days.

(21) Appl. No.: 16/199,784

(22) Filed: Nov. 26, 2018

(65) Prior Publication Data

US 2019/0229413 A1 Jul. 25, 2019

(30) Foreign Application Priority Data

Jan. 24, 2018 (KR) ..... 10-2018-0008995

(51) Int. Cl.
*H01Q 1/42* (2006.01)
*H01Q 1/38* (2006.01)
(Continued)

(52) U.S. Cl.
CPC ..... *H01Q 1/422* (2013.01); *H01Q 1/243* (2013.01); *H01Q 1/38* (2013.01); *H01Q 1/523* (2013.01);
(Continued)

(58) Field of Classification Search
CPC ..... H01Q 1/422; H01Q 1/243; H01Q 21/28; H01Q 21/062; H01Q 1/38; H01Q 1/523;
(Continued)

(56) References Cited

U.S. PATENT DOCUMENTS 6,320,544 B1 11/2001 Korisch et al.
8,354,972 B2 1/2013 Boija et al.
(Continued)

FOREIGN PATENT DOCUMENTS

CN 1320982 A 11/2001
KR 10-2019-0007734 1/2019
(Continued)

OTHER PUBLICATIONS

International Search Report and Written Opinion dated Feb. 28, 2019 in counterpart International Patent Application No. PCT/KR2018/014365.
(Continued)

*Primary Examiner* — Dimary S Lopez Cruz
*Assistant Examiner* — Michael M Bouizza
(74) *Attorney, Agent, or Firm* — Nixon & Vanderhye P.C.

(57) ABSTRACT

An electronic device includes a housing that includes a first plate, a second plate facing a direction opposite the first plate, and a side member surrounding a space between the first plate and the second plate, an antenna structure that includes a plurality of dielectric layers perpendicular to the side member and parallel to the first plate, a first array of conductive plates aligned in a first direction perpendicular to the first plate at a first dielectric layer of the dielectric layers, a second array of conductive plates spaced from the first array and aligned in the first direction at the first dielectric layer, wherein the second array is farther from the first plate than the first array, at least one ground plane positioned on at least one of the dielectric layers and interposed between the first array and the second array, when viewed from above the side member, and a wireless communication circuit electrically connected to the first array and the second array and configured to transmit and/or receive a signal having a frequency in a range of 20 GHz to 100 GHz.

13 Claims, 35 Drawing Sheets

(51) Int. Cl.

| | |
|---|---|
| ***H01Q 1/52*** | (2006.01) |
| ***H01Q 11/14*** | (2006.01) |
| ***H01Q 19/13*** | (2006.01) |
| ***H01Q 21/00*** | (2006.01) |
| ***H01Q 1/24*** | (2006.01) |
| ***H01Q 21/28*** | (2006.01) |
| ***H01Q 21/06*** | (2006.01) |

(52) U.S. Cl.
CPC ..... *H01Q 11/14* (2013.01); *H01Q 19/138* (2013.01); *H01Q 21/0031* (2013.01); *H01Q 21/062* (2013.01); *H01Q 21/28* (2013.01)

(58) Field of Classification Search
CPC ..... H01Q 21/0031; H01Q 11/14; H01Q 19/138; H01Q 21/24; H01Q 21/08; H01Q 9/0485; H01Q 1/50; H01Q 9/285; H04M 1/0202
See application file for complete search history.

(56) References Cited

U.S. PATENT DOCUMENTS

| | | | | |
|---|---|---|---|---|
| 9,293,816 | B2 | 3/2016 | Samardzija et al. | |
| 9,583,838 | B2 | 2/2017 | Zhu et al. | |
| 9,653,818 | B2 | 5/2017 | Mohammadian et al. | |
| 2010/0171675 | A1 | 7/2010 | Borja et al. | |
| 2013/0147664 | A1* | 6/2013 | Lin | H01Q 1/243 342/372 |
| 2014/0009355 | A1 | 1/2014 | Samardzija et al. | |
| 2014/0266973 | A1 | 9/2014 | De Vries et al. | |
| 2015/0270618 | A1 | 7/2015 | Zhu et al. | |
| 2016/0043470 | A1* | 2/2016 | Ko | H01Q 21/28 343/843 |
| 2016/0087348 | A1* | 3/2016 | Ko | H01Q 1/243 455/73 |
| 2016/0248169 | A1 | 8/2016 | Mohammadian et al. | |
| 2017/0069958 | A1 | 3/2017 | Ko et al. | |
| 2017/0309991 | A1 | 10/2017 | Noori et al. | |
| 2017/0346185 | A1 | 11/2017 | Wang et al. | |
| 2018/0219293 | A1 | 8/2018 | Chi et al. | |

FOREIGN PATENT DOCUMENTS

| | | |
|---|---|---|
| WO | 2016/021935 | 2/2016 |
| WO | 2017/116425 | 7/2017 |

OTHER PUBLICATIONS

European Search Report and Written Opinion dated Nov. 12, 2020 in corresponding European Application No. 18901915.1.
Chinese Office Action dated Mar. 8, 2022 for CN Application No. 201880087678.4.

* cited by examiner (a)

(b)

(c)

(d)

900

ANTENNA STRUCTURE AND ELECTRONIC DEVICE COMPRISING ANTENNA STRUCTURE

CROSS-REFERENCE TO RELATED APPLICATION

This application is based on and claims priority under 35 U.S.C. § 119 to Korean Patent Application No. 10-2018-0008995, filed on Jan. 24, 2018, in the Korean Intellectual Property Office, the disclosure of which is incorporated by reference herein its entirety.

BACKGROUND

1. Field

The disclosure relates to an antenna structure and an electronic device including the antenna structure.

2. Description of Related Art

As the mobile traffic sharply increases, a $5^{th}$ generation (5G) mobile communication technology based on an ultra-high-band frequency of 20 GHz or higher is being developed. A signal of the ultra-high-band frequency includes a millimeter wave (mmWave) having a frequency band ranging from 20 GHz to 100 GHz. If the ultra-high-band frequency is used, a wavelength may become short, and thus, an antenna and a device may become small-sized and/or lightweight. Also, the short wavelength may enable mounting relatively many antennas in the same area, and thus, a signal may be transmitted intensively in a specific direction. Also, since the bandwidth may be used more widely, a significant amount of information may be transmitted.

The above information is presented as background information only to assist with an understanding of the present disclosure. No determination has been made, and no assertion is made, as to whether any of the above might be applicable as prior art with regard to the present disclosure.

A communication device included in an electronic device may include an antenna. In this case, a beam pattern or a radiation pattern formed by the antenna may have an influence of a housing, thereby causing distortion of the pattern.

Conventionally, to avoid the influence of the housing, the antenna has been implemented with a metal material included in the housing or by making a separation distance between the antenna and the housing wide. However, since a large number of feed lines for supplying a power are required in the case of an antenna array, it may be inefficient to use the conventional way due to a limitation on a mounting space in the electronic device.

SUMMARY

Example aspects of the present disclosure address at least the above-mentioned problems and/or disadvantages and provide at least the advantages described below. Accordingly, an example aspect of the present disclosure is to provide an antenna structure including a plurality of antenna arrays and an electronic device including the antenna structure.

In accordance with an aspect of the present disclosure, an electronic device may include a housing that includes a first plate, a second plate facing a direction opposite the first plate, and a side member surrounding a space between the first plate and the second plate, an antenna structure that includes a plurality of dielectric layers perpendicular to the first plate and parallel to the side member, a first array of conductive plates aligned in a first direction perpendicular to the first plate at a first dielectric layer of the dielectric layers, a second array of conductive plates spaced from the first array and aligned in the first direction at the first dielectric layer, wherein the second array is farther from the first plate than the first array, at least one ground plane positioned on at least one of the dielectric layers and interposed between the first array and the second array, when viewed from above the side member, and a wireless communication circuit electrically connected to the first array and the second array and configured to transmit and/or receive a signal having a frequency in a range of 20 GHz to 100 GHz.

In accordance with another aspect of the present disclosure, an electronic device may include a housing that includes a first plate, a second plate facing a direction opposite the first plate, and a side member surrounding a space between the first plate and the second plate, the side member including a first side and a second side extending in a first direction and having a first length in the space and a third side and a fourth side extending in a second direction and having a second length longer than the first length, a communication device comprising communication circuitry disposed within the space and configured to transmit and/or receive a wireless signal having a frequency in a range of 20 GHz to 100 GHz, wherein the communication device includes a substrate including a first surface and a second surface facing a direction opposite the first surface, a first antenna array positioned at the substrate and including a plurality of first conductive plates, a second antenna array positioned at the substrate and including a plurality of second conductive plates independent of the plurality of first conductive plates, and a ground region interposed between the first antenna array and the second antenna array within the space, and a wireless communication circuit that is configured to receive a radio frequency (RF) signal having a specific polarization characteristic using the plurality of first conductive plates and the plurality of second conductive plates and is further configured to transmit and/or receive an RF signal having the specific polarization characteristic using the plurality of second conductive plates.

In accordance with another aspect of the present disclosure, a communication device may include at least one substrate on which a wireless communication circuit configured to transmit and/or receive a signal having a frequency in a range of 20 GHz to 100 GHz is positioned, a first antenna array that includes a plurality of first conductive plates configured in an array at any one substrate of the at least one substrate, a second antenna array that includes a plurality of second conductive plates configured in an array at the any one substrate, and a ground region that is positioned at the any one substrate, is electrically connected to the plurality of first conductive plates and the plurality of second conductive plates, and is interposed between the plurality of first conductive plates and the plurality of second conductive plates, when viewed from above one surface of the any one substrate. The wireless communication circuit may be configured to transmit and/or receive an RF signal of a specific polarization characteristic through the plurality of first conductive plates, and may be configured to transmit and/or receive an RF signal of the specific polarization characteristic through the plurality of second conductive plates.

According to various example embodiments of the present disclosure, a plurality of antennas may be efficiently mounted in a small space defined within an electronic device.

According to various example embodiments of the present disclosure, distortion of a beam pattern or a radiation pattern due to a housing of the electronic device may be effectively prevented.

Moreover, a variety of effects directly or indirectly understood through this disclosure may be provided.

Other aspects, advantages, and salient features of the disclosure will become apparent to those skilled in the art from the following detailed description, which, taken in conjunction with the annexed drawings, discloses various example embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Hereinafter, various example embodiments of the present disclosure will be described with reference to accompanying drawings. However, those of ordinary skill in the art will recognize that various modifications, equivalents, and/or alternatives of the various example embodiments described herein can be variously made without departing from the scope and spirit of the present disclosure.

Figure 1A:
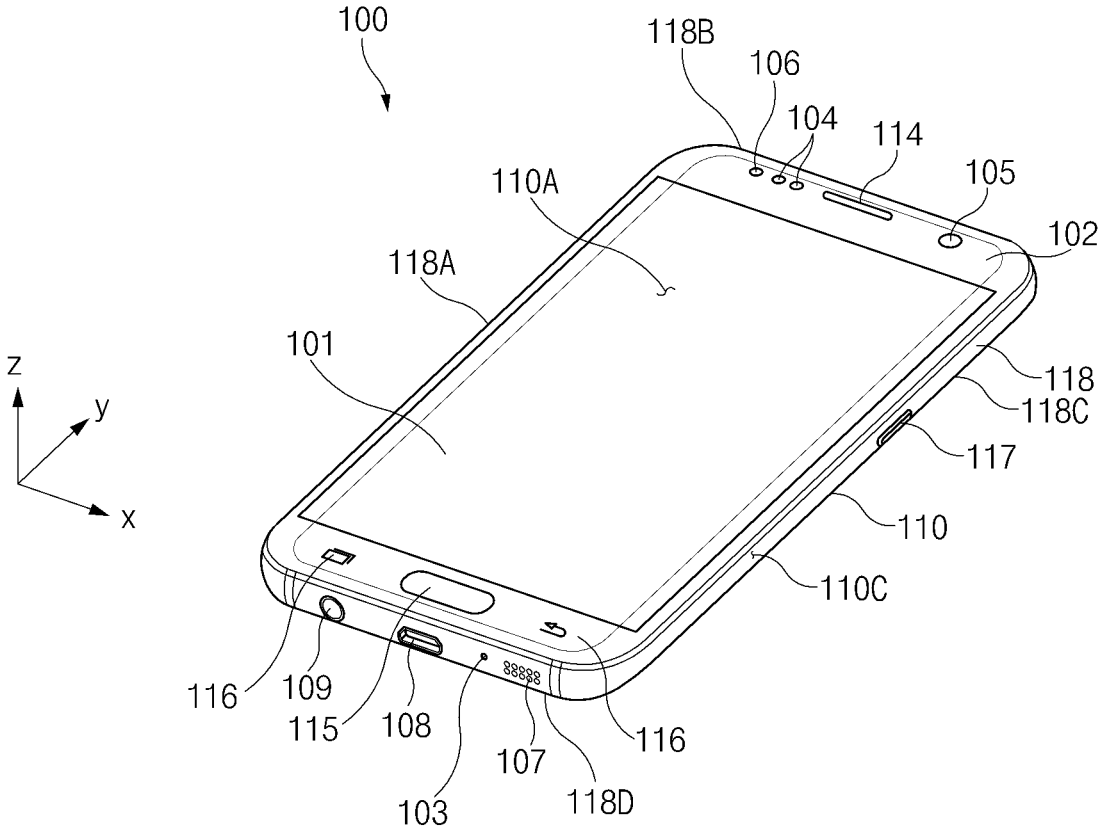
FIG. 1A is a front perspective view illustrating a mobile electronic device according to an embodiment.

FIG. 1A is a front perspective view illustrating a mobile electronic device according to an embodiment.

Figure 1B:
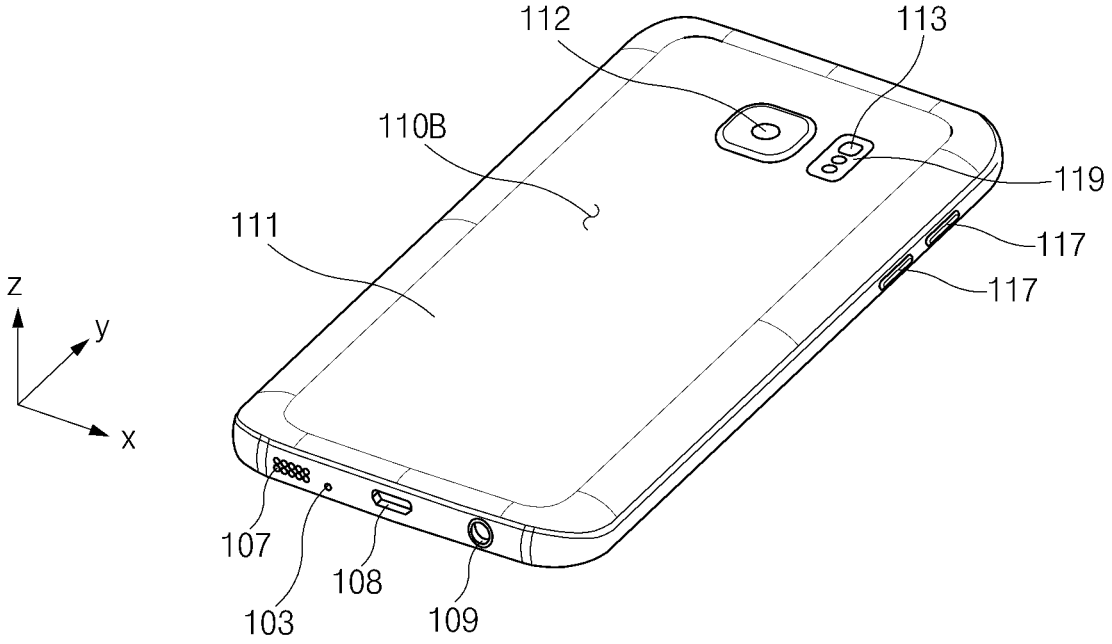
FIG. 1B is a back perspective view illustrating an electronic device of FIG. 1A.

FIG. 1B is a back perspective view illustrating an electronic device of FIG. 1A.

Referring to FIGS. 1A and 1B, an electronic device 100 according to an embodiment may include a housing 110 including a first surface (or a front surface) 110A, a second surface (or a back surface) 110B, and a side surface 110C surrounding a space between the first surface 110A and the second surface 110B. In another embodiment (not illustrated), the housing 110 may refer to a structure which forms a part of the first surface 110A of FIG. 1A, the second surface 110B of FIG. 1B, and the side surface 110C of FIG. 1A.

According to an embodiment, the first surface 110A may be formed by a first plate (or a front plate) 102 (e.g., a glass plate including various coating layers, or a polymer plate), at least a portion of which is substantially transparent.

According to an embodiment, the second surface 110B may be formed by a second plate (or a back plate) 111. The second plate 111 may be formed by coated or colored glass, ceramic, polymer, metal (e.g., aluminum, stainless steel (STS), or magnesium), or a combination of at least two of the materials.

According to an embodiment, the side surface 110C may be coupled with the first plate 102 and the second plate 111, and may be formed by a side bezel structure (or a "side member") 118 including metal and/or polymer. In any embodiment, the second plate 111 and the side bezel structure 118 may be integrally formed and may include the same material (e.g., a metal material such as aluminum).

According to an embodiment, the side surface 110C or the side member 118 may include at least one nonconductive portion for the purpose of transmitting and/or receiving a signal according to an embodiment. According to an embodiment, the nonconductive portion may be filled by a nonconductive material.

According to an embodiment, the side surface 110C or the side member 118 may include a plurality of conductive portions which are spaced (or separated) from each other by the nonconductive portion. The conductive portion may be referenced as a first conductive portion, a second conductive portion, and/or a third conductive portion.

According to an embodiment, when viewed from above the front surface 110A, the side member 118 may include a first side 118A which has a first length and extends in a first direction (e.g., a +y or −y direction), a second side 118B which has a second length and extends in a second direction (e.g., a +x or −x direction) different from the first direction, a third side 118C which has the first length and extends in parallel with the first side 118A, and a fourth side 118D which has the second length and extends in parallel with the second side 118B. The first direction and the second direction may be perpendicular to each other. According to an embodiment, the second length may be shorter than the first length.

According to an embodiment, the electronic device 100 may include at least one or more of a display 101, an audio module (103, 107, 114), a sensor module (104, 119), a camera module (105, 112, 113), a key input device (115, 116, 117), an indicator 106, and a connector hole (108, 109). In any embodiment, the electronic device 100 may not include at least one (e.g., the key input device (115, 116, 117) or the indicator 106) of the components or may further include any other component.

The display 101 may be exposed through a considerable portion of the first plate 102, for example. The display 101 may be coupled with a touch sensing circuit, a pressure sensor which may measure the intensity (or pressure) of a touch, and/or a digitizer detecting a magnetic stylus pen or may be positioned adjacent thereto.

According to an embodiment, the audio module (103, 107, 114) may include a microphone hole 103 and a speaker hole (107, 114). A microphone for obtaining external sound may be positioned within the microphone hole 103. In any embodiment, a plurality of microphones may be positioned to make it possible to detect a direction of sound. The speaker hole (107, 114) may include an external speaker hole 107 and a receiver hole 114 for call. In any embodiment, the speaker hole (107, 114) and the microphone hole 103 may be implemented with one hole, or a speaker (e.g., a piezo speaker) may be included without the speaker hole (107, 114).

According to an embodiment, the sensor module (104, 119) may generate an electrical signal or a data value which corresponds to an internal operation state of the electronic device 100 or corresponds to an external environment state. The sensor module (104, 119) may include, for example, a first sensor module 104 (e.g., a proximity sensor) and/or a second sensor module (not illustrated) (e.g., a fingerprint sensor) positioned on the first surface 110A of the housing 110, and/or a third sensor module 119 (e.g., a hear rate monitor (HRM) sensor) positioned on the second surface 110B of the housing 110.

According to an embodiment, the fingerprint sensor may be positioned on the second surface 110B as well as the first surface 110A (e.g., a home key button 115) of the housing 110. The electronic device 100 may further include a sensor module not illustrated, for example, at least one of a gesture sensor, a grip sensor, a barometric pressure sensor, a magnetic sensor, an acceleration sensor, a grip sensor, a color sensor, an infrared (IR) sensor, a biometric sensor, a temperature sensor, a humidity sensor, or an illumination sensor 104.

According to an embodiment, the camera module (105, 112, 113) may include a first camera device 105 positioned on the first surface 110A of the electronic device 100, and a second camera module 112 and/or a flash 113 positioned on the second surface 110B. The camera module (105, 112) may include one or more lenses, an image sensor, and/or an image signal processor. The flash 113 may include, for example, a light emitting diode or a xenon lamp. In any embodiment, two or more lenses (wide-angle and telephoto lenses) and image sensors may be positioned on one surface of the electronic device 100.

According to an embodiment, the key input device (115, 116, 117) may include the home key button 115 positioned on the first surface 110A of the housing 110, a touch pad(s) 116 positioned in the vicinity of the home key button 115, and/or a side key button 117 positioned on the side surface 110C of the housing 110. In another embodiment, the electronic device 100 may not include all or a part of the key input device (115, 116, 117), and the key input device(s) not included may be implemented on the display 101 in the form of a soft key.

According to an embodiment, the indicator 106 may be positioned, for example, on the first surface 110A of the housing 110. The indicator 106 may provide state information of the electronic device 100, for example, in the form of light, and may include an LED.

According to an embodiment, the connector hole (108, 109) may include a first connector hole 108 which may accommodate a connector (e.g., a universal serial bus (USB) connector) for transmitting/receiving a power and/or data to/from an external electronic device, and/or a second connector hole (or an earphone jack) 109 which may accommodate a connector for transmitting/receiving an audio signal to/from the external electronic device.

Figure 1C:
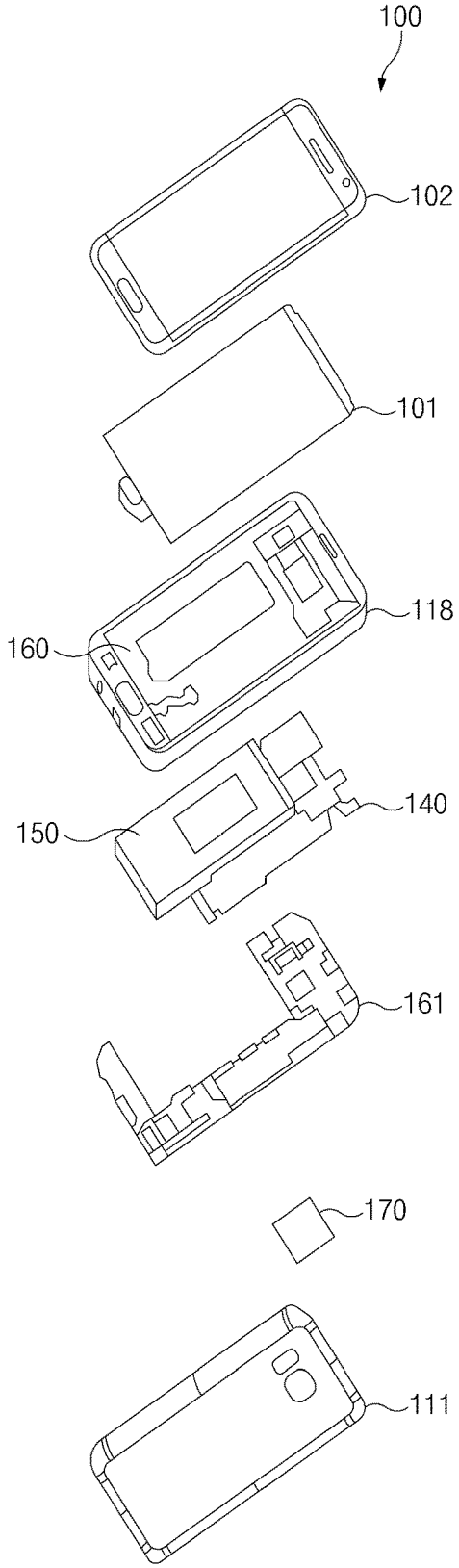
FIG. 1C is an exploded perspective view illustrating an electronic device of FIG. 1A.

FIG. 1C is an exploded perspective view of an electronic device of FIG. 1A.

Referring to FIG. 3, the electronic device 100 may include the side bezel structure 118, a first support member 160 (e.g., a bracket), the first plate 102, the display 101, a substrate 140, a battery 150, a second support member 161 (e.g., a rear case), a communication device 170, and the second plate 111. In an example embodiment, the electronic device 100 may not include at least one (e.g., the first support member 160 or the second support member 161) of the components or may further include any other component. At least one of the components of the electronic device 100 may be identical or similar to at least one of the components of the electronic device 100 of FIG. 1A or 1B, and thus, additional description will be omitted to avoid redundancy.

The first support member 160 may be positioned within the electronic device 100 and may be connected with the side bezel structure 118, or may be integrally formed with the side bezel structure 118. The first support member 160 may be formed of, for example, a metal material and/or a nonmetal material (e.g., polymer). The display 101 may be coupled with one surface of the first support member 160, and the substrate 140 may be coupled with an opposite surface of the first support member 160. A processor, a memory, and/or an interface may be mounted on the substrate 140. According to an embodiment, the substrate 140 which is a printed circuit board (PCB) may be a main PCB. For example, and without limitation, the processor may include one or more of a dedicated processor, a central processing unit, an application processor, a graphic processing device, an image signal processor, a sensor hub processor, and/or a communication processor or the like.

The memory may include, for example, a volatile memory and/or a nonvolatile memory.

The interface may include, for example, and without limitation, a high definition multimedia interface (HDMI), a USB interface, a secure digital (SD) card interface, and/or an audio interface, or the like. The interface may electrically or physically connect, for example, the electronic device 100 with an external electronic device and may include a USB connector, an SD card/MMC connector, or an audio connector.

The battery 150 which may refer, for example, to a device for supplying a power to at least one component of the electronic device 100 may include, for example, and without limitation, a primary cell incapable of being recharged, a secondary cell rechargeable, and/or a fuel cell, or the like. At least a part of the battery 150 may be positioned on substantially the same dielectric layer as the printed circuit board 140, for example. The battery 150 may be integrally positioned within the electronic device 100, or may be positioned removable from the electronic device 100.

According to an embodiment, the communication device (e.g., including communication circuitry) 170 may be interposed between the second plate 111 and the battery 150. According to an embodiment, the electronic device 100 may include a plurality of communication devices 170. According to an embodiment, the communication device 170 may include, for example, and without limitation, an mmWave module and/or an antenna module, or the like. The mmWave band may include, for example, a frequency band ranging from 20 GHz to 100 GHz. According to an embodiment, the communication device 170 may include at least one antenna array for transmitting and/or receiving a signal in the mmWave band. A plurality of antenna elements may be arrayed in the antenna array with an arrangement. According to an embodiment, the communication device 170 may be interposed between the substrate 140 and the side bezel structure 118. In this case, when viewed from above the front surface 110A of the electronic device 100, the communication device 170 may be interposed between the side bezel structure 118 and the display 101.

Figure 2A:
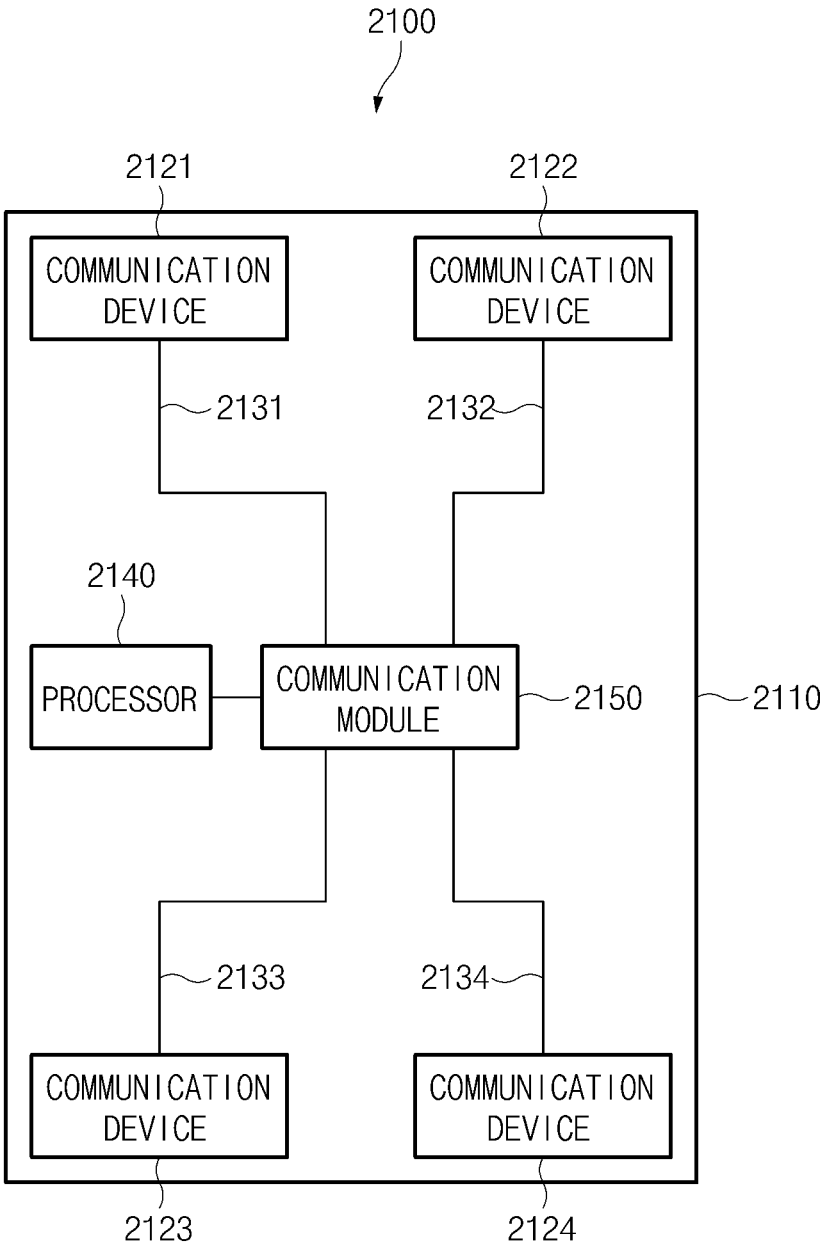
FIG. 2A is a block diagram illustrating an example of an electronic device supporting 5G communication.

FIG. 2A is a block diagram illustrating an example of an electronic device supporting 5G communication.

Referring to FIG. 2A, an electronic device 2100 (e.g., the electronic device 100 of FIG. 1A) may include a housing 2110, a processor (e.g., including processing circuitry) 2140, a first communication module (e.g., including communication circuitry) 2150 (e.g., a communication module 1890 of FIG. 18), a first communication device (e.g., including communication circuitry) 2121, a second communication device (e.g., including communication circuitry) 2122, a third communication device (e.g., including communication circuitry) 2123, a fourth communication device (e.g., including communication circuitry) 2124, a first conductive line 2131, a second conductive line 2132, a third conductive line 2133, and/or a fourth conductive line 2134.

According to an embodiment, the housing 2110 may protect any other components of the electronic device 2100. The housing 2110 may include, for example, a front plate (e.g., the first plate 102 of FIG. 1A), a back plate (e.g., the second plate 111 of FIG. 1B) facing away from (a direction opposite) the front plate, and a side member (or a metal frame) (e.g., the side bezel structure (or "side member") 118 of FIG. 1A) surrounding a space between the front plate and the back plate. The side member may be attached to the back plate or may be integrally formed with the back plate.

According to an embodiment, the electronic device 2100 may include at least one of the first communication device 2121, the second communication device 2122, the third communication device 2123, or the fourth communication device 2124.

According to an embodiment, the first communication device 2121, the second communication device 2122, the third communication device 2123, or the fourth communication device 2124 may be positioned within the housing 2110. According to an embodiment, when viewed from above the back plate of the electronic device 2100, the first communication device 2121 may be positioned at a left top end of the electronic device 2100, the second communication device 2122 may be positioned at a right top end of the electronic device 2100, the third communication device 2123 may be positioned at a left bottom end of the electronic device 2100, and the fourth communication device 2124 may be positioned at a right bottom end of the electronic device 2100.

According to an embodiment, the processor 2140 may include various processing circuitry, such as, for example, and without limitation, one or more of a dedicated processor, a central processing unit, an application processor, a graphic processing unit (GPU), an image signal processor of a camera, and/or a baseband processor (or a communication processor (CP)), or the like. According to an embodiment, the processor 2140 may be implemented with a system on chip (SoC) or a system in package (SiP).

For example, the communication module 2150 may be electrically connected to the first communication device 2121, the second communication device 2122, the third communication device 2123, and/or the fourth communication device 2124 using the first conductive line 2131, the second conductive line 2132, the third conductive line 2133, and/or the fourth conductive line 2134. The communication module 2150 may include, for example, and without limitation, a baseband processor and/or at least one communication circuit (e.g., an inter frequency integrated circuit (IFIC) and/or a radio frequency integrated circuit (RFIC)). The communication module 2150 may include, for example, and without limitation, a baseband processor which is independent of the processor 2140 (e.g., an application processor (AP)), or the like. The first conductive line 2131, the second conductive line 2132, the third conductive line 2133, or the fourth conductive line 2134 may include, for example, a coaxial cable and/or an FPCB.

According to an embodiment, the communication module 2150 may include a first baseband processor (BP) (not illustrated) and/or a second baseband processor (not illustrated). The electronic device 2100 may further include one or more interfaces for supporting inter-chip communication between the first BP (or the second BP) and the processor 2140. The processor 2140 and the first BP or the second BP may transmit/receive data using the inter-chip interface (or an inter processor communication channel).

According to an embodiment, the first BP or the second BP may provide an interface for performing communication with any other entities. The first BP may support, for example, wireless communication with regard to a first network (not illustrated). The second BP may support, for example, wireless communication with regard to a second network (not illustrated).

According to an embodiment, the first BP or the second BP may form one module with the processor 2140. For example, the first BP or the second BP may be integrally formed with the processor 2140. For another example, the first BP or the second BP may be positioned within one chip or may be implemented in the form of an independent chip. According to an embodiment, the processor 2140 and at least one baseband processor (e.g., the first BP) may be integrally formed within one chip (a SoC), and another baseband processor (e.g., the second BP) may be implemented in the form of an independent chip.

Figure 18:
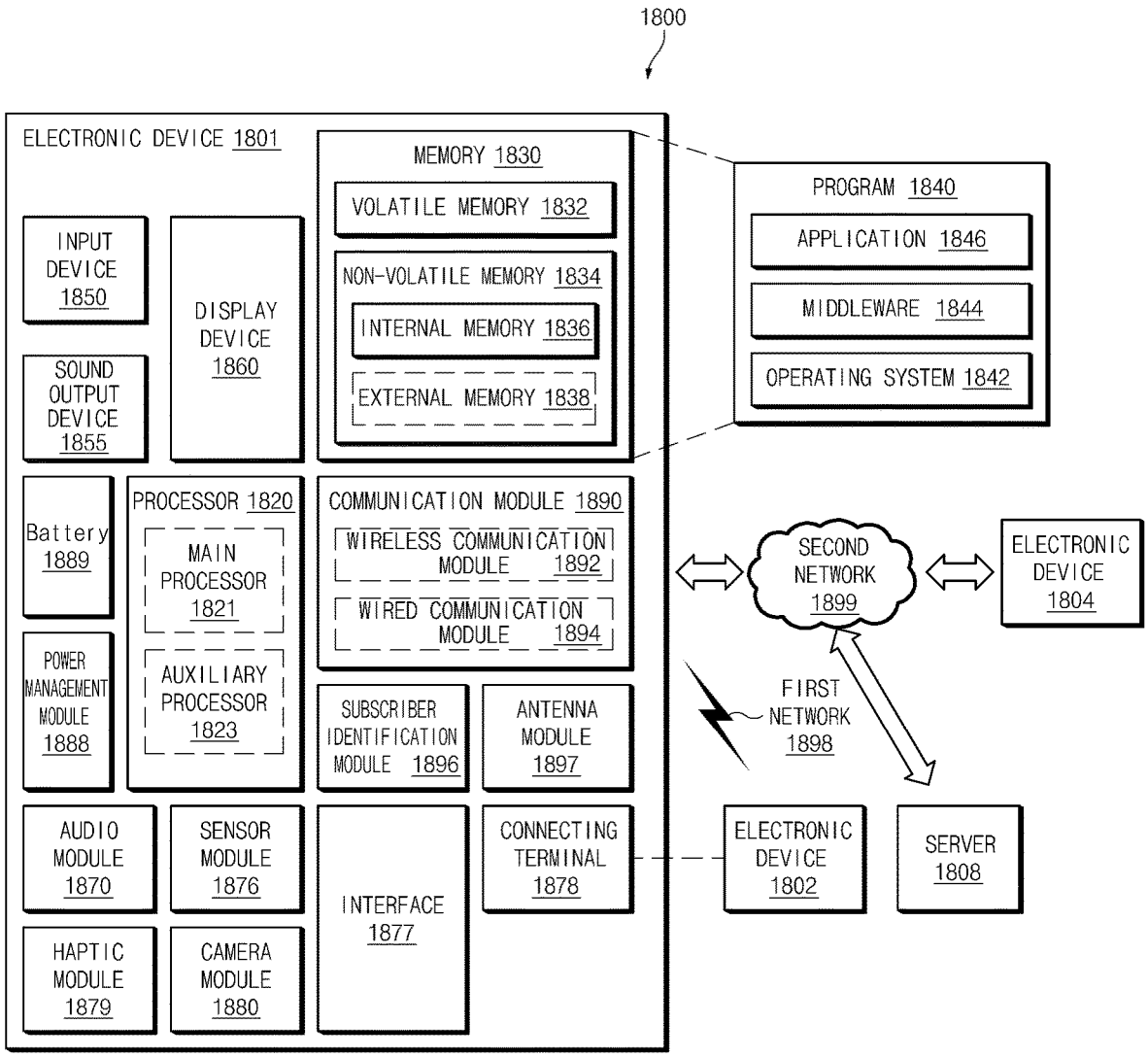
FIG. 18 is a block diagram of an electronic device in a network environment, according to various embodiments.

According to an embodiment, the first network (not illustrated) or the second network (not illustrated) may correspond to a network 1899 of FIG. 18. According to an embodiment, the first network (not illustrated) and the second network (not illustrated) may include a $4^{th}$ generation (4G) network and a $5^{th}$ generation (5G) network, respectively. The 4G network may support, for example, a long term evolution (LTE) protocol defined in the 3GPP. The 5G network may support, for example, a new radio (NR) protocol defined in the 3GPP.

Figure 2B:
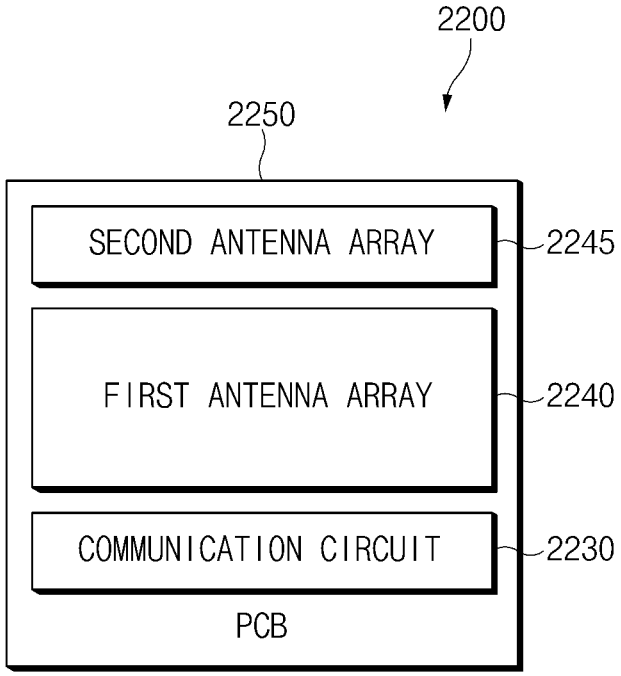
FIG. 2B is a block diagram illustrating an example of a communication device.

FIG. 2B is a block diagram illustrating a communication device according to an embodiment.

Referring to FIG. 2B, a communication device 2200 (e.g., the first communication device 2121, the second communication device 2122, the third communication device 2123, and/or the fourth communication device 2124 of FIG. 2A) may include a communication circuit 2230 (e.g., an RFIC), a PCB 2250, a first antenna array 2240, and/or a second antenna array 2245.

According to an embodiment, the communication circuit 2230, the first antenna array 2240, and/or the second antenna array 2245 may be positioned on the PCB 2250. For example, the first antenna array 2240 and/or the second antenna array 2245 may be positioned on a first surface of the PCB 2250, and the communication circuit 2230 may be positioned on a second surface of the PCB 2250. The PCB 2250 may include a connector (e.g., a coaxial cable connector or a board to board (B-to-B) connector) for electrical connection with any other PCB (e.g., a PCB on which the communication module 2150 of FIG. 2A is positioned) using a transmission line (e.g., the first conductive line 2131 of FIG. 2A or a coaxial cable). The PCB 2250 may be connected to the PCB, on which the communication module 2150 is positioned, for example, using a coaxial cable, and the coaxial cable may be used to transmit a receive/transmit IF or RF signal. For another example, a power or any other control signal may be provided through the B-to-B connector.

According to an embodiment, the first antenna array 2240 and/or the second antenna array 2245 may include a plurality of antennas. The antennas may include various antennas, such as, for example, and without limitation, a patch antenna, a loop antenna, and/or a dipole antenna, or the like. For example, a plurality of antennas included in the first antenna array 2240 may be a patch antenna for forming a beam toward a back plate of the electronic device 2100. For another example, a plurality of antennas included in the second antenna array 2245 may be a dipole antenna or a loop antenna for forming a beam toward a side member of the electronic device 2100.

According to an embodiment, the communication circuit 2230 may support at least a portion (e.g., 24 GHz to 30 GHz or 37 GHz to 40 GHz) of a band ranging from 24 GHz to 100 GHz. According to an embodiment, the communication circuit 2230 may up-convert and/or down-convert a frequency. For example, the communication circuit 2230 included in the communication device 2200 (e.g., the first communication device 2121 of FIG. 2A) may up-convert an IF signal received from a communication module (e.g., a communication module 1890 of FIG. 18) through a conductive line (e.g., the first conductive line 2131 of FIG. 2A) to an RF signal. For another example, the communication circuit 2230 included in the communication device 2200 (e.g., the first communication device 2121 of FIG. 2A) may transmit may down-convert an RF signal (e.g., an mmWave signal) received through the first antenna array 2240 and/or the second antenna array 2245 to an IF signal and may transmit the IF signal to a communication module using a conductive line.

Figure 3A:
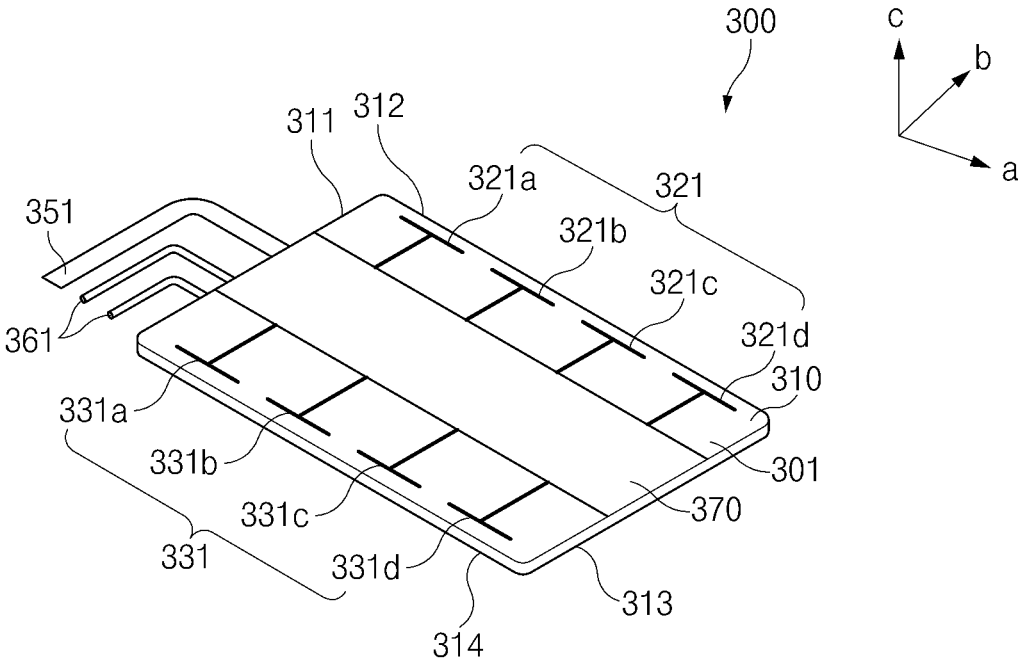
FIGS. 3A, 3B and 3C are perspective views illustrating a communication device according to various embodiments.
Figure 3B:
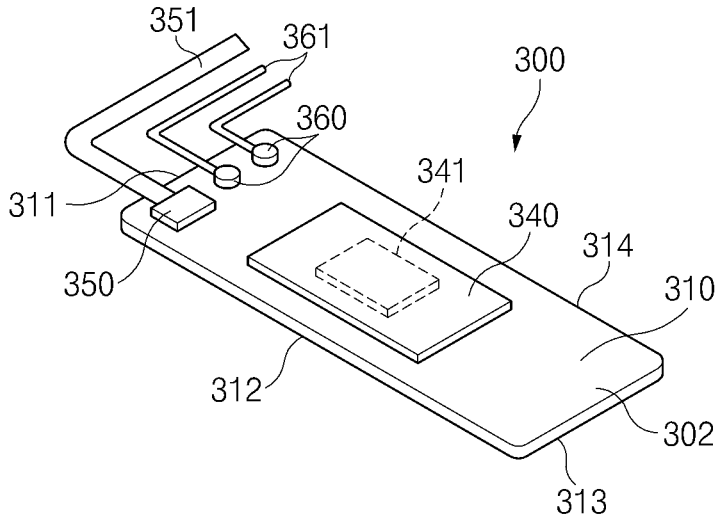
Figure 3C:
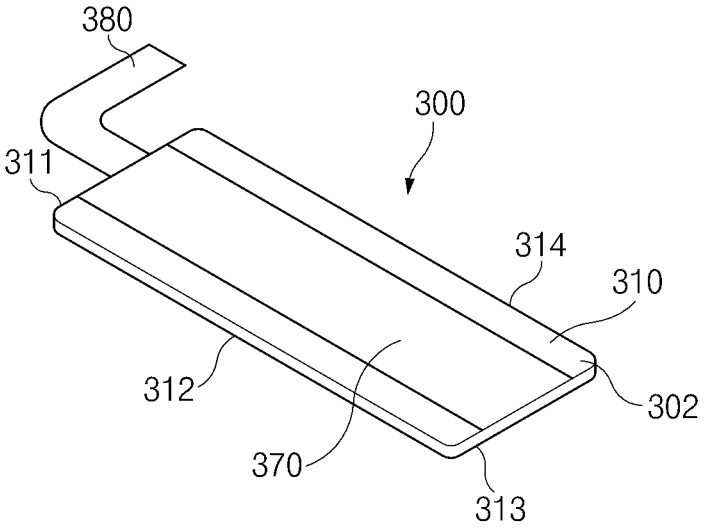

FIGS. 3A, 3B and 3C are perspective views illustrating a communication device according to various embodiments.

Referring to FIGS. 3A, 3B and 3C, at least a portion of a communication device 300 may be similar to the communication device 2200 of FIG. 2B, or the communication device 300 may be variously changed or modified according to various embodiments.

Referring to FIGS. 3A, 3B and 3C, the communication device 300 may include an antenna module (or an antenna structure) and a communication circuit (e.g., the second communication circuit 2230 of FIG. 2A), and the antenna module may include at least one of a first antenna array 321, a second antenna array 331, and a ground region 370.

Referring to FIGS. 3A and 3B, the antenna module and the communication circuit may be positioned at a substrate 310 or may be included in the substrate 310. According to an embodiment, the substrate 310 may be integrally implemented with a main substrate (e.g., the substrate 140 of FIG. 1C) or may be implemented with a separate component.

According to an embodiment, the communication device 300 may include the substrate 310 (e.g., the PCB 2250 of FIG. 2B). According to an embodiment, the substrate 310 may include a first surface 301 and a second surface 302 facing away from the first surface 301.

According to an embodiment, the communication device 300 may be positioned within a housing (e.g., the housing 110 of FIG. 1A) of an electronic device (e.g., the electronic device 100 of FIG. 1A) in such a way that the first surface 301 faces a side member (e.g., the side member 118 of FIG. 1A) or a back plate (e.g., the back surface 110B) of the electronic device.

According to an embodiment, the substrate 310 may be provided in the form of substantially a quadrangle. For example, the substrate 310 may include a first side 311 which extends in a first direction (a "b" direction), a second side 312 which extends in a second direction (an "a" direction), a third side 313 which extends in parallel with the first side 311 in the first direction, and a fourth side 314 which extends in parallel with the second side 312 in the second direction.

According to an embodiment, the side communication device 300 may include the antenna arrays 321 and 331 which are divided (or separated) with respect to the ground region 370. For example, the communication device 300 may include the first antenna array 321 and the second antenna array 331.

According to an embodiment, the communication device 300 may include at least one antenna array (e.g., the first antenna array 321 and/or the second antenna array 331 of FIG. 3A) positioned on/in the substrate 310.

According to an embodiment, the first antenna array 321 may include first antennas 321*a*, 321*b*, 321*c*, and 321*d*, and the second antenna array 331 may include second antennas 331*a*, 331*b*, 331*c*, and 331*d*. The antenna arrays 321 and 331 may include a dual polarized antenna array or may include a single polarized antenna array. The case where the antenna arrays 321 and 331 include the single polarized antenna array is illustrated in FIG. 3A.

According to an embodiment, the first antenna array 321 may include the first antennas 321*a*, 321*b*, 321*c*, and 321*d* which transmit or receive a signal having a specific polarization characteristic. For example, the first antenna array 321 may include the first antennas 321*a*, 321*b*, 321*c*, and 321*d* which form a beam having a horizontal polarization characteristic upon radiating a signal. For example, the first antenna array 321 which is a horizontally polarized antenna array may include a plurality of horizontally polarized antennas (or horizontally polarized antenna elements). The second antenna array 331 may include the second antennas 331*a*, 331*b*, 331*c*, and 331*d* which form a beam having a horizontal polarization characteristic.

According to an embodiment, when viewed from above the first surface 301 of the substrate 310, the ground region 370 may be interposed between the first antenna array 321 and the second antenna array 331. For example, the first antenna array 321 and the second antenna array 331 may be separated (or distinguished) from each other by the ground region 370. According to an embodiment, the ground region 370 may include a ground plane in the substrate 310.

Referring to FIG. 3B, the communication device 300 may include a communication circuit 341 (e.g., the communication circuit 2230 of FIG. 2B) positioned on the second surface 302 of the substrate 310. According to an embodiment, the antenna arrays 321 and 331 may be electrically connected to the communication circuit 341 through a conductive via which passes from the first surface 301 to the second surface 302 of the substrate 310. However, the present disclosure is not limited thereto. For example, the antenna arrays 321 and 331 may be fed through capacitive coupling with the communication circuit 341.

According to an embodiment, the communication device 300 may include a shield can 340 which is mounted on the second surface 302 of the substrate 310 and is positioned in a way to surround the communication circuit 341 (e.g., the communication circuit 2150) for the purpose of shielding a noise.

According to an embodiment, the communication device 300 may include a first terminal 350 and/or a second terminal 360 for connection with a substrate (e.g., the substrate 140 of FIG. 1C) of an electronic device (e.g., the electronic device 100 of FIG. 1C) through at least a portion of the substrate 310. For example, the second terminal 360 may be provided in plurality. According to an embodiment, the terminals 350 and 360 may be electrically connected to a substrate (e.g., the substrate 140 of FIG. 1C) of an electronic device through a first connection member 351 or a second connection member 361, respectively. For example, the second connection member 361 may be provided in plurality. According to an embodiment, the first terminal 350 may be a power terminal, and the second terminal 360 may be an RF terminal.

According to an embodiment, the connection members 351 and 361 may include a flexible printed circuit board (FPCB) or a coaxial cable. According to an embodiment, the first connection member 351 or the second connection member 361 may be implemented in such a way that the first connection member 351 or the second connection member 361 is separated from the substrate 310 or may be implemented in such a way that the first connection member 351 or the second connection member 361 is integrally formed with the substrate 310.

According to an embodiment, the connection members 351 and 361 may extend in a direction (e.g., a −b direction) which faces the second antenna array 331 from a left side, a right side, or a bottom end of the communication circuit 341. According to an embodiment, at least one of the terminals 350 and 360 may be positioned in a region of the substrate 310, which is spaced from a beam pattern direction of the antenna arrays 321 and 331. According to an embodiment, at least one of the terminals 350 and 360 may be positioned in a region of the substrate 310, which is spaced from a beam pattern direction (e.g., a +b direction) of the first antenna array 321.

FIG. 3C is a diagram illustrating the second surface 302 of the substrate 310 according to an embodiment.

Referring to FIG. 3C, an antenna module (or an antenna structure) may be at the substrate 310, and a communication circuit (e.g., the communication circuit 341 of FIG. 3B or the second communication circuit 2230 of FIG. 2A) may not be positioned on the substrate 310 and may be positioned on a substrate which is independent of the antenna module. The antenna module may include, for example, at least one of the first antenna array 321, the second antenna array 331, or the ground region 370. According to an embodiment, the connection members 351 and 361 illustrated in FIG. 3B may be implemented with one third connection member 380 (e.g., a FPCB). According to an embodiment, the third connection member 380 and the substrate 310 may be implemented in such a way that the third connection member 380 and the substrate 310 are separated from each other or may be implemented in such a way that the third connection member 380 and the substrate 310 are integrally formed.

FIGS. 4A, 4B, 4C, and 4D are diagrams illustrating configurations of an antenna array in a communication device according to an embodiment.

Figure 4A:
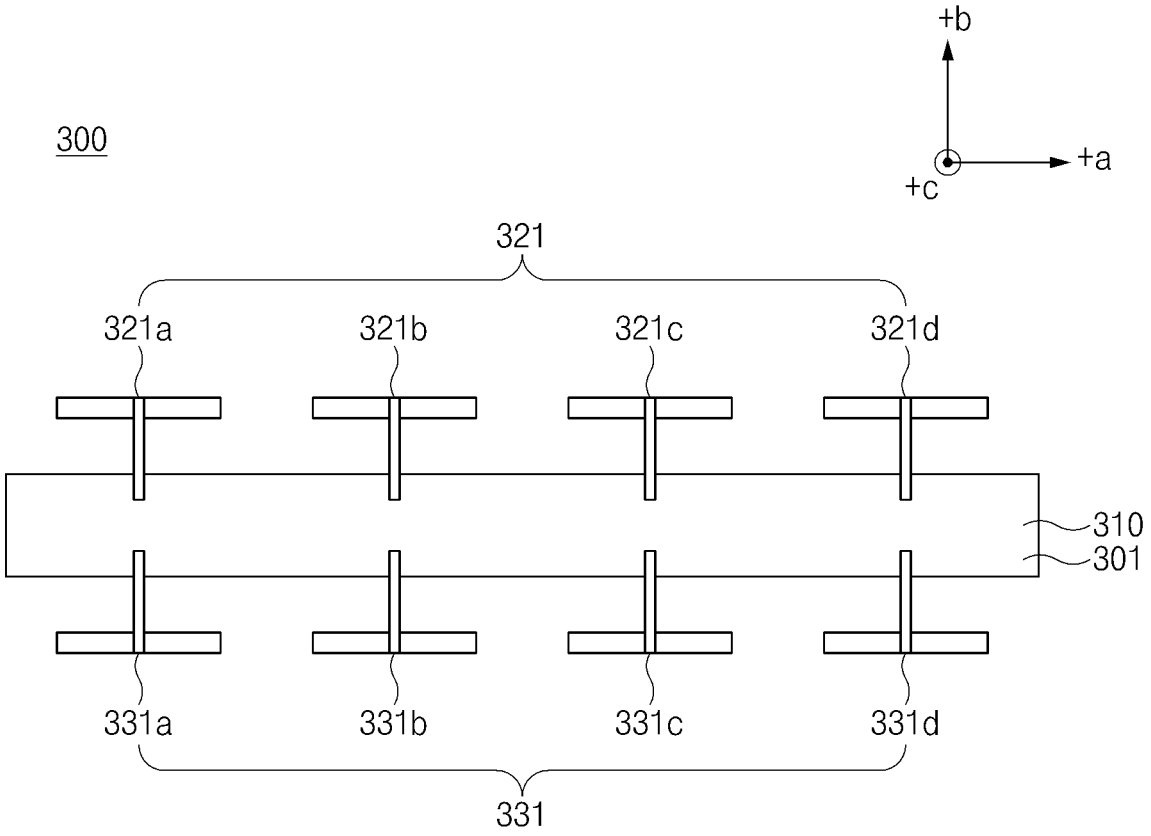
FIGS. 4A, 4B, 4C, and 4D are diagrams illustrating configurations of an antenna array in a communication device according to an embodiment.
Figure 4B:
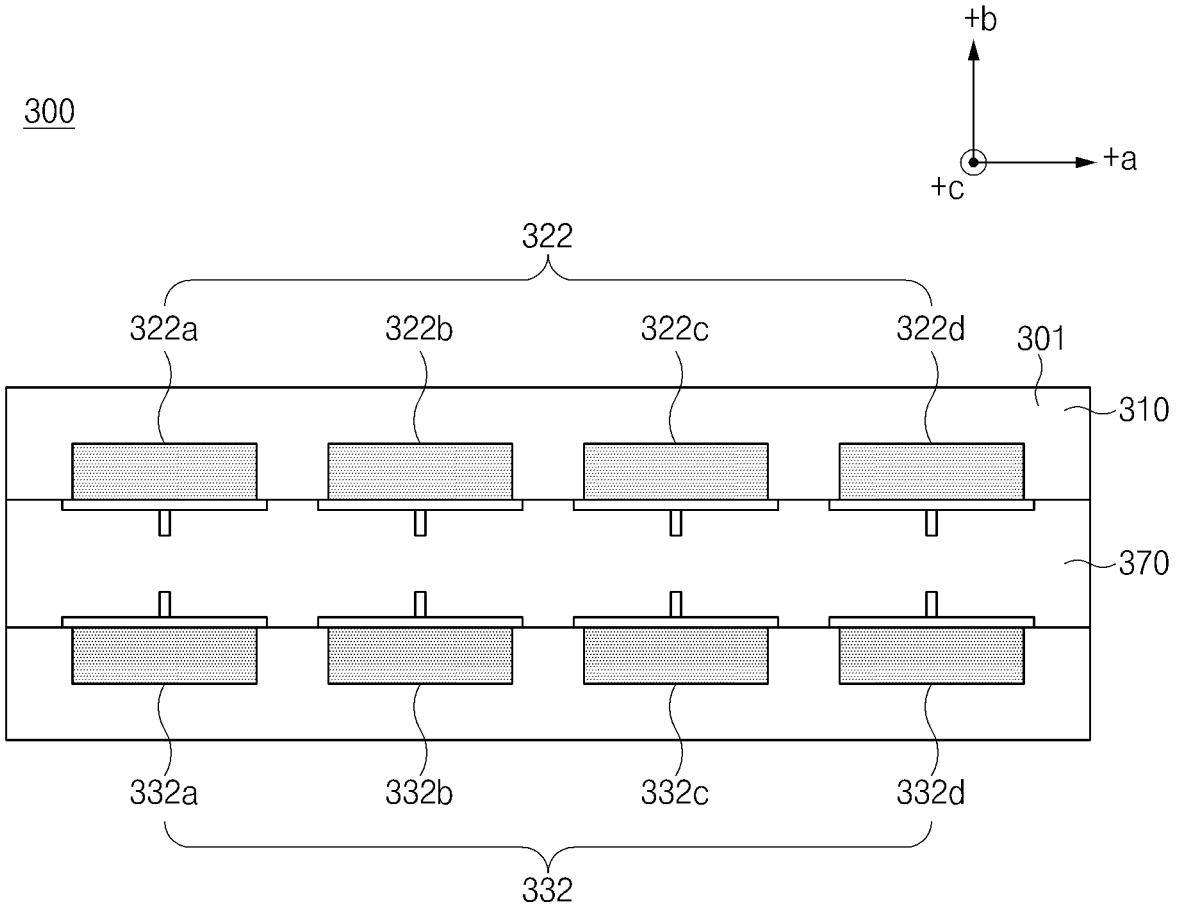

Referring to FIGS. 4A and 4B, the first antenna array 321 (e.g., the first antenna array 321 of FIG. 3A) and the second antenna array 331 (e.g., the second antenna array 331 of FIG. 3A) included in the communication device 300 (e.g., the communication device 300 of FIG. 3A or 3B) may include a single polarized antenna. FIG. 4A illustrates the case where the single polarized antenna is a horizontally polarized antenna. FIG. 4B illustrates the case where the communication device 300 includes a vertically polarized antenna. Below, FIGS. 4A, 4B and 4C will be described with reference to reference marks and configuration names of FIGS. 3A, 3B and 3C for convenience of description.

Referring to FIG. 4A, the first antenna array 321 (e.g., the first antenna array 321 of FIG. 3A) and the second antenna array 331 (e.g., the second antenna array 331 of FIG. 3A) may be positioned on the first surface 301 of the substrate 310 (e.g., the substrate 310 of FIG. 3A or 3B). The first antenna array 321 and the second antenna array 331 may be a horizontally polarized antenna array.

According to an embodiment, the first antenna array 321 may include the first plurality of antennas 321*a*, 321*b*, 321*c*, and 321*d* having a radiation pattern for horizontal polarization. The first antenna array 321 may form a beam according to various embodiments of the present disclosure. For example, the first antenna array 321 may form a beam of a fan shape on a "bc" plane. The beam formed by the first antenna array 321 may be variously changed or modified by the Beam book.

According to an embodiment, the first plurality of antennas 321*a*, 321*b*, 321*c*, and 321*d* may form the first antenna array 321 with a specific array. The case where the specific array is a 1×4 array is illustrated by way of example in FIG. 4A, but the specific array may be variously changed or modified according to various embodiments. For example, the specific array may be "1×N" (N being an integer greater than 2).

According to an embodiment, the second antenna array 331 may include the second plurality of antennas 331*a*, 331*b*, 331*c*, and 331*d* having a radiation pattern for horizontal polarization. The second antenna array 331 may form a beam according to various embodiments of the present disclosure. For example, the second antenna array 331 may form a beam of a fan shape on the "bc" plane. The beam formed by the second antenna array 331 may be variously changed or modified by the Beam book. The second antenna array 331 may be formed to be identical or similar to the first antenna array 321.

According to an embodiment, the first antenna array 321 and the second antenna array 331 may be positioned in a structure in which the first antenna array 321 and the second antenna array 331 are symmetric to each other, with a ground region (e.g., the ground region 370 of FIG. 3A) interposed therebetween. For example, the first antenna 321*a* in the first antenna array 321 may be positioned to be symmetric to the fifth antenna 331*a* in the second antenna array 331, with the ground region interposed therebetween; the second antenna 321*b* may be positioned to be symmetric to the sixth antenna 331*b*, with the ground region interposed therebetween.

According to an embodiment, the first antenna array 321 and the second antenna array 331 may radiate beams in different directions due to polarizations and locations thereof. For example, the first antenna array 321 and the second antenna array 331 may form beams having a horizontal polarization characteristic, and may radiate the beams in different directions, for example, in opposite directions. As illustrated in FIGS. 3A, 3B and 3C, when the first antenna array 321 radiates a beam in the +b direction, the second antenna array 331 may radiate a beam in the −b direction.

Referring to FIG. 4B, a third antenna array 322 and a fourth antenna array 332 may be positioned on the first surface 301 of the substrate 310 (e.g., the substrate 310 of FIG. 3A or 3B). The third antenna array 322 and the fourth antenna array 332 may be a vertically polarized antenna array.

According to an embodiment, the third antenna array 322 may include a third plurality of antennas 322*a*, 322*b*, 322*c*, and 322*d* having a vertical polarization characteristic. The third plurality of antennas 322*a*, 322*b*, 322*c*, and 322*d* may form the third antenna array 322 with a specific array. The case where the specific array is a 1×4 array is illustrated by way of example in FIG. 4B, but the specific array may be variously changed or modified according to various embodiments. For example, the specific array may be "1×N" (N being an integer greater than 2).

According to an embodiment, the fourth antenna array 332 may include a fourth plurality of antennas 332*a*, 332*b*, 332*c*, and 332*d* having a vertical polarization characteristic. The fourth antenna array 332 may be formed to be identical or similar to the third antenna array 322.

According to an embodiment, the third antenna array 322 and the fourth antenna array 332 may be positioned in a structure in which the third antenna array 322 and the fourth antenna array 332 are symmetric to each other, with a ground region (e.g., the ground region 370 of FIG. 3A) interposed therebetween. For example, the ninth antenna 322*a* in the third antenna array 322 may be positioned to be symmetric to the thirteenth antenna 332*a* in the fourth antenna array 332, with the ground region interposed therebetween; the tenth antenna 322*b* may be positioned to be symmetric to the fourteenth antenna 332*b*, with the ground region interposed therebetween.

According to an embodiment, the third antenna array 322 and the fourth antenna array 332 may form beam patterns of different directions. For example, the third antenna array 322 and the fourth antenna array 332 may form beams of vertical polarization in opposite directions. Upon transmitting/receiving a signal, the third antenna array 322 may form a beam in the +b direction, and the fourth antenna array 332 may form a beam in the −b direction.

Figure 4C:
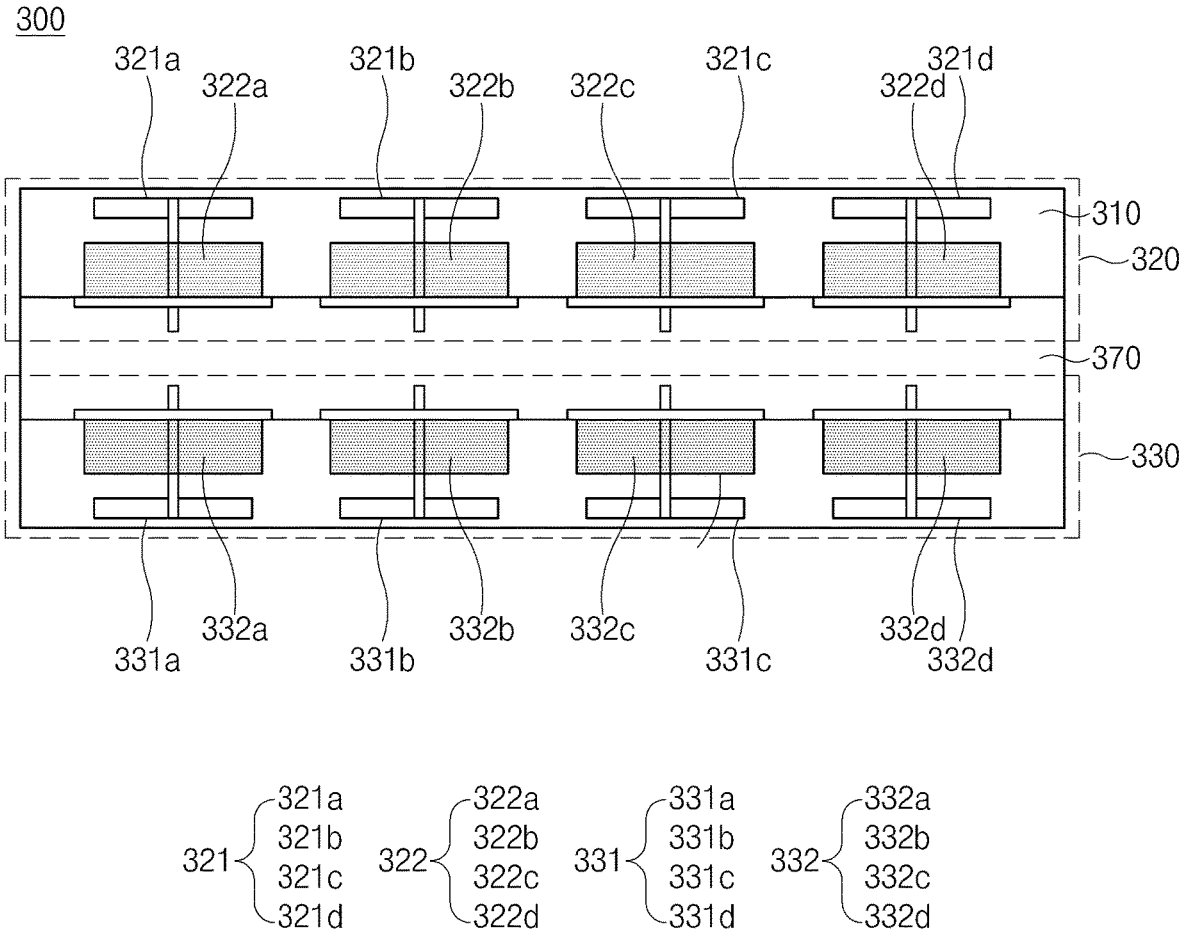

Referring to FIG. 4C, the communication device 300 may include the plurality of antenna arrays, and may also include a plurality of antenna groups 320 and 330 spaced from each other by the ground region 370.

For example, the communication device 300 may include the first antenna array group 320 and the second antenna array group 330. The first antenna array group 320 and the second antenna array group 330 may include a dual polarized antenna array. The first antenna array group 320 may include the first antenna array 321 and the third antenna array 322 forming different polarization, and the second antenna array group 330 may include the second antenna array 331 and the fourth antenna array 332.

According to an embodiment, the first antenna array 321 and the second antenna array 331 may be identical or similar to the first antenna array 321 and the second antenna array 331 of FIG. 4A. The third antenna array 322 and the fourth antenna array 332 may be identical or similar to the third antenna array 322 and the fourth antenna array 332 of FIG. 4B.

According to an embodiment, the first antenna array group 320 and the second antenna array group 330 may be positioned not to overlap each other, when viewed from above a first surface (e.g., the first surface 301 of FIG. 4B) of the substrate 310. The ground region 370 may be interposed between the first antenna array group 320 and the second antenna array group 330.

According to an embodiment, the first antenna array group 320 and the second antenna array group 330 may be substantially symmetric to each other in structure, with the ground region 370 interposed therebetween.

Figure 4D:
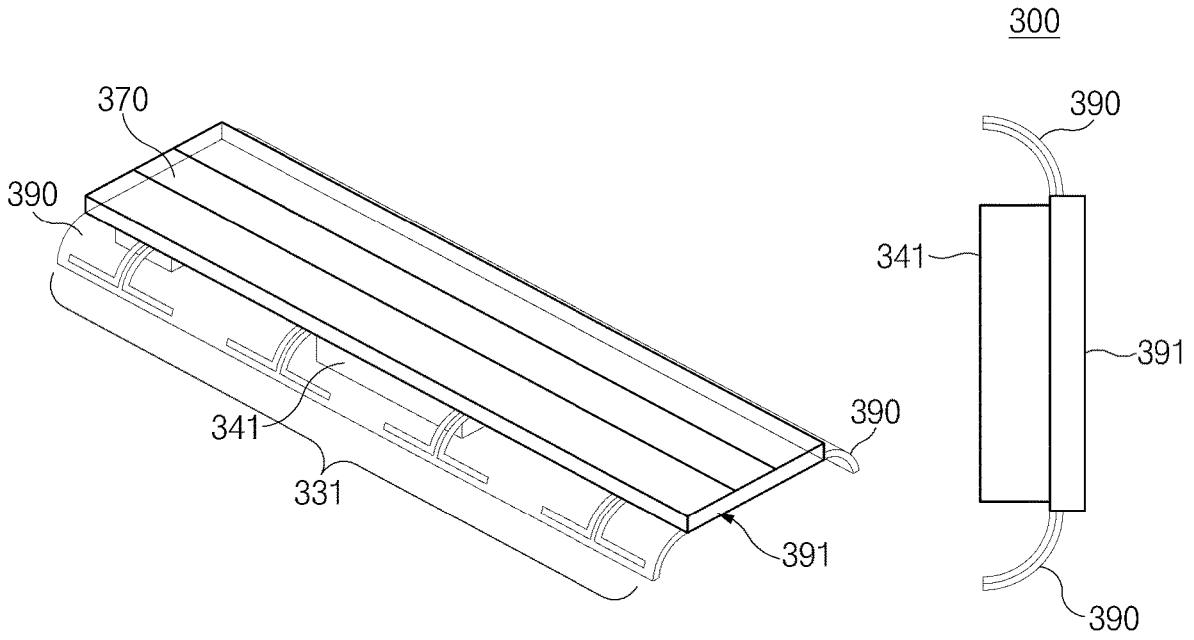

Referring to FIG. 4D, at least a portion of the communication device 300 may be implemented with a FPCB 390. According to an embodiment, another portion of the communication device 300 may include a PCB 391 which is different from the FPCB 390 in property. For example, the PCB 391 may be a rigid PCB. According to an embodiment, the FPCB 390 and/or the PCB 391 may be included within the substrate 310 of FIGS. 3B and 3C.

According to an embodiment, at least one antenna array (e.g., the first antenna array 321 or the second antenna array 331) may be positioned at the FPCB 390. According to an embodiment, the communication circuit 341 (e.g., the communication circuit 341 of FIG. 3B or the second communication circuit 2230 of FIG. 2A) may be positioned on the PCB 391. A region for forming an antenna array may be implemented, for example, at the low-loss FPCB 390. According to an embodiment, the ground region 370 may be positioned at the PCB 391.

According to an embodiment, if the PCB 391 and the FPCB 390 are implemented separately, it may be efficient to mount the communication device 300 because a mounting height of the communication device 300 decreases. For example, when a radiation direction of at least one antenna array is positioned to face a front surface (e.g., the front surface 110A of FIG. 1A) or a back surface (e.g., the back surface 110B of FIG. 1B) of an electronic device (e.g., the electronic device 100 of FIG. 1A), a mounting height of a side surface (e.g., the side surface 110C of FIG. 1A) may decrease.

Figure 5:
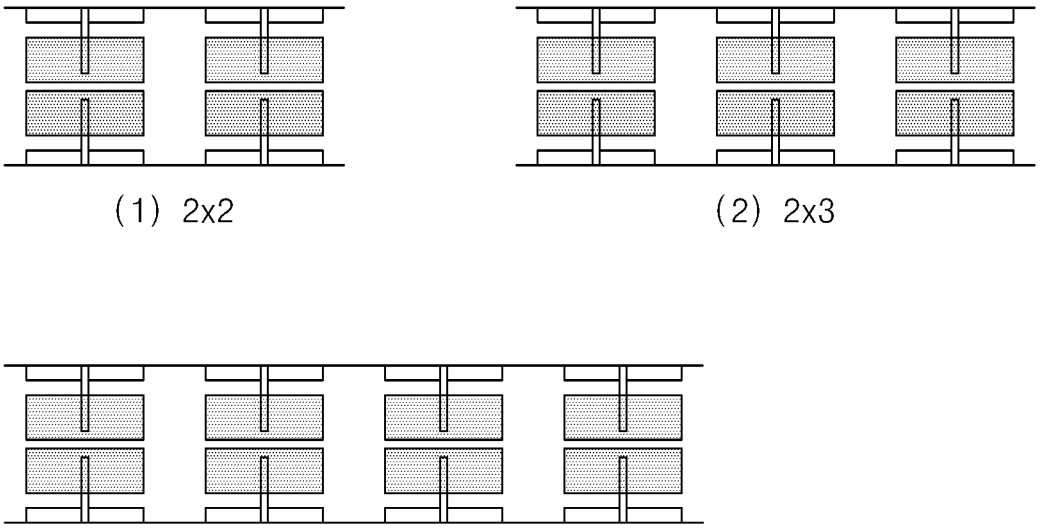
FIG. 5 is a diagram illustrating arrays of antennas in a communication device according to an embodiment.

FIG. 5 is a diagram illustrating arrays of antenna array groups in a communication device according to an embodiment.

According to an embodiment, antenna array groups in a communication device (e.g., the communication device 300 of FIG. 3B) may have various arrays.

According to an embodiment, the antenna array groups in the communication device may have an array (or a matrix) of "M×N" (M being an integer equal to or greater than 1, and N being an integer equal to or greater than 2). According to an embodiment, "M" may correspond to the number of antenna array groups. According to an embodiment, "N" may correspond to the number of antennas forming one antenna array.

According to an embodiment, an antenna array group may be implemented with a single polarized antenna array group or a dual polarized antenna array group. In the case of the single polarized antenna array group, one antenna array group may include one antenna array. In the case of the dual polarized antenna array group, the one antenna array group may include a plurality of antenna arrays having different beam patterns. The case where one antenna array group includes a dual polarized antenna array group is illustrated in FIG. 5.

According to an embodiment, "M" and "N" may be various combined. The case where "M" is 2 is illustrated in (1), (2), and (3) of FIG. 5. In this case, an antenna module in a communication device may include two antenna array groups.

(1) of FIG. 5 illustrates an array (2×2) of antenna array groups corresponding to the case where "N" is 2, (2) of FIG. 5 illustrates an array (2×3) of antenna array groups corresponding to the case where "N" is 3, and (3) of FIG. 5 illustrates an array (2×4) of antenna array groups corresponding to the case where "N" is 4.

The cases where "N" is 2, 3, and 4 are illustrated in FIG. 5, but various embodiments of the present disclosure are not limited thereto. For example, an array of antenna array groups may be various changed or modified.

Figure 6A:
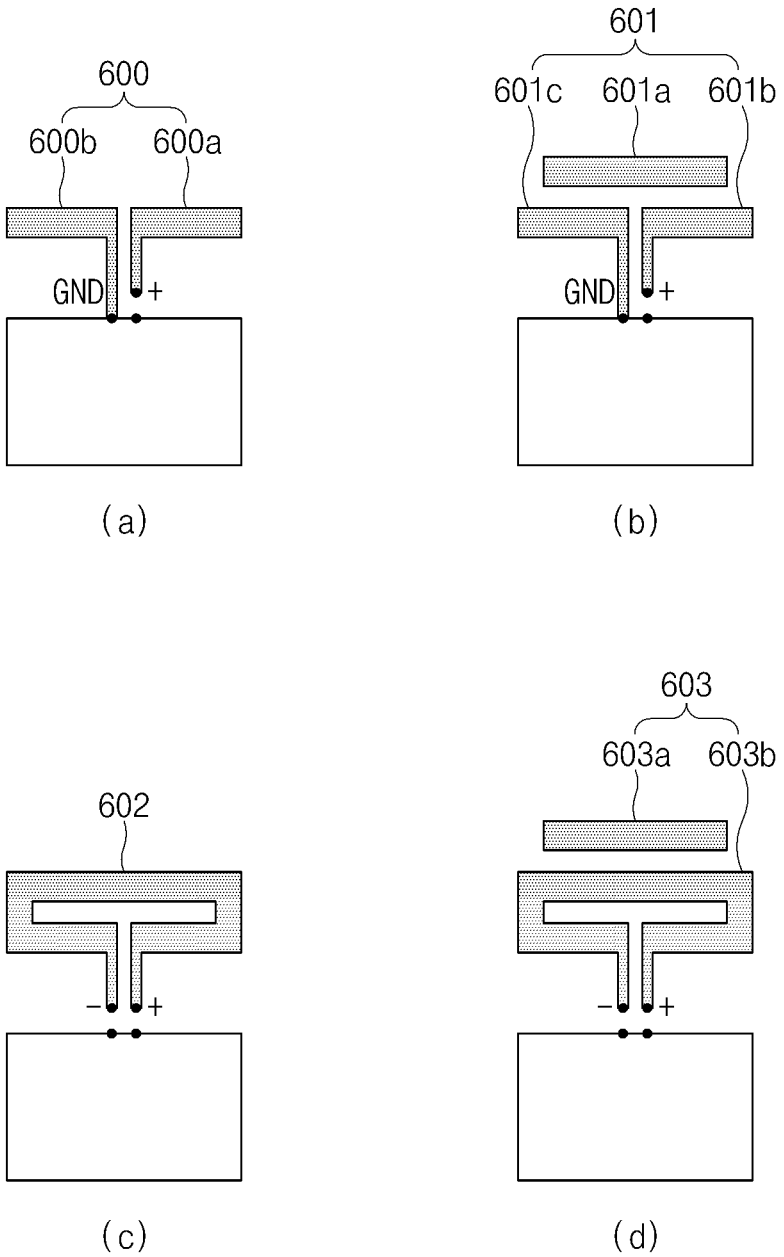
FIGS. 6A and 6B are diagrams illustrating various embodiments of an antenna according to an embodiment.
Figure 6B:
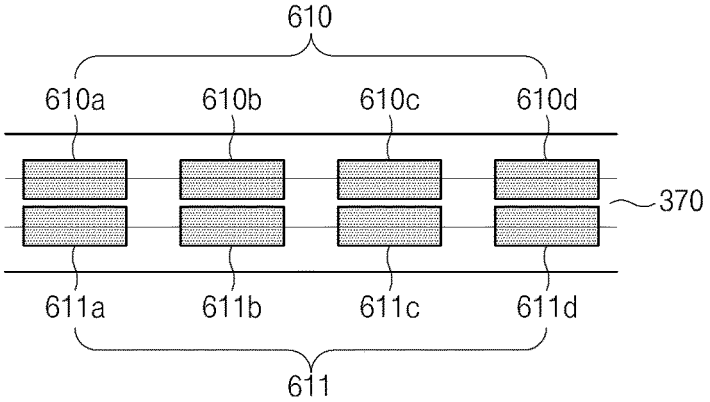
Figure 6B:
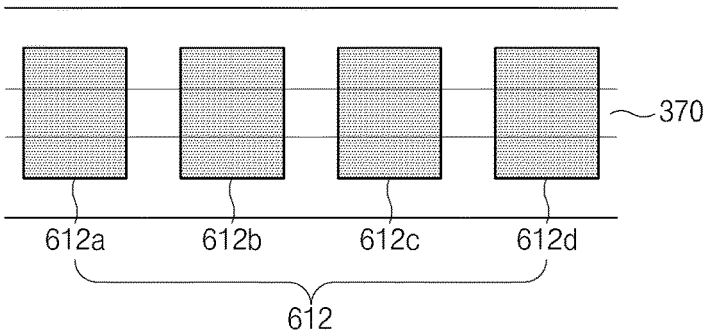
Figure 6B:
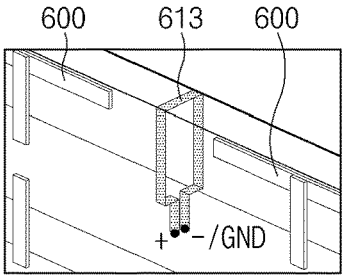
Figure 6B:
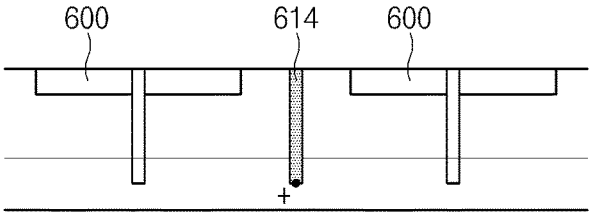

FIGS. 6A and 6B are diagrams illustrating various embodiments of an antenna according to an embodiment.

According to an embodiment, a polarized antenna array included in a communication device (e.g., the communication device 300 of FIG. 3A) may be variously formed. FIG. 6A illustrates various embodiments of a horizontally polarized antenna forming a horizontally polarized antenna array (e.g., the first antenna array 321 or the second antenna array 331 of FIG. 4C), and FIG. 6B illustrates various embodiments of a vertically polarized antenna forming a vertically polarized antenna array (e.g., the third antenna array 322 or the fourth antenna array 332 of FIG. 4C).

Referring to FIG. 6A, a horizontally polarized antenna array may be implemented with at least one of (a) a dipole antenna 600, (b) a dipole antenna 601 including a director or a dual band coupler 601*a*, (c) a folded dipole antenna 602, or (d) a folded dipole antenna 603 including a director or a dual band coupler 603*a*, or a combination thereof.

According to various embodiments, an antenna array may include an antenna having various structures depending on a resonance characteristic, a feed characteristic, and/or a shape characteristic.

According to an embodiment, an antenna may include a single resonance antenna or a dual resonance antenna depending on a resonance manner. Referring to FIG. 6A, the dipole antenna 600 (refer to (a) of FIG. 6A) and/or the folded dipole antenna 602 (refer to (c) of FIG. 6A) having a single pattern depending on an antenna pattern may be a single resonance antenna. The dipole antenna 601 (refer to (b) of FIG. 6A) including the director or the dual band coupler 601*a* as an additional pattern and/or the folded dipole antenna 603 (refer to (d) of FIG. 6A) including the director or the dual band coupler 603*a* as an additional pattern may be a dual resonance antenna.

According to an embodiment, the dipole antenna 600 (refer to (a) of FIG. 6A) may include a first antenna element 600*a* and a second antenna element 600*b*. The dipole antenna 601 (refer to (b) of FIG. 6A) including the director or the dual band coupler 601*a* may further include the director or the dual band coupler 601*a* in addition to a dipole antenna structure including a first antenna element 601*b* and a second antenna element 601*c*. The folded dipole antenna 602 (refer to (c) of FIG. 6A) may operate by providing an electrical signal to one antenna element having a folded shape. The folded dipole antenna 603 (refer to (d) of FIG. 6A) including a director or a dual band coupler may further include one antenna element 603*b* having a folded shape and a director or the dual band coupler 603*a* which may be electrically connected to the one antenna element 603*b*.

According to various embodiments, various feed structures may be used for the purpose of supplying a signal to antennas. For example, the feed structures may include a single feed structure or a dual feed structure. A way to feed a dipole antenna will be described with reference to FIG. 6A.

According to various embodiments, a dipole antenna may have a single feed structure or a dual feed (or balanced feed) structure. A feed part may be placed at the first antenna element 600*a* of the first antenna element 600*a* and the second antenna element 600*b* forming the dipole antenna 600 (refer to (a) of FIG. 6A), and the second antenna element 600*b* may be electrically connected to a ground region. A first feed part may be placed at a partial region (or one end) of an antenna element forming the folded dipole antenna 602 (refer to (c) of FIG. 6A), and a second feed part may be placed at another partial region (or an opposite end) of the antenna element. Signals of opposite phases (e.g., signals having a phase difference of 180 degrees) may be provided to the first feed part and the second feed part.

The feed structures of (a), (b), (c) and (d) of FIG. 6A may be an example. For example, the dual feed structure may be applied to (a) and (b) of FIG. 6A, and the single feed structure may be applied to (c) and (d) of FIG. 6A.

Referring to FIG. 6B, a vertically polarized antenna array may be implemented with (a) ((a) is a λ/4 patch antenna 610*a* and λ corresponds to a wavelength and a multiplication of a radiated signal), (b) a patch antenna ((b) is a λ patch antenna 612*a*), (*c*) a loop antenna 613, or (d) a monopole antenna 614, or a combination thereof.

Referring to (a) of FIG. 6B, a first plurality of λ/4 patch antennas 610*a*, 610*b*, 610*c*, and 610*d* may form a first antenna array 610, and a second plurality of λ/4 patch antennas 611*a*, 611*b*, 611*c*, and 611*d* may form a second antenna array 611. The first antenna array 610 and the second antenna array 611 may be positioned, with the ground region 370 interposed therebetween.

Referring to (b) of FIG. 6B, a third plurality of λ patch antennas 612*a*, 612*b*, 612*c*, and 612*d* may form a third antenna array 612. The third plurality of λ patch antennas 612*a*, 612*b*, 612*c*, and 612*d* may be positioned to overlap the ground region 370.

Referring to (c) of FIG. 6B, a first feed part may be placed at a partial region of an antenna element forming the loop antenna 613, and a second feed part or a ground part GND may be placed at another partial region of the antenna element. In the case where a dual feed structure is applied to the loop antenna, signals of opposite phases (e.g., signals having a phase difference of 180 degrees) may be provided to the first feed part and the second feed part. In the case where the loop antenna 613 is positioned together with an antenna of a horizontal polarization characteristic, for example, the dipole antennas 600, the loop antenna 613 may be interposed between the dipole antennas 600.

Referring to (d) of FIG. 6B, a feed part may be placed at one end of an antenna element forming a monopole antenna 614, and an electrical signal may be provided to the monopole antenna 614 through the feed part. In the case where the monopole antenna 614 is positioned together with an antenna of a horizontal polarization characteristic, for example, the dipole antennas 600, the monopole antenna 614 may be interposed between the dipole antennas 600.

In the following embodiments and drawings associated with the embodiments, for convenience of description, a dipole antenna may be used as an example of a horizontally polarized antenna, and a patch antenna may be used as an example of a vertically polarized antenna.

Figure 7:
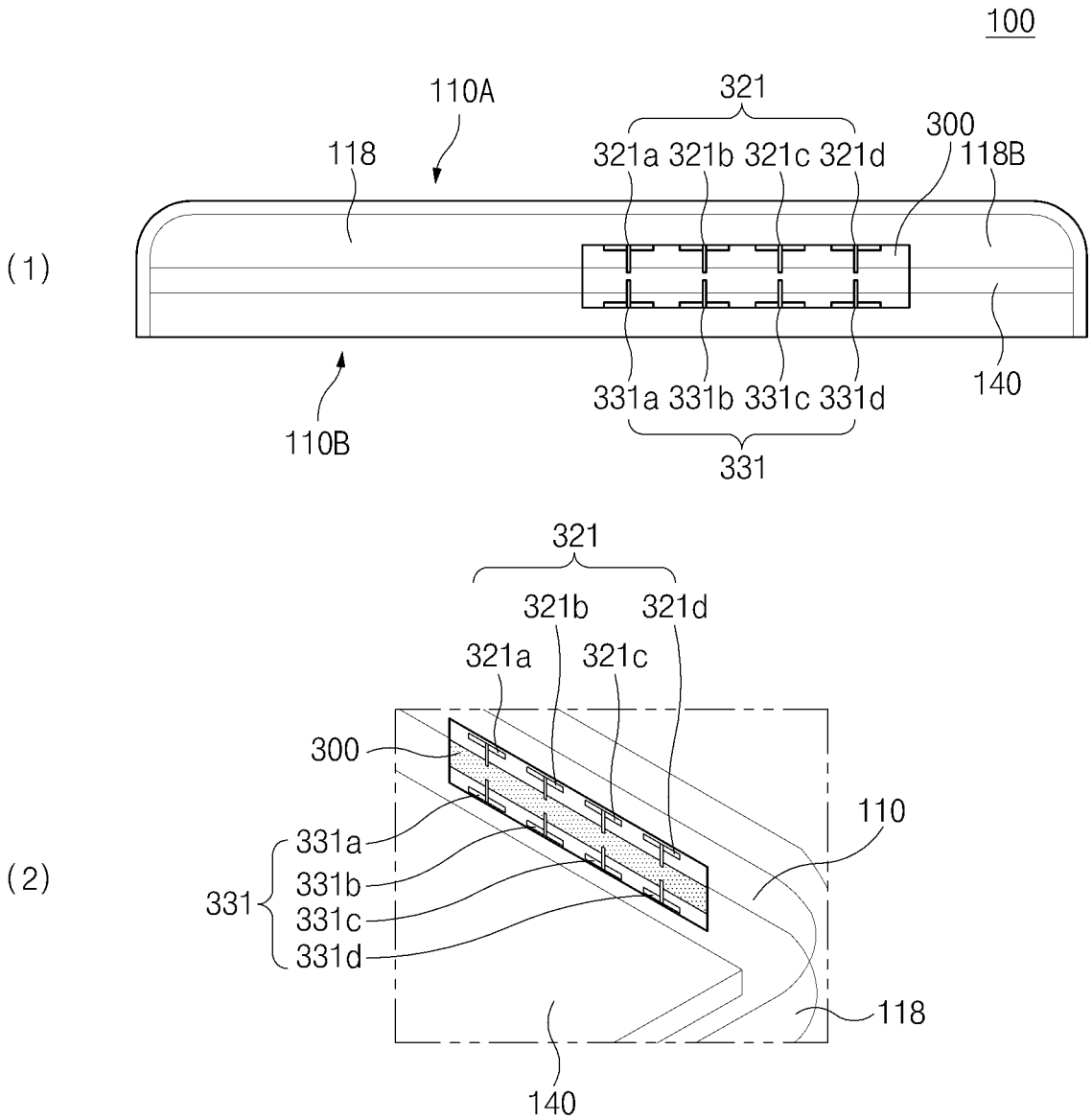
FIG. 7 is a diagram illustrating placement of a communication device in an electronic device according to an embodiment.

FIG. 7 is a diagram illustrating placement of a communication device in an electronic device according to an embodiment.

Referring to FIG. 7, a first surface (e.g., the first surface 301 of FIG. 3A) or a second surface (e.g., the second surface 302 of FIG. 3A) of the communication device 300 (e.g., the communication device 300 of FIG. 3A or 3B) in the electronic device 100 (e.g., the electronic device 100 of FIGS. 1A to 1C) may be positioned to face the side member 118 of the electronic device 100.

(1) of FIG. 7 is a front perspective view of the electronic device 100 seen from above one side (e.g., the second side 118B) of sides forming the side member 118, and (2) of FIG. 7 is a perspective view of the electronic device 100 seen from above another side (e.g., the third side 118C) different from the one side.

Referring to (1) and (2) of FIG. 7, the first surface on which the antenna arrays 321 and 331 of the communication device 300 are positioned may be positioned to face the side member 118. For example, the first surface or the second surface of the communication device 300 may be interposed between the first surface 110A and the second surface 110B of the electronic device 100 so as to be perpendicular to the first surface 110A and/or the second surface 110B.

According to an embodiment, at least a portion of the side member 118 may be formed of metal. According to an embodiment, the first surface or the second surface of the communication device 300 may be determined to face a specific side (e.g., 118B) of the side member 118.

According to an embodiment, the communication device 300 may include the first antenna array 321 (e.g., the first antenna array 321 of FIG. 3A) and the second antenna array 331 (e.g., the second antenna array 331 of FIG. 3A). According to an embodiment, the communication device 300 may be positioned to be perpendicular to the substrate 140, the front surface 110A, and/or the back surface 110B such that the first antenna array 321 radiates a beam toward the front surface 110A of the electronic device 100 and the second antenna array 331 radiates a beam toward the back surface 110B, thereby making it possible to minimize and/or reduce the deformation of an antenna radiation beam due to the side member 118. For example, a radiation pattern which the antennas 321*a*, 321*b*, 321*c*, and 321*d* included in the first antenna array 321 form may face the front surface 110A, and a radiation pattern which the antennas 331*a*, 331*b*, 331*c*, and 331*d* included in the second antenna array 331 form may face the back surface 110B. For another example, a radiation pattern which the antennas 321*a*, 321*b*, 321*c*, and 321*d* included in the first antenna array 321 form may face the back surface 110B, and a radiation pattern which the antennas 331*a*, 331*b*, 331*c*, and 331*d* included in the second antenna array 331 form may face the front surface 110A.

Figure 8A:
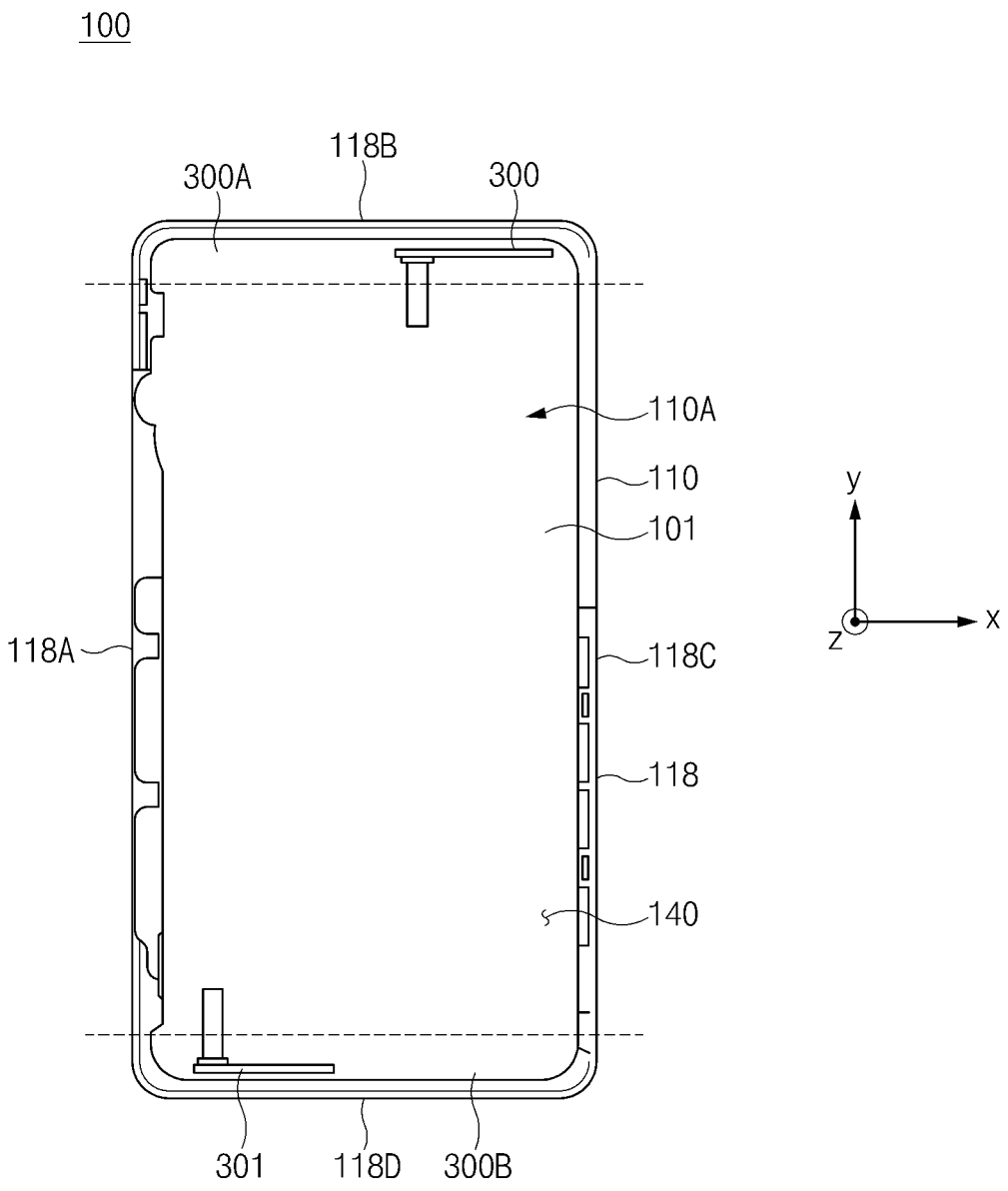
FIGS. 8A and 8B are diagrams illustrating configurations of a communication device in an electronic device according to an embodiment.
Figure 8B:
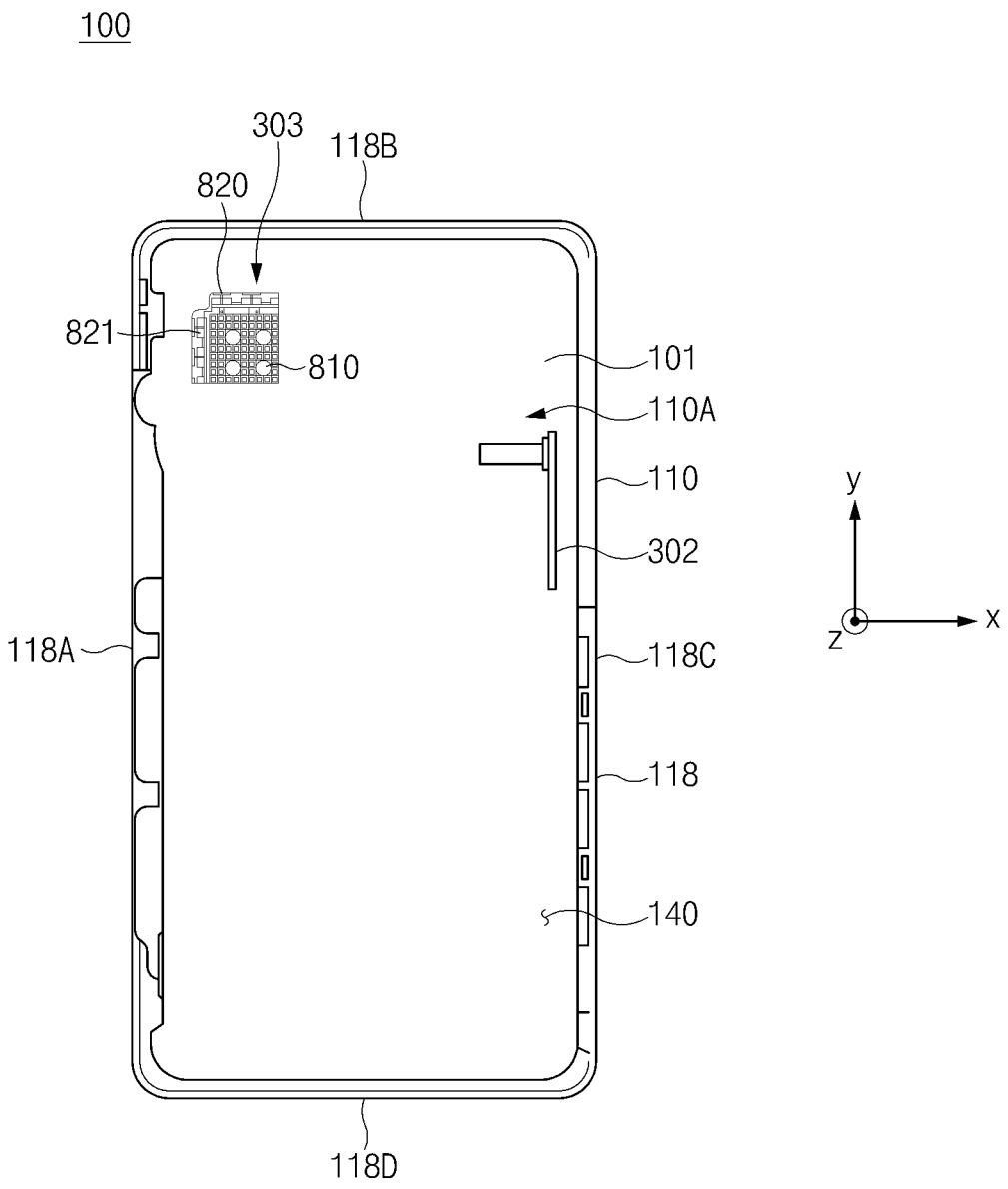

FIGS. 8A and 8B are diagrams illustrating configurations of an electronic device where a communication device is positioned, according to an embodiment.

Referring to FIG. 8A, communication devices 300 and 301 (e.g., the communication device 300 of FIG. 3A or 3B) may be positioned within the housing 110 of the electronic device 100, and may be respectively positioned in regions 300A and 300B between the side member 118 and the display 101 of the electronic device 100 (e.g., the electronic device 100 of FIGS. 1A to 1C). In the following description, a configuration in which the communication devices 300 and 301 are electrically connected to the substrate 140 positioned within the electronic device 100 may be identical or similar to the configuration described above. Thus, additional description will be omitted to avoid redundancy.

According to an embodiment, the first region 300A and the second region 300B may be a region where at least a portion of a conductive material which is present between the side member 118 and the display 101 and in the electronic device 100 may be removed. According to an embodiment, at least a portion of the side member 118 may include a conductive material (e.g., metal). For example, the second side 118B of the side member 118 may be formed of metal.

According to an embodiment, the first region 300A may be a region where at least a portion of a conductive material present between the second side 118B of the side member 118 and the display 101 may be removed, when viewed from above the first surface 110A of the electronic device 100; the second region 300B may be a region where at least a portion of a conductive material present between a fourth side 118D of the side member 118 and the display 101 may be removed, when viewed from above the first surface 110A.

According to an embodiment, the first communication device 300 may be positioned in the first region 300A. For example, the first communication device 300 may be positioned in the first region 300A so as to face the second side 118B of the side member 118.

According to an embodiment, a first antenna array (e.g., the first antenna array 321 of FIG. 3A) and a second antenna array (e.g., the second antenna array 331 of FIG. 3A) of the first communication device 300 may form beam patterns facing opposite directions. According to an embodiment, a beam pattern of a direction (e.g., a −z to +z direction) facing away from the front surface 110A of the housing 110 may be formed by the first antenna array. According to an embodiment, a beam pattern of a direction (e.g., a −z direction) facing the back surface 110B of the housing 110 may be formed by the second antenna array.

According to an embodiment, the first communication device 300 may include a third antenna array (e.g., the third antenna array 322 of FIG. 4B) forming a beam pattern of the same direction as the first antenna array, and a fourth antenna array (e.g., the fourth antenna array 332 of FIG. 4B) forming a beam pattern of the same direction as the second antenna array.

According to an embodiment, a structure of the second communication device 301 may be identical or similar to the structure of the first communication device 300.

According to an embodiment, the second communication device 301 may be positioned in the second region 300B. The second communication device 301 may be positioned in the second region 300B so as to face the fourth side 118D of the side member 118.

According to an embodiment, a beam pattern of a direction (e.g., a −z to +z direction) facing away from the front surface 110A may be formed by a first antenna array of the second communication device 301, and a beam pattern of a direction (e.g., a +z to −z direction) facing away from the back surface 110B of the housing 110 may be formed by a second antenna array of the second communication device 301.

Referring to FIG. 8B, communication devices 302 and 303 may be interposed between the front surface 110A of the electronic device 100 (e.g., the electronic device 100 of FIGS. 1A to 1C) and the substrate 140, or may be positioned in a region between the side member 118 and the display 101.

According to an embodiment, the third communication device 302 may be identical or similar to the first communication device 300 of FIG. 8A. A description associated with the placement of the third communication device 302 may refer to the description of FIG. 8A. The third communication device 302 may be positioned to face the third side 118C (or the first side 118A) of the side member 118, the length of which is long.

According to an embodiment, the third communication device 302 may further include a third antenna array (e.g., the third antenna array 322 of FIG. 4B) and a fourth antenna array (e.g., the fourth antenna array 332 of FIG. 4B). The third antenna array and the fourth antenna array may form a beam having a vertical polarization characteristic.

Referring to FIG. 8B, the communication devices 302 and 303 may have different structures. For example, the third communication device 302 may include a first antenna array (e.g., the first antenna array 321 of FIG. 3A) and a second antenna array (e.g., the second antenna array 331 of FIG. 3A), which are a horizontally polarized antenna, with the ground region 370 of FIG. 4A interposed therebetween. The fourth communication device 303 may include a first antenna array 810 of a patch shape, a second antenna array 820 aligned in a first direction, and/or a third antenna array 821 aligned in a second direction. The second direction may be perpendicular to the first direction.

According to an embodiment, the fourth communication device 303 may include the first antenna array 810 which transmits/receives a signal in one direction, the second antenna array 820 which transmits/receives a direction (e.g., a +z direction) different from the one direction, and/or the third antenna array 821 which transmits/receives a signal in a direction (e.g., a −x direction) different from the directions.

The fourth communication device 303 may radiate an RF signal toward a side surface of an electronic device (e.g., the electronic device 100 of FIG. 1A) using the second antenna array 820 and the third antenna array 821. For example, the second antenna array 820 may be aligned along any one side (e.g., the second side 118B) of the side member 118, and the third antenna array 821 may be aligned along another side (e.g., the first side 118A) perpendicular to the one side.

According to an embodiment, the third communication device 302 and the fourth communication device 303 may be positioned to be spaced from each other. For example, in the case where the third communication device 302 is adjacent to the third side 118C of the side member 118, the fourth communication device 303 may be positioned to be adjacent to the first side 118A opposite to the third side 118C and to be spaced from the third communication device 302 on the first side 118A. For example, in the case where the third communication device 302 is adjacent to the center of the third side 118C, the fourth communication device 303 may be adjacent to any one of opposite ends of the first side 118A. For example, the fourth communication device 303 may be positioned at a top end or a bottom end of the electronic device 100. When the first side 118A and the third side 118C are gripped by a user, the electronic device 100 may use the fourth communication device 303, and thus, the reduction of performance of an antenna may be prevented and/or reduced.

The electronic device 100 may radiate a signal toward a side surface, a front surface, and/or a back surface through the fourth communication device 303. In FIG. 8B, a patch antenna array is illustrated by way of example as the first antenna array 810, and the patch antenna array is illustrated by way of example as a patch antenna element (or a patch antenna) of a 2×2 array. However, the patch antenna array may have various array structures.

According to the placement of the communication devices 302 and 303 of FIG. 8B, the electronic device 100 may maintain performance of radiation using the various communication devices 302 and 303 depending on an external environment. For example, in the case where the user grips both sides 118A and 118C of the electronic device 100, performance of radiation of the third communication device 302 may be reduced. In this case, the electronic device 100 may transmit/receive a given signal using the fourth communication device 303. In the case where the user grips top and bottom sides 118B and 118D of the electronic device 100, performance of radiation of the fourth communication device 303 may be reduced. In this case, the electronic device 100 may transmit/receive a given signal using the third communication device 302.

According to an embodiment, the electronic device 100 may only include the third communication device 302 and the fourth communication device 303. For another example, various combinations of the third communication device 302 and the fourth communication device 303 of FIGS. 8A and 8B may be positioned within the electronic device 100. For example, the electronic device 100 may include the first communication device 300 to the fourth communication device 303. Besides, the electronic device 100 may include additional communication devices.

Figure 9A:
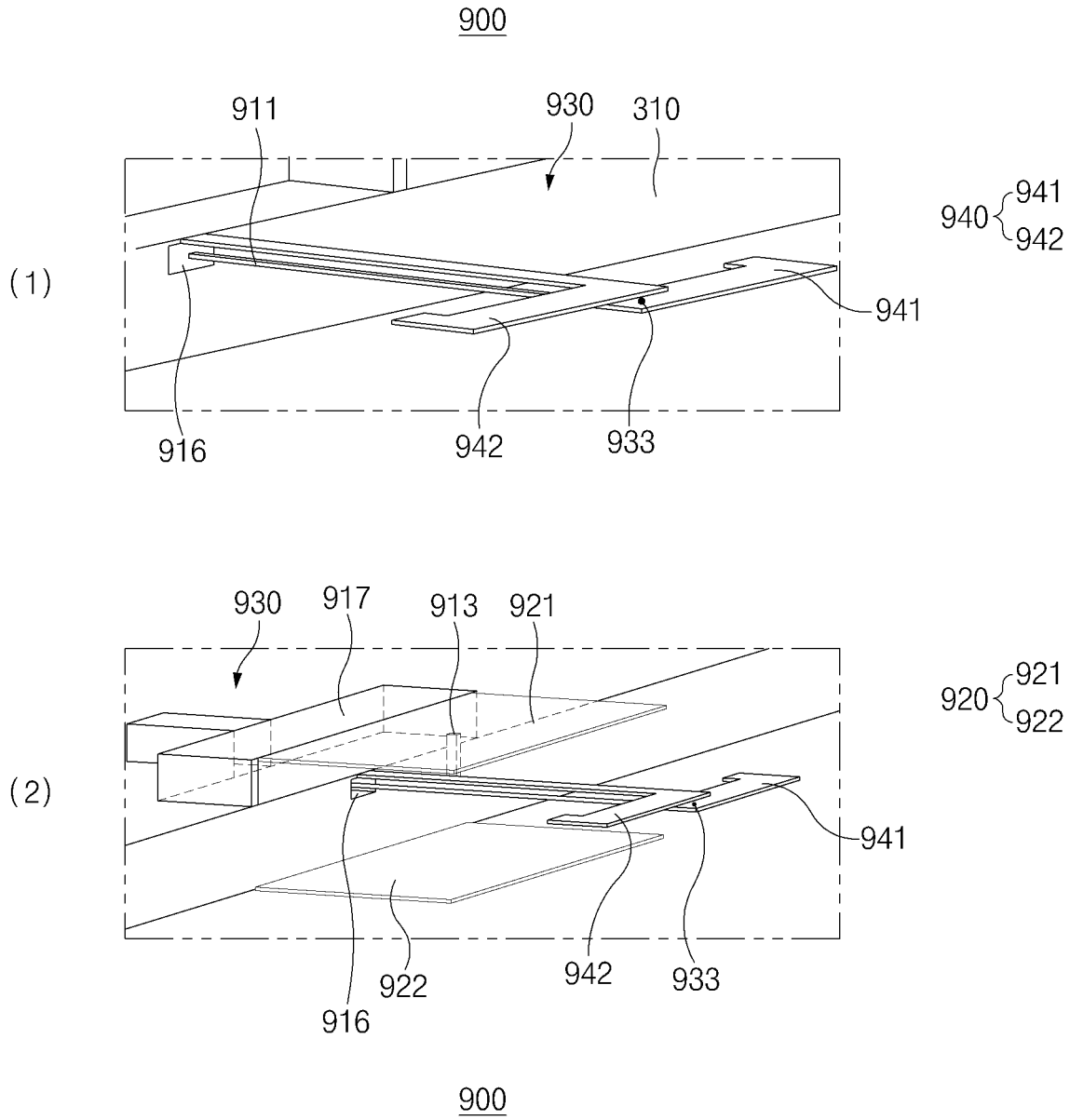
FIGS. 9A, 9B and 9C are perspective views of an electronic device including a first antenna and a second antenna according to an embodiment.
Figure 9B:
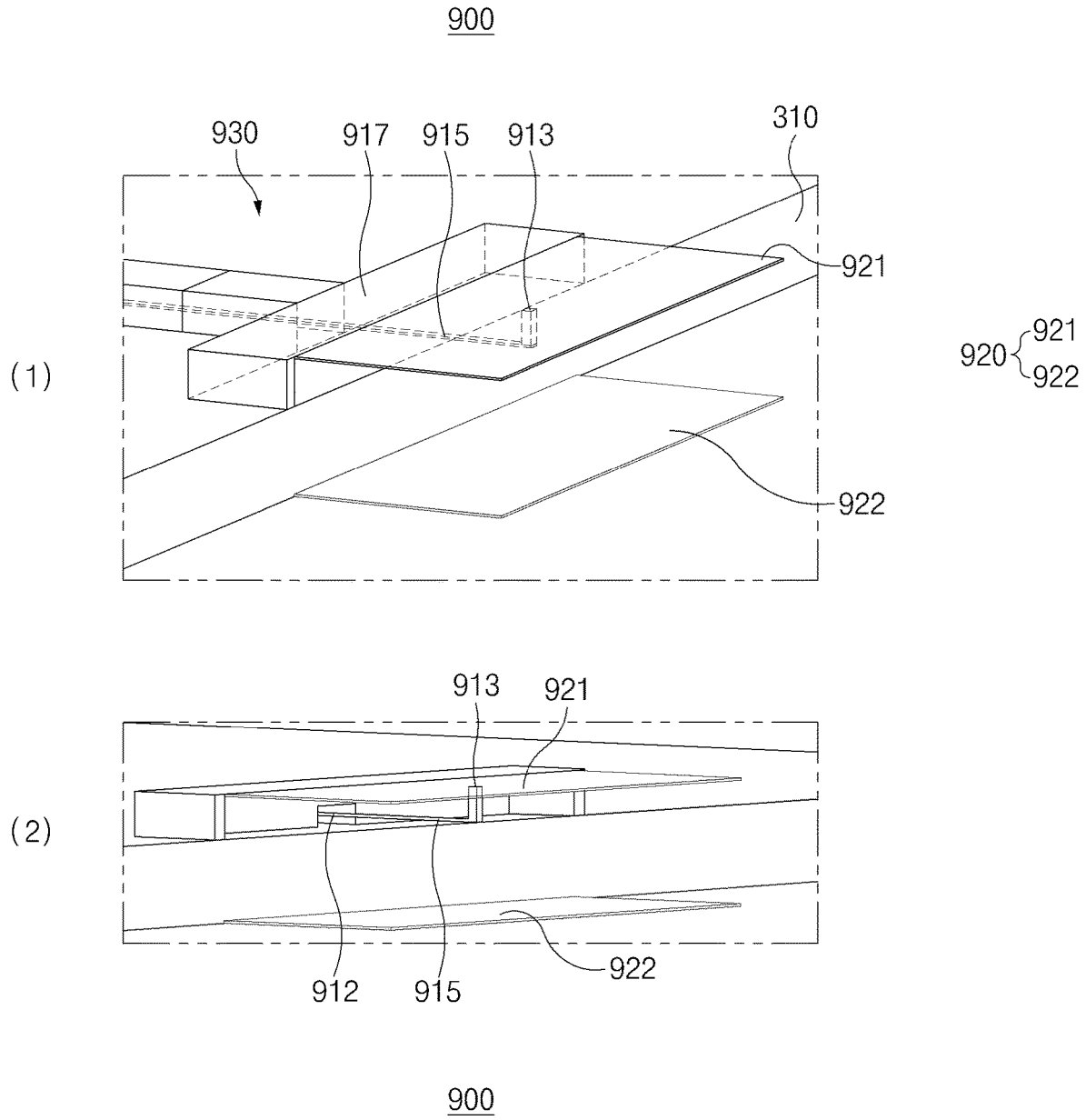
Figure 9C:
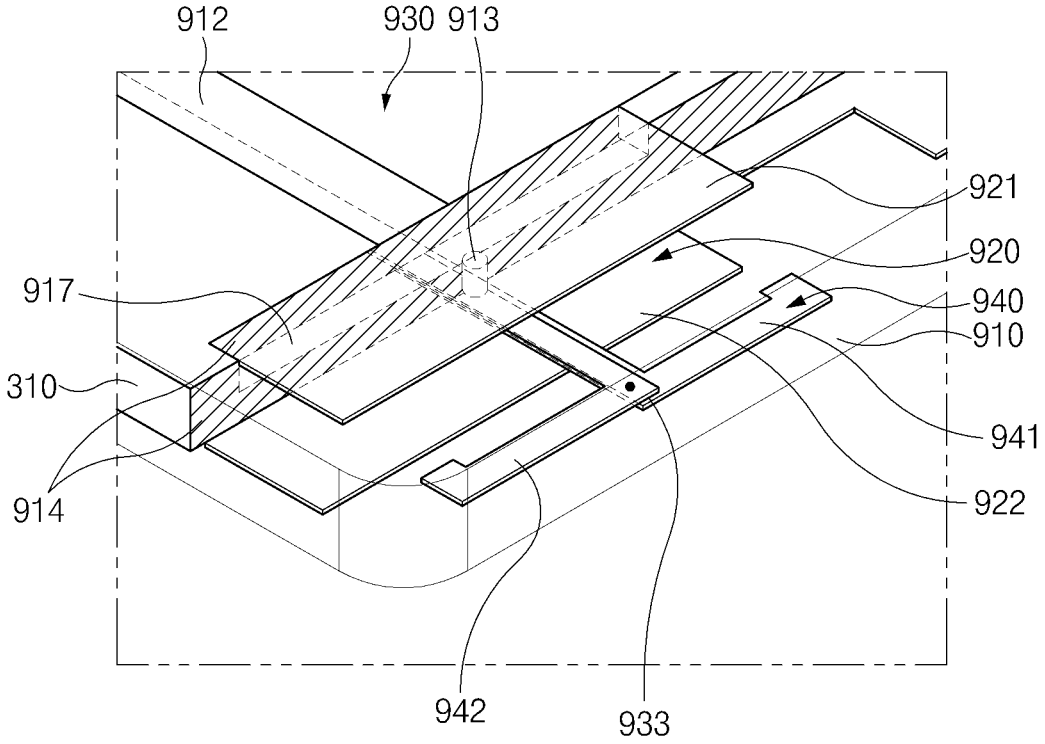

FIGS. 9A, 9B and 9C are perspective views illustrating an electronic device including a first antenna and a second antenna according to an embodiment.

One implementation example of an electronic device 900 (e.g., the electronic device 100 of FIGS. 1A to 1C) will be described with reference to FIGS. 9A, 9B and 9C. According to an embodiment, an antenna structure 930 may include a first antenna 940 and a second antenna 920. A dipole antenna including a first antenna element 941 and a second antenna element 942 is illustrated in FIG. 9A as an example of the first antenna 940. A patch antenna including a third antenna element 921 and a fourth antenna element 922 is illustrated in FIG. 9B as an example of the second antenna 920 (e.g., the ninth antenna 322*a* of FIG. 4B). However, a structure of the dipole antenna is not limited thereto, and the dipole antenna may be formed in various structures (refer to FIG. 6A).

According to an embodiment, one ends of the first antenna element 941 and the second antenna element 942 may be implemented at the substrate 310. At least a portion of the first antenna element 941 and the second antenna element 942 may be positioned in a space between the third antenna element 921 and the fourth antenna element 922. For example, when viewed from the third antenna element 921, the third antenna element 921 may overlap at least a portion of the first antenna element 941 and the second antenna element 942.

According to an embodiment, the one end of the second antenna element 942 may be electrically connected to a ground region (e.g., the ground region 370 of FIG. 3A). For example, the ground region may be included in the substrate 310. According to an embodiment, the substrate 310 may include a ground plane included in the ground region.

According to an embodiment, the first antenna element 941 may be fed through a first feed part 933. For example, the electronic device 900 may include a first feed line 911 which is electrically connected to the first feed part 933 and extends in parallel with the first antenna element 941 and the second antenna element 942. For example, the first feed line 911 may be connected from a communication circuit to the first feed part 933 through a transmission line 916 of the substrate 310. For example, the first feed line 911 may be included in the substrate 310. In various embodiments, the first feed line 911 may be included in a communication device (e.g., the communication device 2200 of FIG. 2B or the communication device 300 of FIG. 3A) including the first antenna 940.

In various embodiments, the first feed part 933 may be referenced as any one point included in the first antenna element 941 or the second antenna element 942. Referring to FIG. 9A, one point 933 of the first antenna element 941 is illustrated by way of example as the first feed part 933. The first antenna element 941 and the second antenna element 942 may function as a radiator of a dipole antenna.

In various embodiments, the first antenna element 941 and the second antenna element 942 may be positioned to be parallel to each other and to have the same height, or may be out of line to have different heights (i.e., to have a step). Referring to FIG. 9A, for example, the first antenna element 941 and the second antenna element 942 are positioned to have a step.

In various embodiments, the substrate 310 may include a cavity 917 for impedance matching for a patch antenna. For example, the cavity 917 may be formed at the substrate 310 and may be a region which is filled by a dielectric for impedance matching. For example, the cavity 917 may be a region which is filled by a dielectric having a transverse length "w", a longitudinal length "h", and a height length "h".

One implementation example of the second antenna 920 (e.g., the second antenna 920 of FIG. 9A) is illustrated in FIG. 9B. The second antenna 920 may be referenced as a patch antenna including the third antenna element 921 and the fourth antenna element 922. For example, the third antenna element 921 and the fourth antenna element 922 may be referenced as a conductive plate.

According to an embodiment, at least one side of the third antenna element 921 and at least one side of the fourth antenna element 922 may be fixed by the substrate 310 (e.g., the PCB 2250 of FIG. 2B). The third antenna element 921 may be spaced from the fourth antenna element 922 and may be positioned parallel to the fourth antenna element 922. For example, the substrate 310 may be referenced as a low-loss printed circuit board appropriate for a high-frequency signal.

According to an embodiment, the third antenna element 921 may be fed through a second feed part 913. The fourth antenna element 922 may be electrically connected to a ground region (e.g., the ground region 370 of FIG. 3A). For example, the ground region may be included in the substrate 310. The third antenna element 921 and the fourth antenna element 922 may function as a radiator of a patch antenna.

According to an embodiment, the electronic device 900 may include a second feed line 915 which electrically connects the second feed part 913 and a communication circuit (e.g., the second communication circuit 2230 of FIG. 2B). For example, the second feed line 915 may be included in the substrate 310. In various embodiments, the second feed line 915 may be included in a communication device (e.g., the communication device 2200 of FIG. 2B or the communication device 300 of FIG. 3A) including the second antenna 920.

For example, the communication circuit may be positioned on a portion of the substrate 310. The second feed line 915 may be connected to the second feed part 913 through a transmission line 912 of the substrate 310. The communication circuit may feed the second feed part 913 through the second feed line 915. The communication circuit may transmit/receive a signal using the third antenna element 921 and the fourth antenna element 922.

In various embodiments, the substrate 310 may include the cavity 917 for impedance matching associated with the second antenna 920.

Referring to FIG. 9C, the first antenna 940 and the second antenna 920 according to an embodiment may be mounted within the electronic device 900 (e.g., the electronic device 100 of FIGS. 1A to 1C). The first antenna 940 and the second antenna 920 may be positioned to face a side member of a housing 910 of the electronic device 900.

According to an embodiment, a ground connection surface 914 for connection between at least one antenna element and a ground region (or a ground plane) may be interposed between the third antenna element 921 and the fourth antenna element 922. According to an embodiment, the ground connection surface 914 may be formed by at least one ground part (e.g., ground parts 914*a*, 914*b*, 914*c*, 914*d*, and 914*e* of FIGS. 10A and 10B). The ground part may include, for example, a via. In this case, the ground connection surface 914 may correspond to a via wall.

Figure 10A:
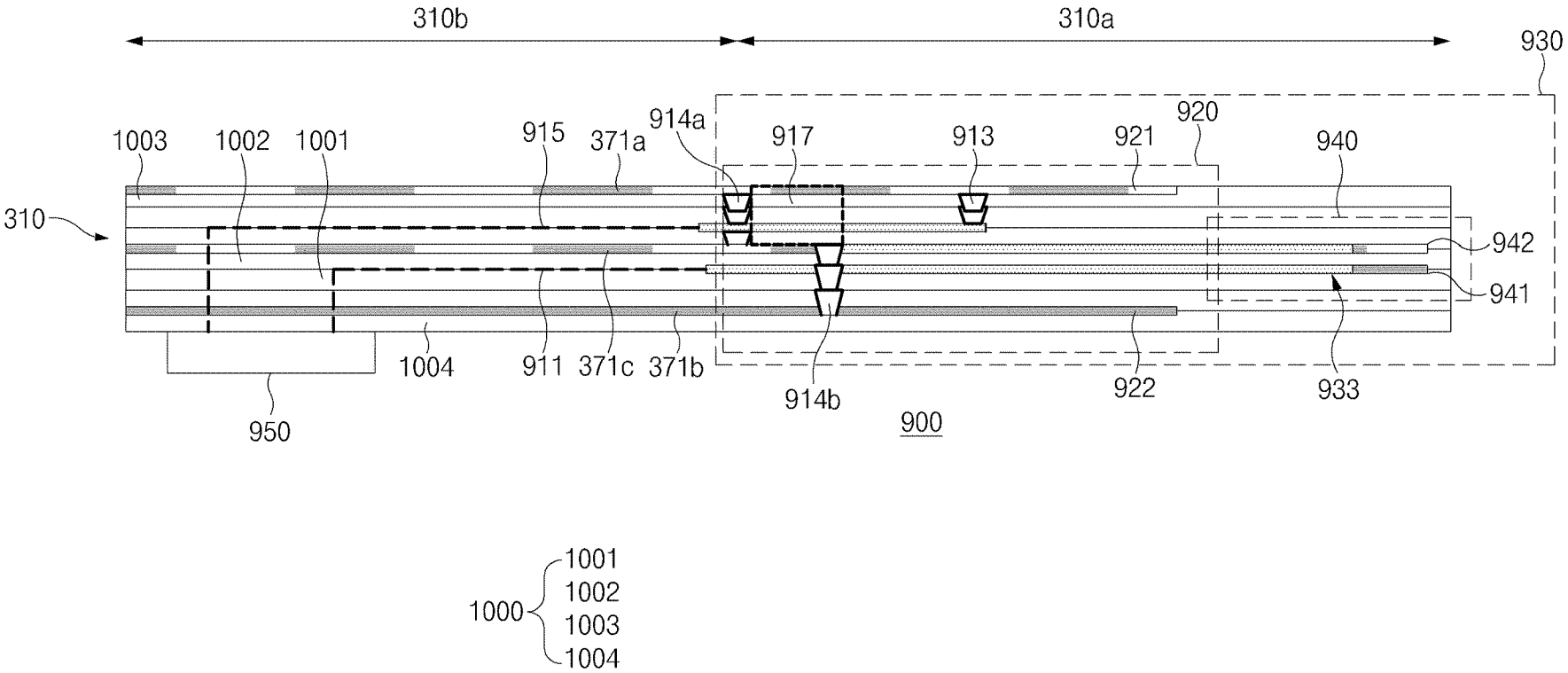
FIGS. 10A and 10B are sectional views of an electronic device including an antenna according to an embodiment.
Figure 10B:
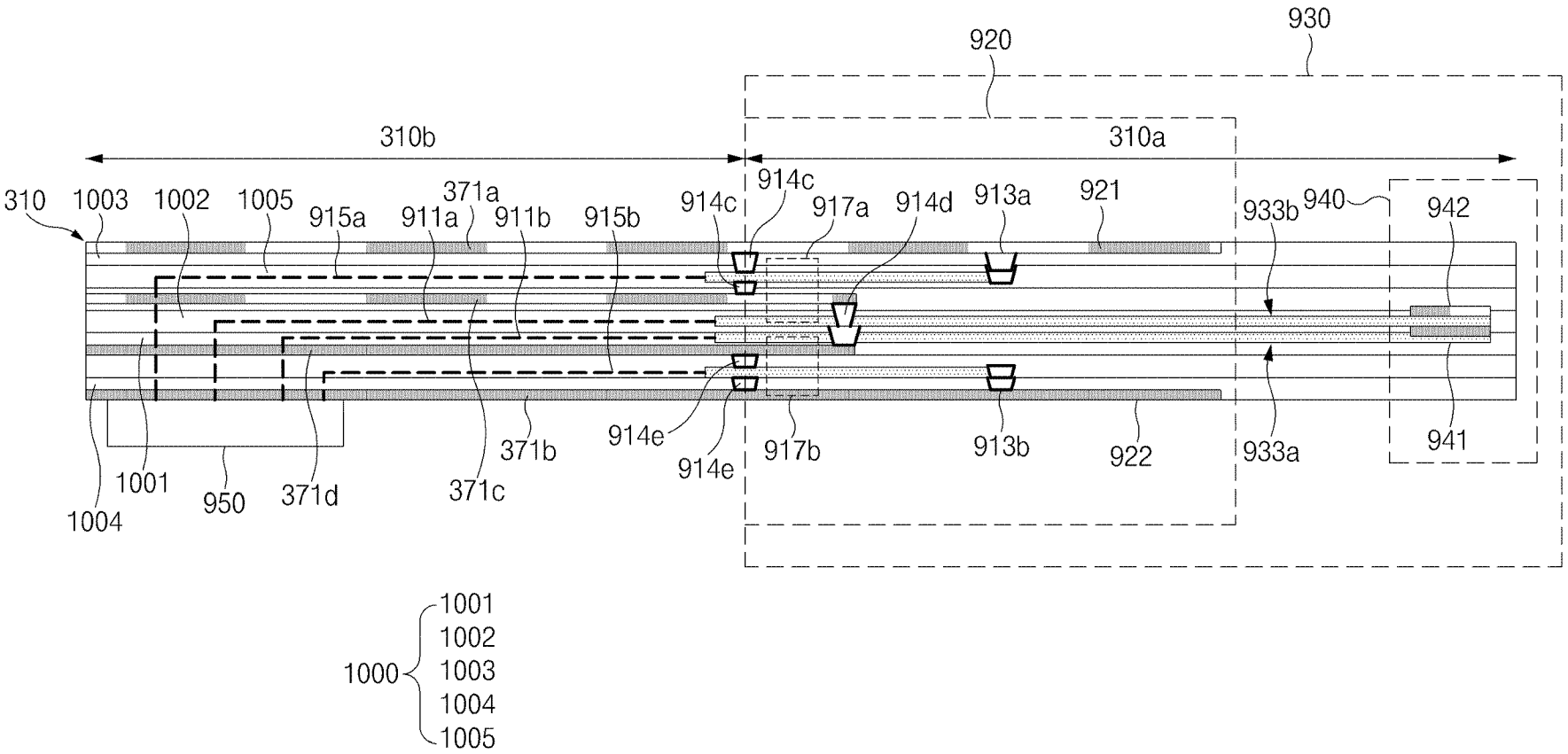

FIGS. 10A and 10B are sectional views illustrating an electronic device including an antenna according to an embodiment.

Referring to FIG. 10A, the electronic device 900 (e.g., the electronic device 100 of FIGS. 1A to 1C) according to an embodiment may include an antenna module 930 (or an antenna structure) including the first antenna 940 and the second antenna 920. According to an embodiment, the first antenna 940 may include the first antenna element 941 and the second antenna element 942. The second antenna 920 may include the third antenna element 921 and the fourth antenna element 922. The first antenna 940 including the first antenna element 941 and the second antenna element 942 and the second antenna 920 including the third antenna element 921 and the fourth antenna element 922 are illustrated by way of example in FIGS. 10A and 10B.

According to various embodiments, the first antenna element 941 and the second antenna element 942 may be referenced as a conductive pattern (or a conductive plate). In various embodiments, the third antenna element 921 and the fourth antenna element 922 may be referenced as a conductive plate.

In various embodiments, a first antenna array (e.g., the first antenna array 321 of FIG. 4C) may include the first antenna 940 in plurality, and a third antenna array (e.g., the third antenna array 322 of FIG. 4C) may include the second antenna 920 in plurality. For example, the first antenna array may be referenced as a horizontally polarized antenna array, and the third antenna array may be referenced as a vertically polarized antenna array.

According to an embodiment, the third antenna element 921 may be spaced from the fourth antenna element 922 and may be positioned parallel to the fourth antenna element 922. The first antenna 940 may be positioned in a space between the third antenna element 921 and the fourth antenna element 922.

In an embodiment, the electronic device 900 may include the substrate 310 (e.g., the substrate 310 of FIG. 3A). For example, the substrate 310 may be referenced as a printed circuit board (PCB). In various embodiments, the substrate 310 may include the first antenna 940 and the second antenna 920. For example, the first antenna element 941, the second antenna element 942, the third antenna element 921, and the fourth antenna element 922 may be implemented with a conductive plate or a conductive pattern on the substrate 310. For another example, the substrate 310 may support the first antenna element 941, the second antenna element 942, the third antenna element 921, and the fourth antenna element 922 implemented with separate conductive patterns.

According to an embodiment, the first antenna 940, one end of at least one side of the third antenna element 921, and one end of at least one side of the fourth antenna element 922 may be fixed by the substrate 310.

According to an embodiment, the substrate 310 may include a plurality of dielectric layers 1000. The plurality of dielectric layers 1000 may be positioned in a direction parallel to a side member (e.g., the side member 118 of FIG. 1A) of the electronic device 900 and may be parallel to each other. For another example, the plurality of dielectric layers 1000 may be positioned to face a side member (e.g., the side member 118 of FIG. 1A) of the electronic device 900.

According to an embodiment, the first antenna element 941 may be positioned on a first dielectric layer 1001 of the plurality of dielectric layers 1000. According to an embodiment, the second antenna element 942 may be positioned on a second dielectric layer 1002 of the plurality of dielectric layers 1000. The first dielectric layer 1001 may be farther from a first surface (e.g., the first surface 301 of FIG. 3A) of the substrate 310 than the second dielectric layer 1002.

According to an embodiment, the third antenna element 921 may be positioned on a third dielectric layer 1003 of the plurality of dielectric layers 1000, and the fourth antenna element 922 may be positioned on a fourth dielectric layer 1004 of the plurality of dielectric layers 1000. According to an embodiment, the first dielectric layer 1001 and the second dielectric layer 1002 may be interposed between the third dielectric layer 1003 and the fourth dielectric layer 1004. The first antenna element 941 and the second antenna element 942 may be positioned parallel to the third antenna element 921 and the fourth antenna element 922.

Although not illustrated in FIGS. 10A and 10B, the first antenna element 941 may be aligned in plurality on the first dielectric layer 1001.

In an embodiment, the electronic device 900 may include a communication circuit 950 electrically connected to the first antenna 940 and/or the second antenna 920. The communication circuit 950 may include, for example, an RFIC.

Referring to FIG. 10A, a feed structure for providing an electrical signal to the first antenna 940 and the second antenna 920 may be a single feed structure. For example, each of the first antenna 940 and the second antenna 920 may have one feed part.

In an embodiment, the communication circuit 950 may feed the first antenna 940 through the first feed part 933. For example, the first feed part 933 may be positioned at the first antenna element 941. In various embodiments, the first antenna 940 may function as a dipole antenna.

In an embodiment, the communication circuit 950 may feed the third antenna element 921 through the second feed part 913. The fourth antenna element 922 may be electrically connected to a ground region. In various embodiments, the second antenna 920 may function as a patch antenna.

According to an embodiment, the communication circuit 950 may apply a signal to the first feed part 933 through the first feed line 911, and may apply a signal to the second feed part 913 through the second feed line 915.

According to an embodiment, at least one of the first antenna element 941 to the fourth antenna element 922 may be electrically connected to the communication circuit 950 through at least one of the first feed part 933 or the second feed part 913.

According to an embodiment, at least one of the third antenna element 921 or the fourth antenna element 922 may be electrically connected to at least one of ground planes 371*a*, 371*b*, and 371*c* through a first ground part 914*a* or a second ground part 914*b*.

According to an embodiment, the first ground part 914*a* or the second ground part 914*b* may electrically connect an antenna element (e.g., the third antenna element 921 of FIG. 10A) and at least one of the ground planes 371*a*, 371*b*, and 371*c*, or may be positioned to form the cavity 917. According to an embodiment, the first ground part 914*a* or the second ground part 914*b* may be implemented with a via. The first ground part 914*a* or the second ground part 914*b* may form a ground connection surface (e.g., the ground connection surface 914 of FIG. 9C). According to an embodiment, the first ground part 914*a* may electrically connect the third antenna element 921 with the first ground plane 371*a* and/or the third ground plane 371*c*, and the second ground part 914*ba* may electrically connect the fourth antenna element 922 with the second ground plane 371*b* and/or the third ground plane 371*c*, According to an embodiment, one antenna element (e.g., the first antenna element 941 of FIG. 10A) of the first antenna element 941 to the fourth antenna element 922 may be extended from at least one of the ground planes 371*a*, 371*b*, and 371*c*.

According to an embodiment, the substrate 310 may include the cavity 917 for impedance matching. The cavity 917 may be referenced, for example, as a matching region for impedance matching of the second antenna 920. For example, the cavity 917 may be a region which is filled by a dielectric having a transverse length "w", a longitudinal length "h", and a height length "h". The transverse length "w", the longitudinal length "h", and the height length "h" may be associated with impedance matching.

Referring to FIG. 10B, a feed structure for providing an electrical signal to the first antenna 940 and the second antenna 920 may be a dual feed structure. For example, the communication circuit 950 may supply signals to the first antenna 940 through two feed lines 911*a* and 911*b*, and may supply signals to the second antenna 920 through two feed lines 915*a* and 915*b*. In this case, the signals supplied through the two feed lines 911*a* and 911*b* or 915*a* and 915*b* may have opposite phases.

In an embodiment, the communication circuit 950 may feed the first antenna element 941 through the first feed line 911*b*, and may feed the second antenna element 942 through the second feed line 911*a*. In various embodiments, the first antenna 940 may function as a dipole antenna upon feeding the first antenna element 941 and the second antenna element 942.

According to an embodiment, the first feed line 911*b* may feed the first antenna element 941 through a first feed part 933*a*, and the second feed line 911*a* may feed the second antenna element 942 through a second feed part 933*b*.

In an embodiment, the communication circuit 950 may transmit/receive an RF signal of a horizontal polarization characteristic using the first antenna 940. For example, the communication circuit 950 may apply signals to the first antenna 940 through the first feed line 911*b* and the second feed line 911*a*.

In an embodiment, the communication circuit 950 may feed the third antenna element 921 through the third feed line 915*a*, and may feed the fourth antenna element 922 through the fourth feed line 915*b*. In various embodiments, the second antenna 920 may function as a patch antenna upon feeding the third antenna element 921 and the fourth antenna element 922.

According to an embodiment, the third feed line 915*a* may feed the third antenna element 921 through a third feed part 913*a*, and the fourth feed line 915*b* may feed the fourth antenna element 922 through a fourth feed part 913*b*.

In an embodiment, the communication circuit 950 may transmit/receive an RF signal of a vertical polarization characteristic using the second antenna 920. For example, the communication circuit 950 may apply an RF signal to the second antenna 920 through the third feed line 915*a* and the fourth feed line 915*b*. An electromagnetic field may be produced due to a potential difference between the third antenna element 921 and the fourth antenna element 922 by the third feed line 915*a* and the fourth feed line 915*b*, and the second antenna 920 may radiate a signal of a vertical polarization characteristic to the outside through resonance.

According to an embodiment, at least one of the third antenna element 921 or the fourth antenna element 922 may be electrically connected to at least one of ground planes 317*a*, 317*b*, 317*c*, and 317*d* through at least one of ground parts 914*c*, 914*d*, and 914*e*.

According to an embodiment, at least one of the ground parts 914*c*, 914*d*, and 914*e* may electrically connect an antenna element (e.g., the third antenna element 921 of FIG. 10B) with at least one of the ground planes 317*a*, 317*b*, 317*c*, and 317*d*, and/or may be positioned to form cavities 917*a* and 917*b*.

According to an embodiment, the third ground part 914*c* may electrically connect the third antenna element 921 with the first ground plane 371*a* and/or the third ground plane 371*c*. The fourth ground part 914*d* may electrically connect the third ground plane 371*c* and the fourth ground plane 371*d*. The fifth ground part 914*e* may electrically connect the fourth antenna element 922 with the second ground plane 371*b* and/or the fourth ground plane 371*d*.

According to an embodiment, at least one of the ground parts 914*c*, 914*d*, and 914*e* may be formed of a via, and a via wall may be formed by connecting a plurality of vias. At least one of the cavities 917*a* and 917*b* may be formed by at least one of the ground parts 914*c*, 914*d*, and 914*e*. At least one of the ground parts 914*c*, 914*d*, and 914*e* may form a ground connection surface (e.g., the ground connection surface 914 of FIG. 9C).

According to an embodiment, at least one antenna element (e.g., the first antenna element 941 of FIG. 10A) of the first antenna element 941 to the fourth antenna element 922 may be extended from at least one ground plane (e.g., the first ground plane 371*a* of FIG. 10B).

According to an embodiment, the substrate 310 may include the first cavity 917*a* or the second cavity 917*b* for impedance matching. The first cavity 917*a* or the second cavity 917*b* may be referenced, for example, as a matching region for impedance matching of the second antenna 920. The cavity 917*a* or the second cavity 917*b* may be a region which is filled by a dielectric having a transverse length "w", a longitudinal length "h", and a height length "h". The transverse length "w", the longitudinal length "h", and the height length "h" may be associated with impedance matching. Inductance (L) and capacitance (C) characteristics may be determined at a high frequency depending on the area defined by the first cavity 917*a* or the second cavity 917*b*, and the first cavity 917*a* and the second cavity 917*b* may be used as a matching circuit for impedance matching.

Referring to FIGS. 10A and 10B, the substrate 310 may include a first region 310*a* where the first antenna 940 and the second antenna 920 are positioned, and a second region 310*b* being the remaining region other than the first region 310*a*.

In an embodiment, the first region 310*a* may include a nonconductive material. The second region 310*b* may form a feed network.

In an embodiment, the first antenna 940 and the second antenna 920 may be positioned in the first region 310*a* of the substrate 310. For example, the first antenna 940 and the second antenna 920 may be positioned on dielectric layers of the substrate 310.

In an embodiment, the second region 310*b* may include at least one of the first ground plane 371*a*, the second ground plane 371*b*, the third ground plane 317*c*, or the fourth ground plane 317*d*. The ground planes 371*a*, 371*b*, 371*c*, and 371*d* may form a ground region (e.g., the ground region 370 of FIG. 3A).

According to an embodiment, the ground planes 371*a*, 371*b*, 371*c*, and 371*d* may be positioned on at least one dielectric layer of the plurality of dielectric layers 1000. According to an embodiment, the ground planes 371*a*, 371*b*, 371*c*, and 371*d* may be a conductive layer positioned on at least one dielectric layer of the plurality of dielectric layers 1000. The ground planes 371*a*, 371*b*, 371*c*, and 371*d* may be positioned in the second region 310*b* of at least one dielectric layer of the plurality of dielectric layers 1000. According to an embodiment, at least one of the ground planes 371*a*, 371*b*, 371*c*, and 371*d* may be interposed between the third dielectric layer 1003 and the fourth dielectric layer 1004, may be interposed between the first dielectric layer 1001 and the second dielectric layer 1002 (not illustrated), or may be positioned on at least one dielectric layer of the first dielectric layer 1001 to the fourth dielectric layer 1004 (refer to FIG. 10A). For example, the third ground plane 371*c* may be positioned on the fifth dielectric layer 1005, and the fifth dielectric layer 1005 may be interposed between the second dielectric layer 1002 and the third dielectric layer 1003. For example, the fourth ground plane 371*d* may be positioned on the first dielectric layer 1001 together with the first antenna element 941 or hierarchically. At least one of the first antenna element 941 to the fourth antenna element 921 may be extended and formed from at least one of the ground planes 371*a*, 371*b*, 371*c*, and 371*d*. An example is illustrated in FIG. 10A as the second antenna element 942 is extended from the third ground plane 371*c*, the third antenna element 921 is extended from the first ground plane 371*a*, and the fourth antenna element 922 is extended from the second ground plane 371*b*, but the present disclosure is not limited thereto. For example, various elements may be extended from at least one of the ground planes 371*a*, 371*b*, 371*c*, and 371*d*.

In various embodiments, the communication circuit 950 may transmit/receive a millimeter wave (mmWave) of 20 GHz or higher in response to a control signal for vertical and horizontal transmission/reception, under control of a processor of the electronic device 900.

Figure 11A:
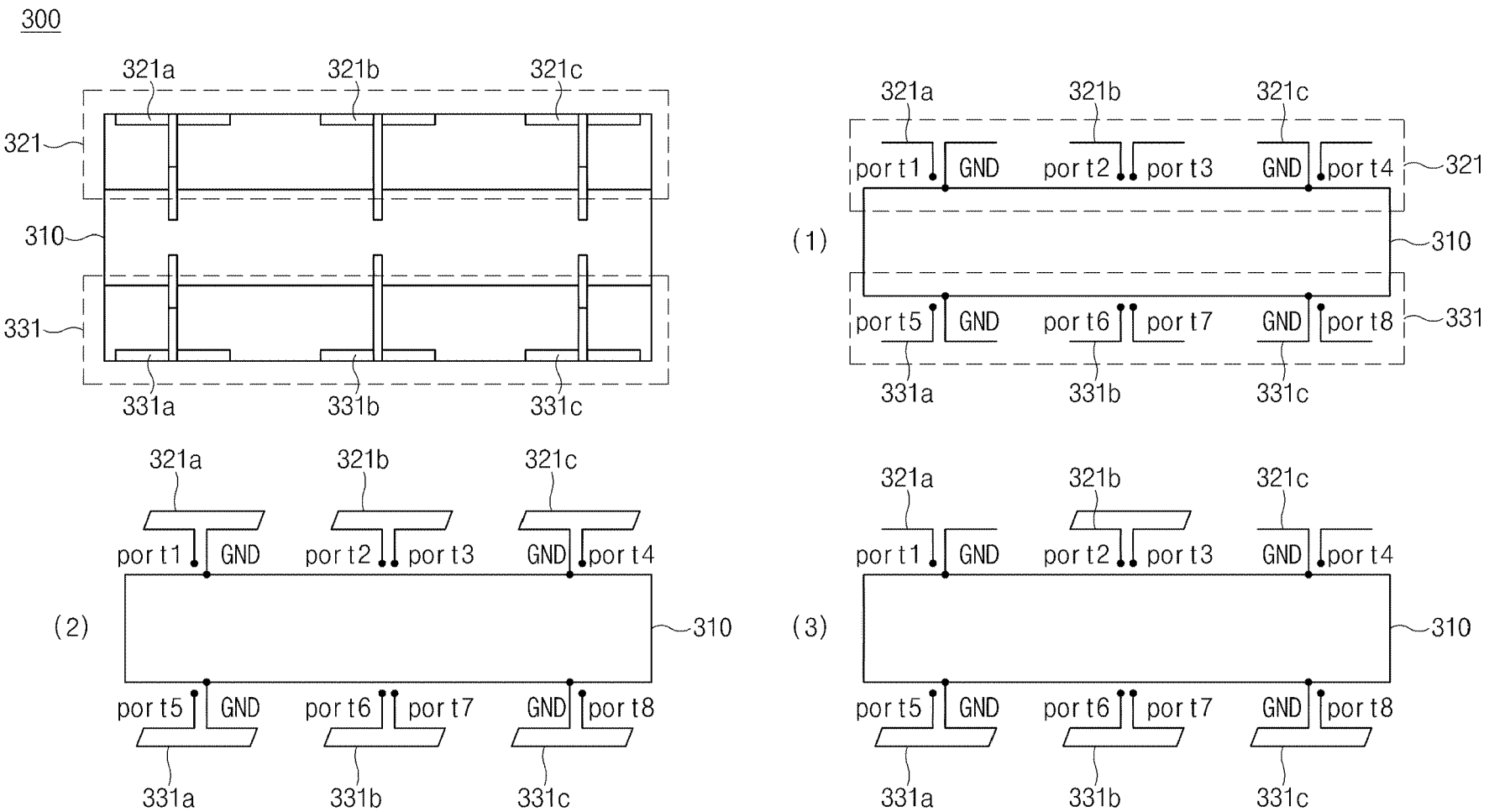
FIGS. 11A and 11B are diagrams illustrating feed structures of a communication device in an electronic device according to various embodiments.
Figure 11B:
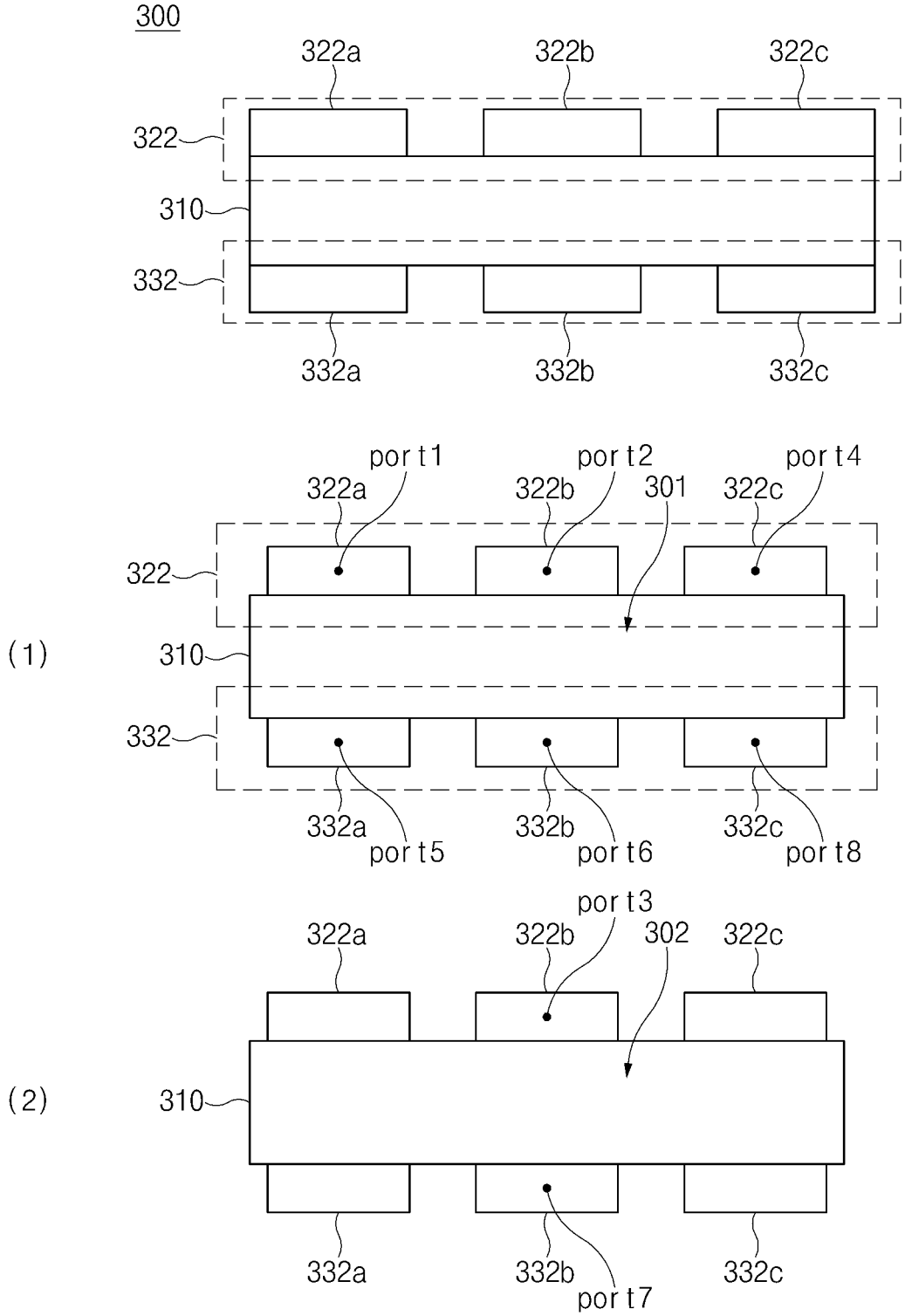

FIGS. 11A and 11B are diagrams illustrating feed structures of a communication device in an electronic device according to various embodiments.

Referring to FIG. 11A, antenna elements included in the antennas 321*a*, 321*b*, and 321*c* forming the first antenna array 321 and antenna elements included in the antennas 331*a*, 331*b*, and 331*c* forming the second antenna array 331 may be positioned at the communication device 300 (e.g., the substrate 310 of the communication device 300 of FIGS. 3A and 3B).

According to an embodiment, a combination of a single feed structure and a dual feed structure may be used to feed the antennas 321*a*, 321*b*, and 321*c* of the first antenna array 321.

Referring to (1) to (3) of FIG. 11A, the single feed structure may be used to feed at least one antenna (e.g., the first antenna 321*a* or the third antenna 321*c*) of the antennas 321*a*, 321*b*, and 321*c* included in the first antenna array 321, and the dual feed structure may be used to feed at least another antenna (e.g., the second antenna 321*b*).

For example, a communication circuit may supply an electrical signal to the first antenna 321*a* through a first port "port 1". For example, the communication circuit may supply an electrical signal to the second antenna 321*b* through a second port "port 2" and a third port "port 3". In this case, signals supplied to the second antenna 321*b* through the second port "port 2" and the third port "port 3" may have opposite phases.

Referring to (1) and (3) of FIG. 11A, the single feed structure may be used for at least one antenna (e.g., the fourth antenna 331*a* or the sixth antenna 331*c*) of the antennas 331*a*, 331*b*, and 331*c* included in the second antenna array 331, and the dual feed structure may be used for at least another antenna (e.g., the fifth antenna 331*b*).

For example, the communication circuit may supply an electrical signal to the fourth antenna 331*a* through a fifth port "port 5". For example, the communication circuit may supply an electrical signal to the fifth antenna 331*b* through a sixth port "port 6" and a seventh port "port 7". In this case, signals supplied to the fifth antenna 331*b* through the sixth port "port 6" and the seventh port "port 7" may have opposite phases.

The combination of the dual feed structure and the single feed structure of FIG. 11A may be applied to various embodiments of an antenna including the third antenna array 322 and the fourth antenna array 332. The case where the combination of the feed structures is used for a dipole antenna is illustrated by way of example in (1) of FIG. 11A, the case where the combination of the feed structures is used for a folded dipole antenna is illustrated by way of example in (2) of FIG. 11A, and the case where the combination of the feed structures is used for antenna arrays, one of which is implemented with a combination of the dipole antenna and the folded dipole antenna, is illustrated by way of example in (3) of FIG. 11A.

Referring to FIG. 11B, antenna elements included in the antennas 322*a*, 322*b*, and 322*c* forming the third antenna array 322 and antenna elements included in the antennas 332*a*, 332*b*, and 332*c* forming the fourth antenna array 332 may be positioned on the first surface 301 (e.g., the first surface 301 of FIG. 3A) and the second surface 302 (e.g., the second surface 302 of FIG. 3A) of the substrate 310 in the communication device 300 (e.g., the communication device 300 of FIGS. 3A and 3B). According to an embodiment, a communication circuit (e.g., the communication circuit 341 of FIG. 3B) may feed the antennas 322*a*, 322*b*, 322*c*, 332*a*, 332*b*, and 332*c* in a single feed scheme or a dual feed scheme.

Referring to (1) and (2) of FIG. 11B, the communication circuit may apply an electrical signal to at least one antenna (e.g., the seventh antenna 322*a* or the ninth antenna 322*c*) of the antennas 322*a*, 322*b*, and 322*c* included in the third antenna array 322 through the single feed structure, and may apply an electrical signal to at least another antenna (e.g., the eighth antenna 322*b*) through the dual feed structure.

For example, the communication circuit may supply an electrical signal to the seventh antenna 322*a* through a first port "port 1". For example, the communication circuit may supply an electrical signal to the eighth antenna 322*b* through a second port "port 2" and a third port "port 3". In this case, signals supplied to the eighth antenna 322*b* through the second port "port 2" and the third port "port 3" may have opposite phases.

Referring to (1) and (2) of FIG. 11B, the single feed structure may be used for at least one antenna (e.g., the tenth antenna 332*a* or the twelfth antenna 332*c*) of the antennas 332*a*, 332*b*, and 332*c* included in the fourth antenna array 332, and the dual feed structure may be used for at least another antenna (e.g., the eleventh antenna 332*b*).

For example, the communication circuit may supply an electrical signal to the tenth antenna 332*a* through a fifth port "port 5". For example, the communication circuit may supply an electrical signal to the eleventh antenna 332*b* through a sixth port "port 6" and a seventh port "port 7". In this case, signals supplied to the eleventh antenna 332*b* through the sixth port "port 6" and the seventh port "port 7" may have opposite phases.

Figure 12A:
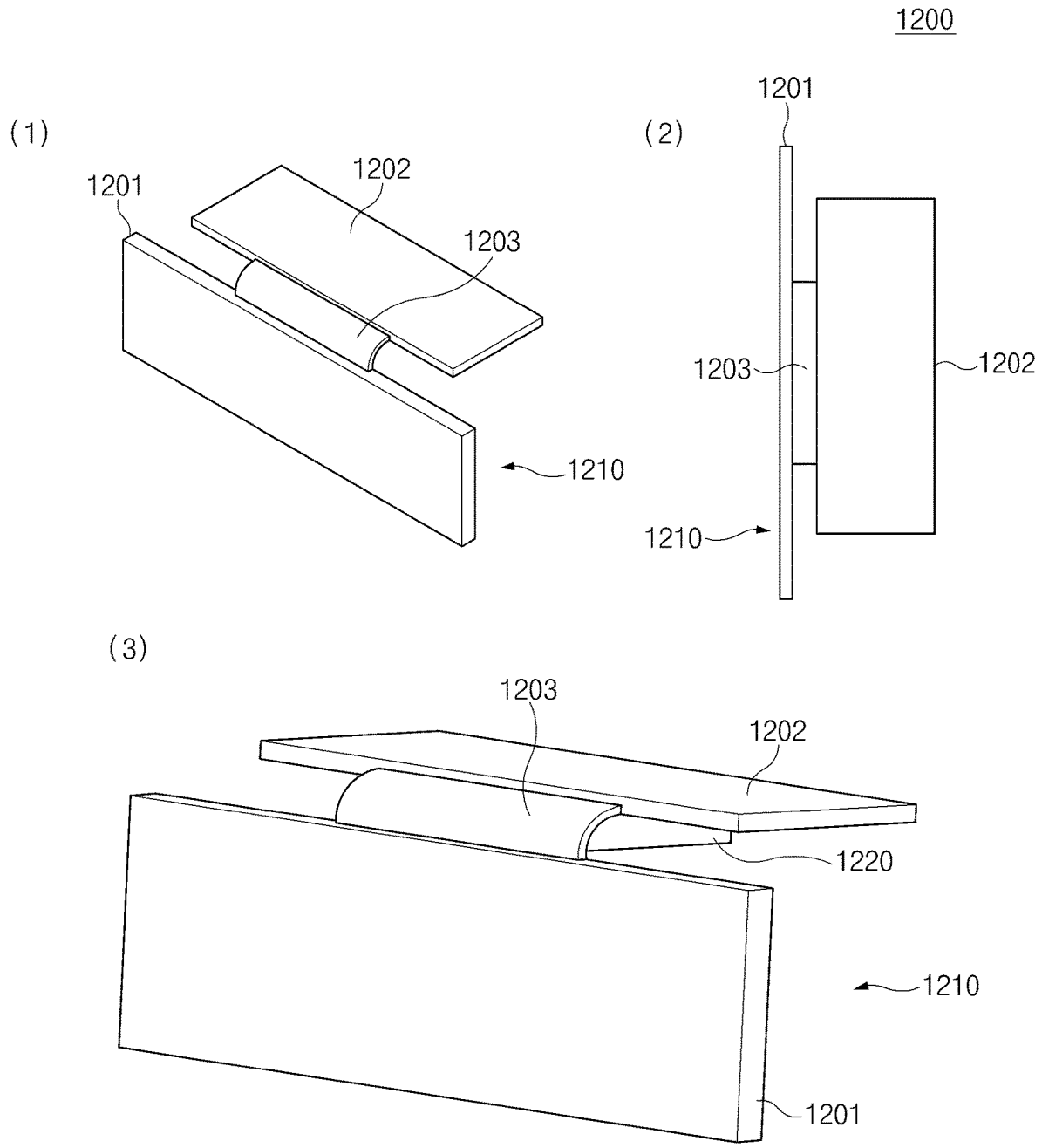
FIGS. 12A and 12B are diagrams illustrating feed structures of a communication device in an electronic device according to various embodiments.
Figure 12B:
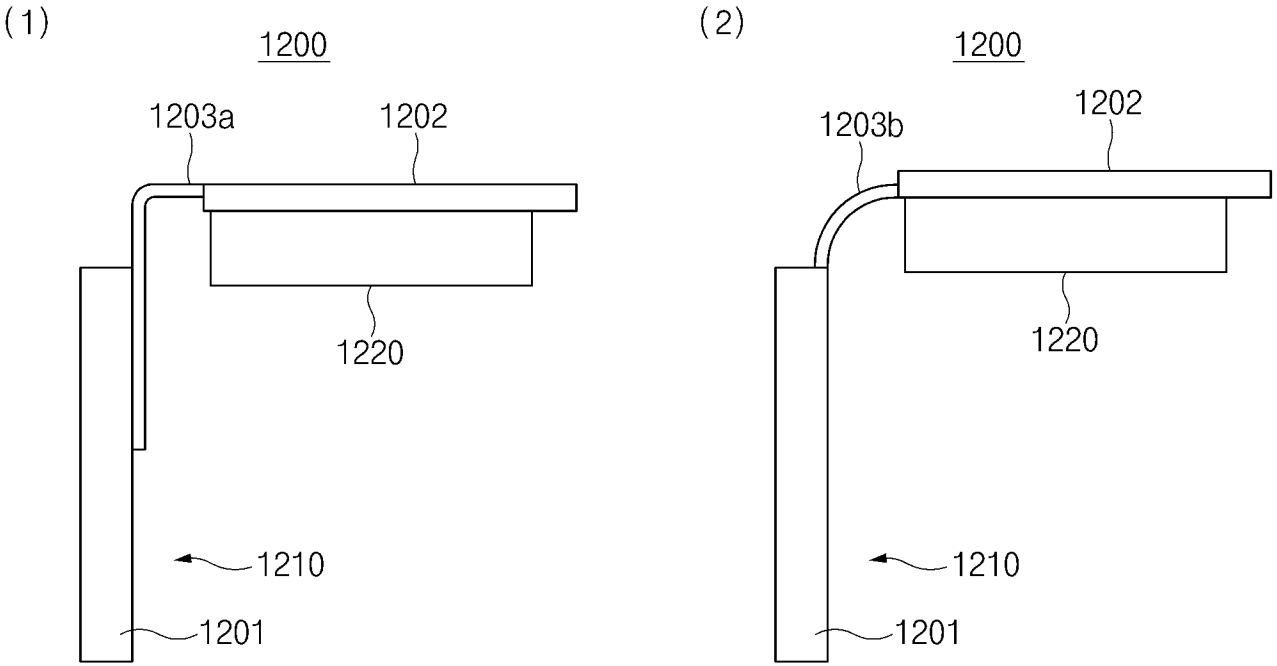
Figure 13:
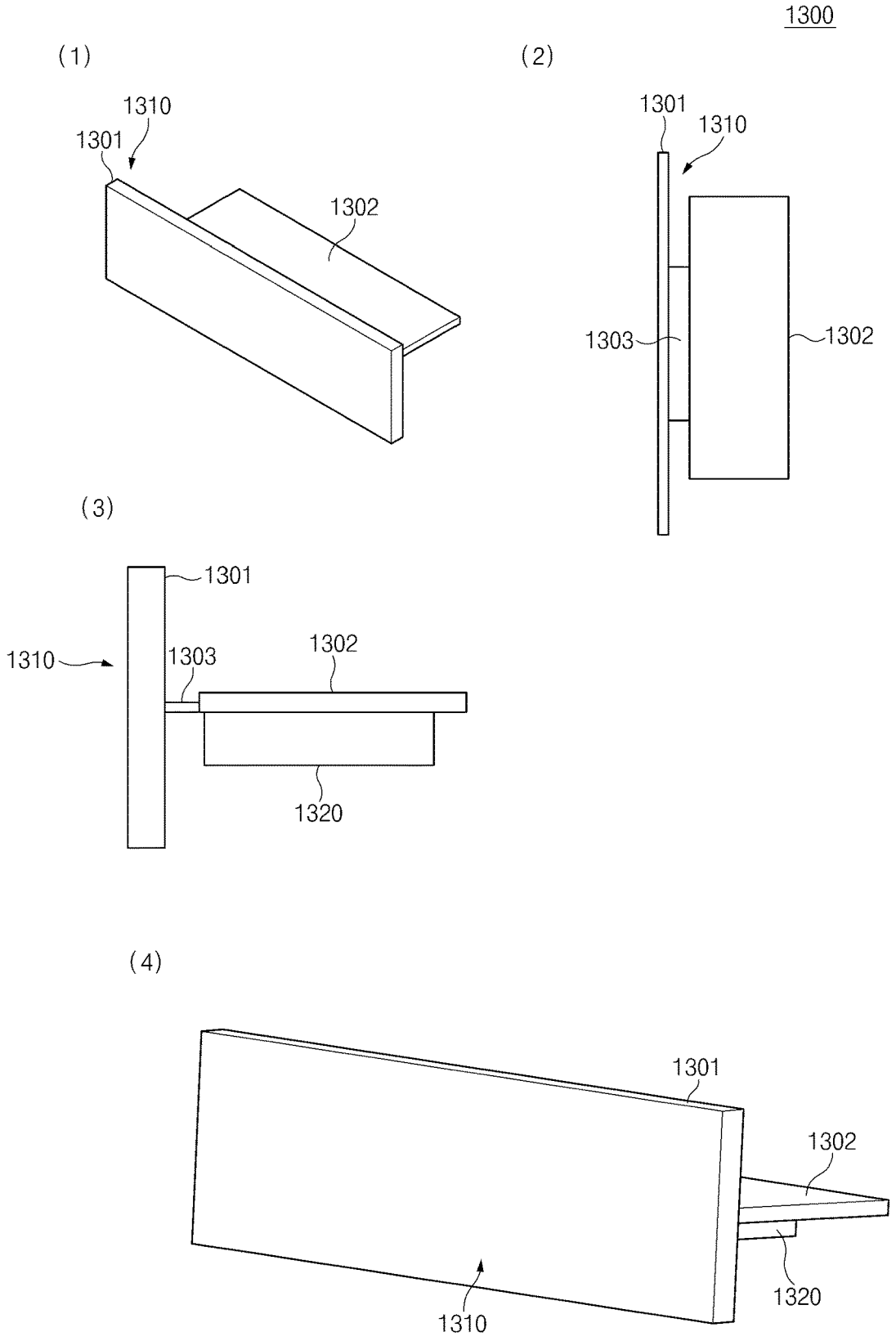
FIG. 13 is a diagram illustrating a feed structure of a communication device in an electronic device according to various embodiments.

FIGS. 12A, 12B and 13 are diagrams illustrating configurations of a communication device in an electronic device according to various embodiments.

Referring to FIGS. 12A and 12B, a communication circuit 1220 (e.g., the second communication circuit 2230 of FIG. 2B) and an antenna module 1210 (or an antenna structure) including at least one antenna array may be respectively positioned at a first substrate 1201 or a second substrate 1202 of a communication device 1200 (e.g., the communication device 300 of FIGS. 3A and 3B).

(1) and (3) of FIG. 12A are perspective views of the communication device 1200 seen in different directions, and (2) is a view of the communication device 1200 seen from above the second substrate 1202.

Referring to FIG. 12A, the communication device 1200 may include the first substrate 1201 and the second substrate 1202, and the first substrate 1201 and the second substrate 1202 may be electrically connected through a connection member 1203.

According to an embodiment, at least one antenna array may be positioned at the first substrate 1201. The communication circuit 1220 may be positioned on the second substrate 1202.

According to an embodiment, the first substrate 1201 and the second substrate 1202 may be positioned at various angles. For example, the first substrate 1201 may correspond to the substrate 310 of FIG. 4A. The second substrate 1202 may be positioned at the substrate 140 of FIG. 1C. For another example, the second substrate 1202 may be a separate substrate.

FIG. 12B is a diagram illustrating various implementation examples of the communication device 1200. FIG. 12B is a diagram illustrating the communication device 1200 seen from sides of the first substrate 1201 and the second substrate 1202.

According to an embodiment, if the communication device 1200 is viewed from one side, the first substrate 1201 and the second substrate 1202 may be positioned at various angles (e.g., a right angle), and may be connected not to overlap each other upon extending each substrate. For example, the connection member 1203 may be provided in a bent shape or may be flexible.

Referring to FIG. 12B, the first substrate 1201 and the second substrate 1202 may be variously connected through the connection member 1203. Referring to (1) of FIG. 12B, a connection member 1203*a* may connect the first substrate 1201 and the second substrate 1202, and may be positioned to support one surface of the first substrate 1201. Referring to (2) of FIG. 12B, a connection member 1203*b* may connect sides of the first substrate 1201 and the second substrate 1202.

Referring to FIG. 13, a communication device 1300 may include a first substrate 1301 and a second substrate 1302, and the first substrate 1301 and the second substrate 1302 may be electrically connected through a connection member 1303.

In FIG. 13, (1) and (4) are perspective views of the communication device 1300 seen in different directions, (2) is a view of the communication device 1300 seen from above one surface the second substrate 1302, and (3) is a view of the communication device 1300 seen from one side of the second substrate 1302.

According to an embodiment, the first substrate 1301 and the second substrate 1302 may be positioned to be perpendicular to each other and may be connected to each other such that the second substrate 1302 is positioned on one substrate (e.g., the first substrate 1301).

According to an embodiment, an antenna module 1310 (or an antenna structure) including at least one antenna array may be positioned at the first substrate 1301. A communication circuit 1320 may be positioned on the second substrate 1302.

According to an embodiment, the first substrate 1301 and the second substrate 1302 may be positioned to form approximately 90 degrees.

Figure 14:
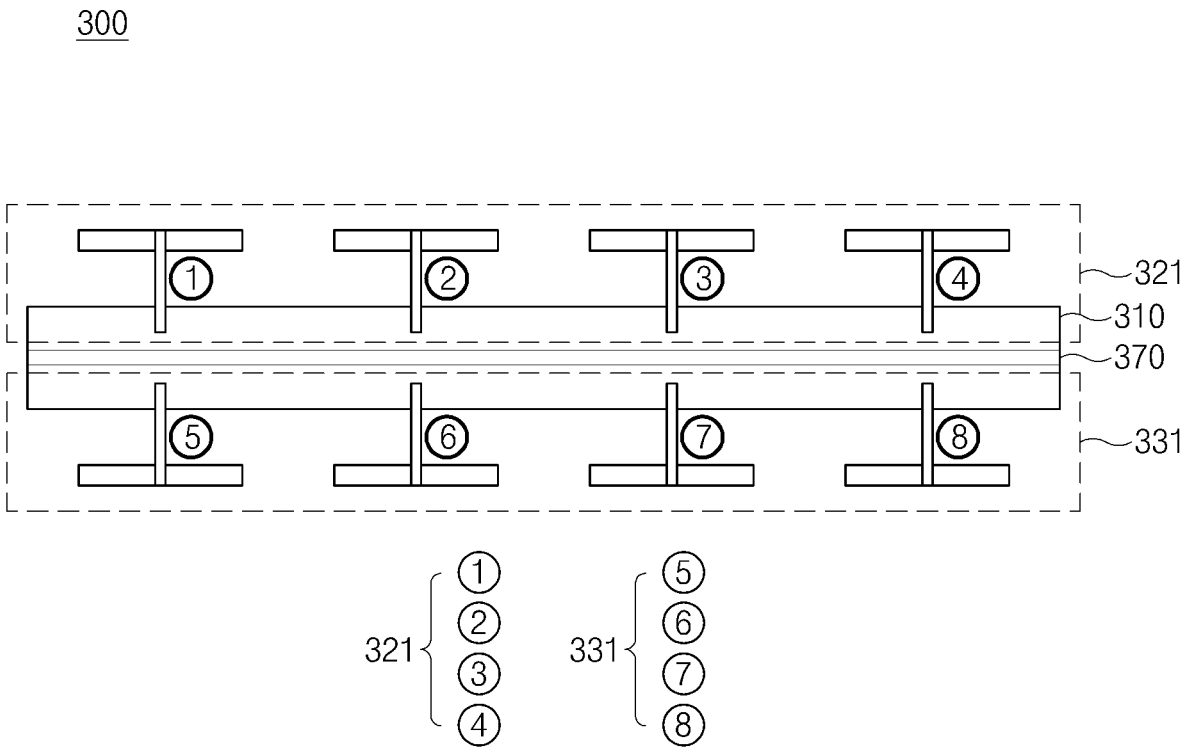
FIG. 14 is a diagram illustrating beam steering of an antenna according to an embodiment.

FIG. 14 is a diagram illustrating beam steering of an antenna according to an embodiment.

According to an embodiment, beam steering may be performed between the antenna arrays 321 and 331 which are included in the communication device 300 (e.g., the communication device 300 of FIG. 3A) of an electronic device (e.g., the electronic device 100 of FIGS. 1A to 1C) and are positioned with the ground region 370 interposed therebetween. For example, the beam steering may be applied between the first antenna array 321 and the second antenna array 331.

The case where the beam steering is applied between the first antenna array 321 and the second antenna array 331 is illustrated by way of example in FIG. 14, but the beam steering to be described below may be applied between the third antenna array 322 and the fourth antenna array 332.

Referring to FIG. 14, the first antenna array 321 may include a first antenna ①, a second antenna ②, a third antenna ③, and/or a fourth antenna ④, the second antenna array 331 may include a fifth antenna ⑤, a sixth antenna ⑥, a seventh antenna ⑦, and/or an eighth antenna ⑧.

According to an embodiment, an electronic device may perform the beam steering such that signals are transmitted with a phase difference between the first antenna array 321 and the second antenna array 331. For example, the electronic device may perform the beam steering such that beams are radiated from one antenna array with the same phase and beams are radiated from antenna arrays with a phase difference.

The following Table 1 shows beams applied between the first antenna array 321 and the second antenna array 331 according to an embodiment.

TABLE 1

| Phase difference | Beam 1 | Beam 2 | Beam 3 | Beam 4 |
|---|---|---|---|---|
| ① | 0 | 0 | 0 | 0 |
| ② | 0 | 0 | 0 | 0 |
| ③ | 0 | 0 | 0 | 0 |
| ④ | 0 | 0 | 0 | 0 |
| ⑤ | 0 | 90 | 180 | 270 |
| ⑥ | 0 | 90 | 180 | 270 |
| ⑦ | 0 | 90 | 180 | 270 |
| ⑧ | 0 | 90 | 180 | 270 |

According to an embodiment, the electronic device may apply a set beam pattern. Referring to Table 1, various beams Beam 1, Beam 2, Beam 3, and Beam 4 may be radiated from the electronic device, and different phase differences may be set between the antenna arrays 321 and 331 for each beam.

According to an embodiment, in the case of Beam 1, a phase difference of 0 degree may be set between the first antenna array 321 and the second antenna array 331; in the case of Beam 2, a phase difference of 90 degrees may be set between the first antenna array 321 and the second antenna array 331. For example, while the electronic device applies the first beam "Beam 1", a beam formed by the antennas ①, ②, ③, and ④ of the first antenna array 321 may have a phase difference of 0 degree with a beam formed by the antennas ⑤, ⑥, ⑦, and ⑧ of the second antenna array 331; while the electronic device applies the second beam "Beam 2", a beam formed by the antennas ①, ②, ③, and ④ of the first antenna array 321 may have a phase difference of 90 degrees with a beam formed by the antennas ⑤, ⑥, ⑦, and ⑧ of the second antenna array 331.

According to an embodiment, the electronic device may store information about beams allowing antenna arrays to have a phase difference, as set in Table 1 with regard to Beam 1, Beam 2, Beam 3, and Beam 4. The electronic device may store the information about beams in a memory in the form of Beam book.

Figure 15:
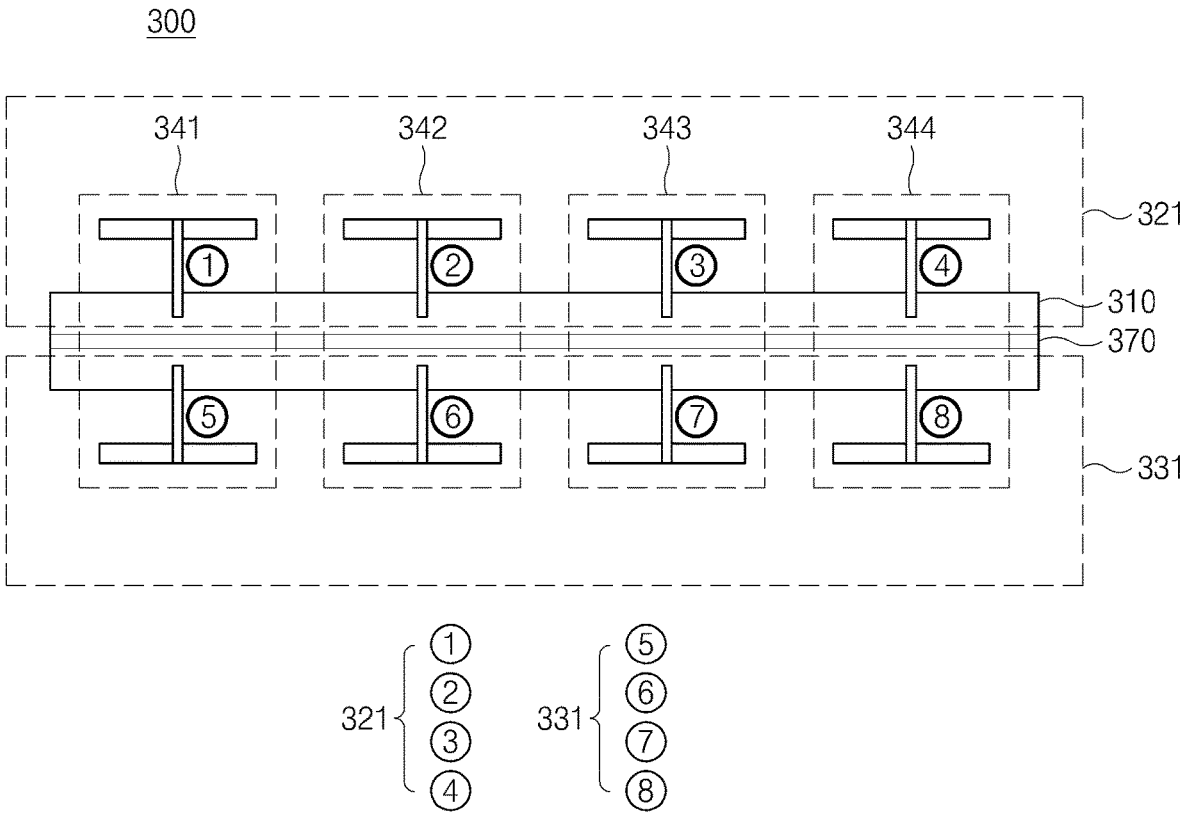
FIG. 15 is a diagram illustrating beam steering of an antenna according to an embodiment.

FIG. 15 is a diagram illustrating beam steering of an antenna according to an embodiment.

According to an embodiment, beam steering may be performed between a plurality of antenna arrays (e.g., the first antenna array 321 and the second antenna array 331) included in the communication device 300 (e.g., the communication device 300 of FIG. 3A) of an electronic device (e.g., the electronic device 100 of FIGS. 1A to 1C). For example, the beam steering may be applied between the corresponding antennas of antennas included in the first antenna array 321 and the second antenna array 331. The corresponding antennas may correspond to each other, with a ground region (e.g., the ground region 370 of FIG. 3A) interposed between the antenna arrays, or may be antennas symmetric to each other.

The case where the beam steering is applied between the first antenna array 321 and the second antenna array 331 is illustrated by way of example in FIG. 15.

According to an embodiment, the first antenna array 321 may include a first antenna ①, a second antenna ②, a third antenna ③, and/or a fourth antenna ④, and the second antenna array 331 may include a fifth antenna ⑤, a sixth antenna ⑥, a seventh antenna ⑦, and/or an eighth antenna ⑧. According to an embodiment, a correspondence relationship may be formed between the first antenna array 321 and the second antenna array 331. For example, the first antenna ① and the fifth antenna ⑤ may correspond to each other to form a first antenna group 341, the second antenna ② and the sixth antenna ⑥ may correspond to each other to form a second antenna group 342, the third antenna ③ and the seventh antenna ⑦ may correspond to each other to form a third antenna group 343, and the fourth antenna ④ and the eighth antenna ⑧ may correspond to each other to form a fourth antenna group 344.

According to an embodiment, an electronic device may perform the beam steering such that signals are transmitted with a phase difference between the first antenna array 321 and the second antenna array 331. For example, the electronic device may perform the beam steering so as to have the same phase in one antenna group (e.g., the first antenna group 341) and to have a phase difference between antennas included in one antenna array (e.g., the first antenna array 321). For another example, the electronic device may perform the beam steering so as to have a phase difference even between antennas included in one antenna array (e.g., the first antenna array 321) while having a phase difference in one antenna group (e.g., the first antenna group 341).

In various embodiments to be described below, one antenna array (e.g., the first antenna array 321 or the second antenna array 331) may include a reference antenna. The reference antenna may have the same reference phase with respect to various beams set in the following tables.

The following Table 2 to Table 5 show beams applied between the first antenna array 321 and the second antenna array 331 according to an embodiment.

TABLE 2

| Phase difference | Beam 1 | Beam 2 | Beam 3 | Beam 4 |
|---|---|---|---|---|
| ① | 0 | 0 | 0 | 0 |
| ② | 0 | 90 | 180 | 270 |
| ③ | 0 | 180 | 360 | 540 |
| ④ | 0 | 270 | 540 | 810 |
| ⑤ | 0 | 0 | 0 | 0 |
| ⑥ | 0 | 90 | 180 | 270 |
| ⑦ | 0 | 180 | 360 | 540 |
| ⑧ | 0 | 270 | 540 | 810 |

TABLE 3

| Phase difference | Beam 1 | Beam 2 | Beam 3 | Beam 4 |
|---|---|---|---|---|
| ① | 0 | 0 | 0 | 0 |
| ② | 0 | 90 | 180 | 270 |
| ③ | 0 | 180 | 360 | 540 |
| ④ | 0 | 270 | 540 | 810 |
| ⑤ | 90 | 90 | 90 | 90 |
| ⑥ | 90 | 180 | 270 | 360 |
| ⑦ | 90 | 270 | 450 | 630 |
| ⑧ | 90 | 360 | 630 | 900 |

TABLE 4

| Phase difference | Beam 1 | Beam 2 | Beam 3 | Beam 4 |
|---|---|---|---|---|
| ① | 0 | 0 | 0 | 0 |
| ② | 0 | 90 | 180 | 270 |
| ③ | 0 | 180 | 360 | 540 |
| ④ | 0 | 270 | 540 | 810 |
| ⑤ | 180 | 180 | 180 | 180 |
| ⑥ | 180 | 270 | 360 | 450 |

TABLE 4-continued

| Phase difference | Beam 1 | Beam 2 | Beam 3 | Beam 4 |
|---|---|---|---|---|
| ⑦ | 180 | 360 | 540 | 720 |
| ⑧ | 180 | 450 | 720 | 990 |

TABLE 5

| Phase difference | Beam 1 | Beam 2 | Beam 3 | Beam 4 |
|---|---|---|---|---|
| ① | 0 | 0 | 0 | 0 |
| ② | 0 | 90 | 180 | 270 |
| ③ | 0 | 180 | 360 | 540 |
| ④ | 0 | 270 | 540 | 810 |
| ⑤ | 270 | 270 | 270 | 270 |
| ⑥ | 270 | 360 | 450 | 540 |
| ⑦ | 270 | 450 | 630 | 810 |
| ⑧ | 270 | 540 | 810 | 1080 |

Referring to Table 2, a beam pattern may be set in such a way that antennas in the antenna groups 341, 342, 343, and 344 have the same phase with regard to one beam pattern. According to an embodiment, antennas in one antenna array may be set to have different phase differences with regard to one beam pattern. For example, antennas in antenna arrays may have different phase differences for each of beams Beam 1, Beam 2, Beam 3, and Beam 4. For example, a phase difference between antennas in antenna arrays may be 0 degree in the case of Beam 1, may be 90 degrees in the case of Beam 2, may be 180 degrees in the case of Beam 3, and may be 270 degrees in the case of Beam 4.

Referring to Table 3 to Table 5, different phases may be set between antennas (signals transmitted from antennas) in an antenna group with regard to one beam. According to an embodiment, a phase difference may be set differently for each beam. For example, each beam may be set to have a phase difference of 90 degrees between antennas (e.g., the first antenna ① and the fifth antenna ⑤) included in an antenna group (e.g., the first antenna group 341) in the case of Table 3, to have a phase difference of 180 degrees between antennas (e.g., the first antenna ① and the fifth antenna ⑤) included in an antenna group (e.g., the first antenna group 341) in the case of Table 4, and to have a phase difference of 270 degrees between antennas (e.g., the first antenna ① and the fifth antenna ⑤) included in an antenna group (e.g., the first antenna group 341) in the case of Table 5.

Referring to Table 3 to Table 5, antennas in an antenna group may have different phases with regard to one beam. The phase difference may be set differently for each beam. Referring to Table 3, antennas in one antenna group may be set to have a phase difference of 0 degree in the case of Beam 1, may be set to have a phase difference of 90 degrees in the case of Beam 2, may be set to have a phase difference of 180 degrees in the case of Beam 3, and may be set to have a phase difference of 270 degrees in the case of Beam 4.

According to an embodiment, an electronic device may store information about beams, which allows antennas in an antenna array and/or antennas in an antenna group to have phase differences as set in Table 2 to Table 5. The electronic device may store the information about beams in a memory in the form of Beam book.

According to an embodiment, for the beam operation, the communication device 300 (e.g., the communication device 300 of FIG. 3A) may include a phase shifter. The phase shifter may include at least one register for the purpose of shifting a phase of a beam. The case where a phase is controlled at an interval of 90 degrees through the phase shifter including a 2-digit register is illustrated by way of example in Table 1 to Table 5, but a phase may be variously changed according to a register structure of the phase shifter. For example, the phase shifter may include a 3-digit register. In this case, a phase may be controlled at an interval of 45 degrees. For another example, the phase shifter may include a 4-digit register. In this case, a phase may be controlled at an interval of 22.5 degrees. For another example, the phase shifter may include a 5-digit register. In this case, a phase may be controlled at an interval of 11.25 degrees.

Figure 16A:
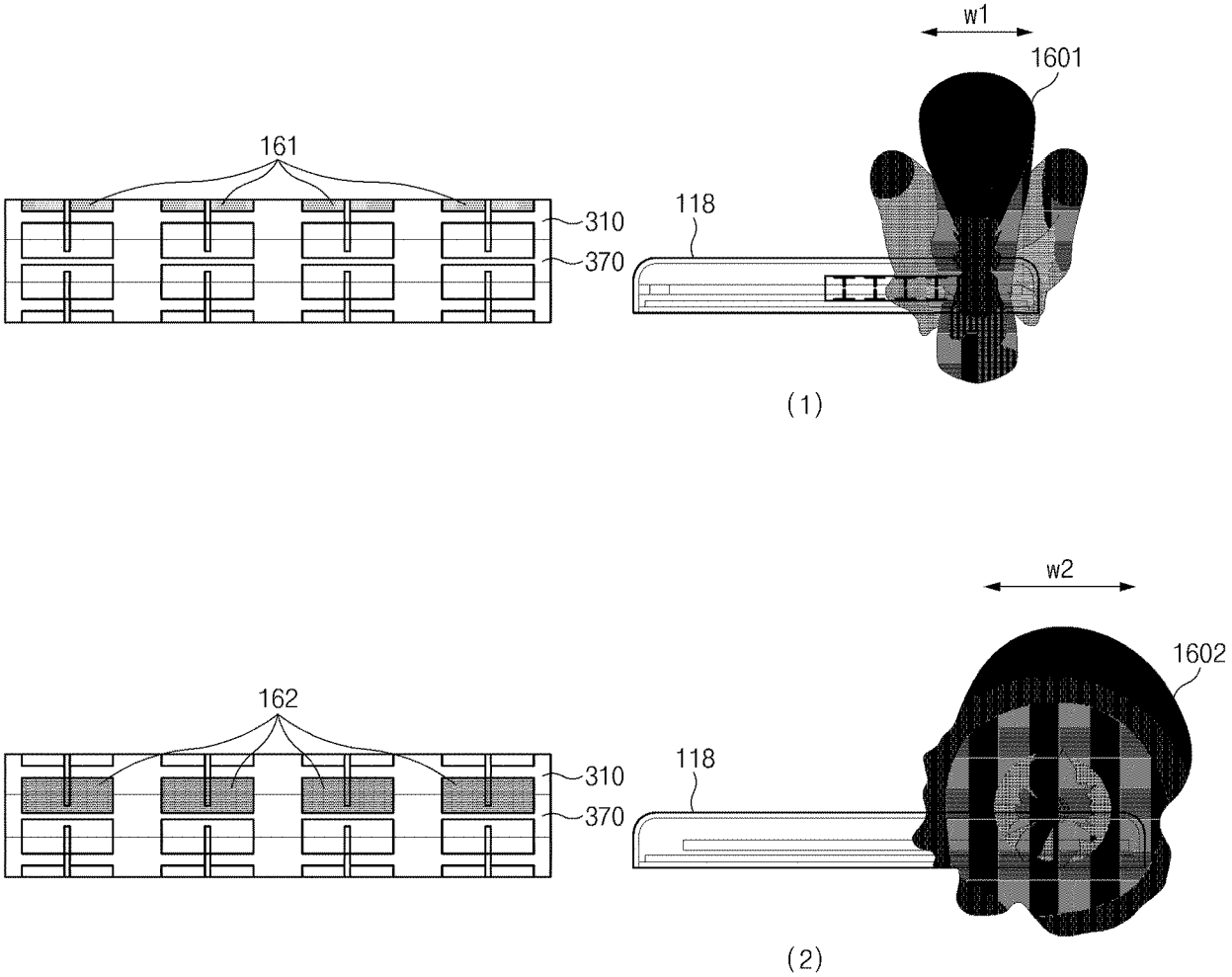
FIGS. 16A and 16B are diagrams illustrating a radiation effect of an electronic device according to various embodiment.
Figure 16B:
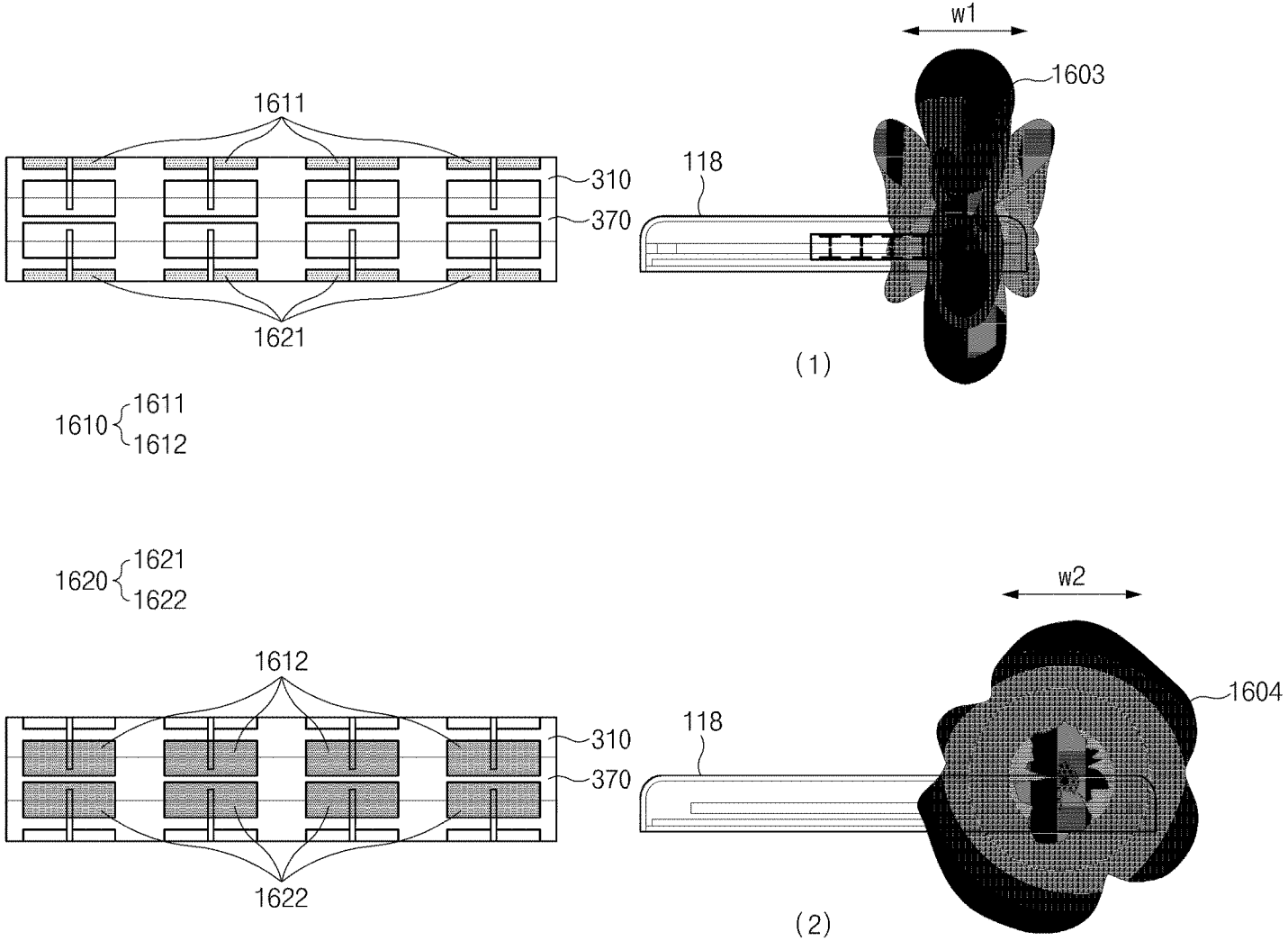

FIGS. 16A and 16B are diagrams illustrating a radiation effect of an electronic device according to various embodiments.

FIG. 16A illustrates radiation patterns 1601 and 1602 of antenna arrays 161 and 162 in the case where a communication device (e.g., the communication device 300 of FIG. 4C) performs single polarization transmission/reception using a single antenna array group.

In FIG. 16A, (1) illustrates the radiation pattern of the horizontally polarized antenna array 161 (e.g., the first antenna array 321 of FIG. 4C), and (2) illustrates the radiation pattern of the vertically polarized antenna array 162 (e.g., the third antenna array 322 of FIG. 4C). In this case, the horizontally polarized antenna array 161 and the vertically polarized antenna array 162 may radiate signals in a direction which is horizontal with respect to a side member. In particular, the horizontally polarized antenna array 161 may radiate a horizontally polarized signal, and the vertically polarized antenna array 162 may radiate a vertically polarized signal.

FIG. 16B illustrates radiation patterns 1603 and 1604 of antenna arrays 1611, 1612, 1621, and 1622 comprising a plurality of antenna array groups 1610 and 1620 in the case of performing single polarization transmission/reception using a dual antenna array group.

In FIG. 16B, the first antenna array group 1610 may include a dual polarized antenna array including the first antenna array 1611 (e.g., the first antenna array 321 of FIG. 4C) for horizontal polarization and the third antenna array 1612 (e.g., the third antenna array 322 of FIG. 4C) for vertical polarization, and the second antenna array group 1620 may include a dual polarized antenna array including the second antenna array 1621 (e.g., the second antenna array 331 of FIG. 4C) for horizontal polarization and the fourth antenna array 1622 (e.g., the fourth antenna array 332 of FIG. 4C) for vertical polarization.

According to an embodiment, the first antenna array 1611 and the second antenna array 1621 may have a specific phase characteristic together and may form a beam at the same time. The third antenna array 1612 and the fourth antenna array 1622 may have a specific phase characteristic together and may form a beam at the same time.

In FIG. 16B, (1) illustrates the beam pattern 1604 indicating the case where the first antenna array 1611 and the second antenna array 1621 have a specific phase characteristic and form a beam at the same time, and (2) illustrates the beam pattern 1604 indicating the case where the third antenna array 1612 and the fourth antenna array 1622 have a specific phase characteristic and form a beam at the same time. In this case, horizontal polarization may be formed in a direction which is horizontal with respect to a side member, and vertical polarization may be formed in a direction which is vertical with respect to the side member.

Referring to FIGS. 16A and 16B, in the case of vertical polarization, a beam width w1 of a beam formed in dual transmission/reception may be narrower and finer than in single transmission/reception. In the case of horizontal polarization, distortion of a beam due to an external housing in dual transmission/reception may be smaller than in signal transmission/reception.

Upon transmitting/receiving signals of horizontal polarization and vertical polarization characteristics, coverage of a beam formed in dual transmission/reception may be wider than in single transmission/reception, and interference between antennas in dual transmission/reception may be smaller than in single transmission/reception. Also, in dual transmission/reception, transmitting or receiving signals of various polarization characteristics may be possible. In the case where the side member 118 is a metal frame, a null period which may occur due to the side member 118 may decrease.

Figure 17A:
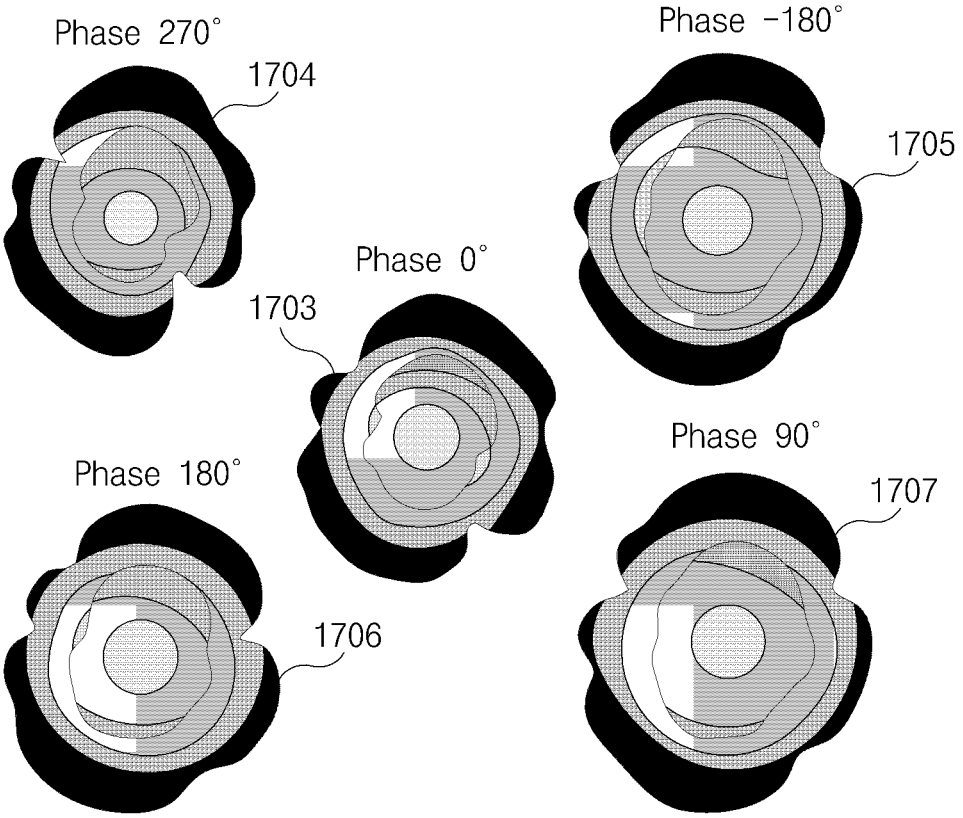
FIGS. 17A and 17B are diagrams illustrating a radiation effect of an electronic device according to an embodiment.
Figure 17B:
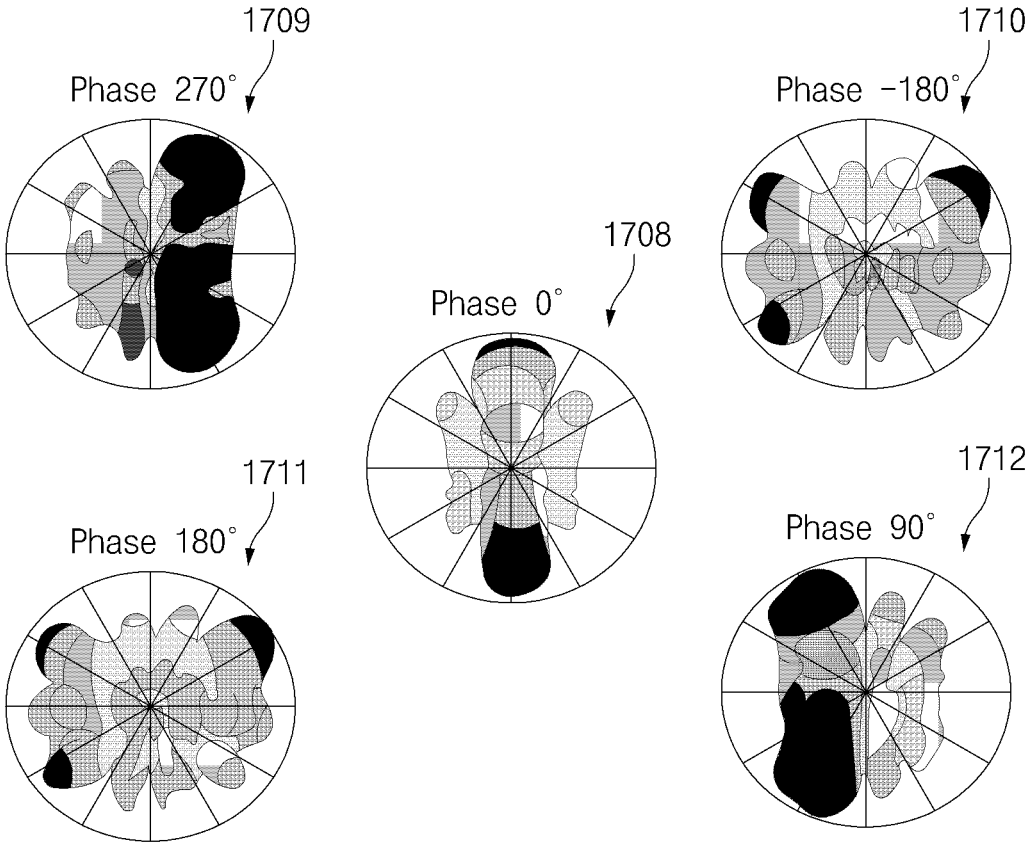

FIGS. 17A and 17B are diagrams illustrating a radiation effect of an electronic device according to an embodiment.

FIG. 17A illustrates beam patterns 1703, 1704, 1705, 1706 and 1707 in the case where an electronic device (e.g., the electronic device 100 of FIG. 1A) performs beam steering according to the embodiment of FIG. 14A, and FIG. 17B shows beam patterns 1708 to 1712 in the case where the electronic device performs beam steering according to the embodiment of FIG. 15.

The following may be understood from a result of comparing the beam patterns of FIGS. 17A and 17B with the beam patterns 1601 and 1602 of FIG. 16A: in the case where a dual antenna array group is used and beam steering is performed, beam coverage may be wider, and distortion of a beam may be smaller.

Also, the following may be understood from a result of comparing the beam patterns of FIGS. 17A and 17B with the beam patterns 1601 and 1602 of FIG. 16A: beam patterns of various polarizations may be formed by performing the beam steering. As such, a null period may decrease more effectively in the case where the side member 118 is a metal frame.

According to an embodiment, an electronic device (e.g., the electronic device 100 of FIG. 1A) may include a housing (e.g., the housing 110 of FIG. 1A) that includes a first plate (e.g., the first plate 102 of FIG. 1A), a second plate (e.g., the second plate 111 of FIG. 1B) facing a direction opposite the first plate, and a side member (e.g., the side member 118 of FIG. 1A) surrounding a space between the first plate and the second plate, an antenna structure (e.g., the antenna module 930 of FIG. 9A) that includes a plurality of dielectric layers arranged perpendicular to the side member and parallel to the first plate, a first array of conductive plates (e.g., the first antenna array 321 of FIG. 3A and the first antenna element 941 of FIG. 9A) aligned in a first direction perpendicular to the first plate at a first dielectric layer of the dielectric layers, a second array of conductive plates (e.g., the second antenna array 331 of FIG. 3A and the first antenna element 941) spaced from the first array and aligned in the first direction at the first dielectric layer, wherein the second array is farther from the first plate than from the first array, at least one ground plane (e.g., the ground plane 370 of FIG. 3A) positioned on at least one of the dielectric layers and interposed between the first array and the second array, when viewed from above the side member, and a wireless communication circuit (e.g., the second communication circuit 2230 of FIG. 2B) that is electrically connected to the first array and the second array and transmits and/or receives a signal of 20 GHz to 100 GHz.

According to an embodiment, the antenna structure may further include a third array of conductive plates (e.g., the first antenna array 331 of FIG. 4A and the second antenna element 942 of FIG. 9A) that are aligned in the first direction at a second dielectric layer of the dielectric layers and form a dipole antenna (e.g., the first antenna 321*a* of FIG. 4A) in pairs with the first array, and a fourth array of conductive plates (e.g., the second antenna array 331 of FIG. 4A and the second antenna element 942 of FIG. 9A) that are aligned in the first direction at the second dielectric layer and form a dipole antenna (e.g., the fifth antenna 331*a* of FIG. 4A) in pairs with the second array, and the third array and the fourth array may be electrically connected to the ground plane.

According to an embodiment, the antenna structure may further include a fifth array of conductive plates (e.g., the third antenna array 322 of FIG. 4B and the third antenna element 921 of FIG. 9B) that are aligned in the first direction between the first array and the ground plane, at a third dielectric layer of the dielectric layers, when viewed from above the side member, and a sixth array of conducive plates (e.g., the fourth antenna array 332 of FIG. 4B and the third antenna element 921 of FIG. 9B) that are aligned in the first direction between the first array and the ground plane, when viewed from above the side member, at the third dielectric layer configured to pair with the fifth array.

According to an embodiment, the antenna structure may further include a seventh array of conductive plates (e.g., the third antenna array 322 of FIG. 4B and the fourth antenna element 922 of FIG. 9B) that are aligned in the first direction between the first array and the ground plane, at a fourth dielectric layer of the dielectric layers, when viewed from above the side member, wherein the seventh array is configured to pair with the fifth array to form an antenna (e.g., the first antenna 322*a* of FIG. 4B), and an eighth array of conductive plates (e.g., the fourth antenna array 332 of FIG. 4B and the fourth antenna element 922 of FIG. 9B) that are aligned in the first direction at the third dielectric layer, when viewed from the side member, wherein the eighth array is configured to pair with the sixth array between the second array and the ground plane to form an antenna (e.g., the first antenna 332*a* of FIG. 4B). The seventh array and the eighth array may be electrically connected to the ground plane.

According to an embodiment, the wireless communication circuit may transmit or receive a radio frequency (RF) signal of a first polarization characteristic using the first array to the fourth array.

According to an embodiment, the wireless communication circuit may transmit or receive an RF signal of a second polarization characteristic different from the first polarization characteristic using the fifth array to the eighth array.

According to an embodiment, the antenna formed of the pair of the fifth array and the seventh array may be a patch antenna.

According to an embodiment, the electronic device may further include a substrate (e.g., the substrate 310 of FIG. 3A), and at least one of the antenna structure or the wireless communication circuit may be positioned at the substrate.

According to an embodiment, the side member may include a metal frame.

According to an embodiment, the electronic device may further include a display (e.g., the display 101 of FIG. 1A) that is exposed to the outside through the first plate. According to an embodiment, the antenna structure may be interposed between the display and the side member, when viewed from above the first plate.

According to an embodiment, the RF signal may be transmitted in a frequency band ranging from 20 GHz to 100 GHz.

According to an embodiment, an electronic device (e.g., the electronic device 100 of FIG. 1A) may include a housing (e.g., the housing 110 of FIG. 1A) that includes a first plate (e.g., the first plate 102 of FIG. 1A), a second plate (e.g., the second plate 111 of FIG. 1B) facing a direction opposite the first plate, and a side member (e.g., the side member 118 of FIG. 1A) surrounding a space between the first plate and the second plate, wherein the side member includes a first side (e.g., the first side 118A of FIG. 1A) and a second side (e.g., the second side 118B of FIG. 1A) extending in a first direction and having a first length in the space and a third side (e.g., the third side 118C of FIG. 1A) and a fourth side (e.g., the fourth side 118D of FIG. 1A) extending in a second direction and having a second length longer than the first length, a communication device comprising communication circuitry (e.g., the communication device 300 of FIG. 3A) that is positioned within the space and is configured to transmit and/or receive a wireless signal in a frequency range of 20 GHz to 100 GHz, wherein the communication device includes a substrate (e.g., the substrate 310 of FIG. 3A) including a first surface (e.g., the first surface 301 of FIG. 3A) and a second surface (e.g., the second surface 302 of FIG. 3A) facing a direction opposite the first surface, a first antenna array (e.g., the first antenna array 321 of FIG. 3A) positioned at the substrate and including a plurality of first conductive plates (e.g., the first antenna element 941 of FIG. 9A), a second antenna array (e.g., the second antenna array 331 of FIG. 3A) positioned at the substrate and including a plurality of second conductive plates (e.g., the second antenna element 942 of FIG. 9A) independent of the plurality of first conductive plates, and a ground region (e.g., the ground region 370 of FIG. 3A) interposed between the first antenna array and the second antenna array within the space, and a wireless communication circuit (e.g., the communication circuit 341 of FIG. 3B) configured to transmit and/or receive a radio frequency (RF) signal having a specific polarization characteristic using the plurality of first conductive plates and the plurality of second conductive plates and to transmit and/or receive an RF signal having the specific polarization characteristic using the plurality of second conductive plates.

According to an embodiment, the first polarization characteristic and the second polarization characteristic may be a horizontal polarization characteristic.

According to an embodiment, any one of the first surface or the second surface may be positioned to face any one of the first side to the fourth side.

According to an embodiment, the electronic device may further include a third antenna array (e.g., the third antenna array 322 of FIG. 4B) that is positioned at the substrate and includes a plurality of third conductive plates (e.g., the third conductive plate 921 of FIG. 9B) overlapping at least partially with the plurality of first conductive plates, when viewed from the first surface, and a fourth antenna array (e.g., the fourth antenna array 332 of FIG. 4B) that is positioned at the substrate and includes a plurality of fourth conductive plates (e.g., the fourth conductive plate 922 of FIG. 9B) overlapping at least partially with the plurality of second conductive plates, when viewed from the first surface. The wireless communication circuit may be configured to transmit and/or receive an RF signal having a different polarization characteristic from the specific polarization characteristic through the plurality of third conductive plates and to transmit and/or receive an RF signal having the different polarization characteristic through the plurality of fourth conductive plates.

According to an embodiment, the different polarization characteristic may be a vertical polarization characteristic.

According to an embodiment, the RF signal may be transmitted in a frequency band ranging from 20 GHz to 100 GHz.

According to an embodiment, a communication device (e.g., the communication device 300 of FIG. 3A) may include at least one substrate (e.g., the substrate 310 of FIG. 3B, or the substrate 390 or the substrate 391 of FIG. 3C) where a wireless communication circuit (e.g., the communication circuit 341 of FIG. 3B) configured to transmit and/or receive a signal having a frequency in a range of 20 GHz to 100 GHz is positioned, a first antenna array (e.g., the first antenna array 321 of FIG. 3A) that includes a plurality of first conductive plates (e.g., the first antenna element 941 of FIG. 9A) placed with an array at any one substrate of the at least one substrate, a second antenna array (e.g., the second antenna array 331 of FIG. 4A) that includes a plurality of second conductive plates (e.g., the second antenna element 942 of FIG. 9A) placed with an array at the any one substrate, and a ground region (e.g., the ground region 370 of FIG. 3A) that is positioned at the any one substrate, is electrically connected to the plurality of first conductive plates and the plurality of second conductive plates, and is interposed between the plurality of first conductive plates and the plurality of second conductive plates, when viewed from above one surface of the any one substrate. The wireless communication circuit may be configured to transmit and/or receive an RF signal of a specific polarization characteristic through the plurality of first conductive plates, and may transmit or receive an RF signal of the specific polarization characteristic through the plurality of second conductive plates.

According to an embodiment, the wireless communication circuit may be positioned at the any one substrate.

According to an embodiment, the at least one substrate may include a different substrate (e.g., the substrate 1202 of FIG. 12A) from the any one substrate (e.g., the substrate 1201 of FIG. 12A), and the wireless communication circuit may be positioned at the different substrate.

FIG. 18 is a block diagram illustrating an electronic device 1801 in a network environment 1800 according to various embodiments. Referring to FIG. 18, the electronic device 1801 in the network environment 1800 may communicate with an electronic device 1802 via a first network 1898 (e.g., a short-range wireless communication network), or an electronic device 1804 or a server 1808 via a second network 1899 (e.g., a long-range wireless communication network). According to an embodiment, the electronic device 1801 may communicate with the electronic device 1804 via the server 1808. According to an embodiment, the electronic device 1801 may include a processor 1820, memory 1830, an input device 1850, a sound output device 1855, a display device 1860, an audio module 1870, a sensor module 1876, an interface 1877, a haptic module 1879, a camera module 1880, a power management module 1888, a battery 1889, a communication module 1890, a subscriber identification module (SIM) 1896, or an antenna module 1897. In some embodiments, at least one (e.g., the display device 1860 or the camera module 1880) of the components may be omitted from the electronic device 1801, or one or more other components may be added in the electronic device 1801. In some embodiments, some of the components may be implemented as single integrated circuitry. For example, the sensor module 1876 (e.g., a fingerprint sensor, an iris sensor, or an illuminance sensor) may be implemented as embedded in the display device 1860 (e.g., a display).

The processor 1820 may execute, for example, software (e.g., a program 1840) to control at least one other component (e.g., a hardware or software component) of the electronic device 1801 coupled with the processor 1820, and may perform various data processing or computation. According to one embodiment, as at least part of the data processing or computation, the processor 1820 may load a command or data received from another component (e.g., the sensor module 1876 or the communication module 1890) in volatile memory 1832, process the command or the data stored in the volatile memory 1832, and store resulting data in non-volatile memory 1834. According to an embodiment, the processor 1820 may include a main processor 1821 (e.g., a central processing unit (CPU) or an application processor (AP)), and an auxiliary processor 1823 (e.g., a graphics processing unit (GPU), an image signal processor (ISP), a sensor hub processor, or a communication processor (CP)) that is operable independently from, or in conjunction with, the main processor 1821. Additionally or alternatively, the auxiliary processor 1823 may be adapted to consume less power than the main processor 1821, or to be specific to a specified function. The auxiliary processor 1823 may be implemented as separate from, or as part of the main processor 1821.

The auxiliary processor 1823 may control at least some of functions or states related to at least one component (e.g., the display device 1860, the sensor module 1876, or the communication module 1890) among the components of the electronic device 1801, instead of the main processor 1821 while the main processor 1821 is in an inactive (e.g., sleep) state, or together with the main processor 1821 while the main processor 1821 is in an active state (e.g., executing an application). According to an embodiment, the auxiliary processor 1823 (e.g., an image signal processor or a communication processor) may be implemented as part of another component (e.g., the camera module 1880 or the communication module 1890) functionally related to the auxiliary processor 1823.

The memory 1830 may store various data used by at least one component (e.g., the processor 1820 or the sensor module 1876) of the electronic device 1801. The various data may include, for example, software (e.g., the program 1840) and input data or output data for a command related thereto. The memory 1830 may include the volatile memory 1832 or the non-volatile memory 1834.

The program 1840 may be stored in the memory 1830 as software, and may include, for example, an operating system (OS) 1842, middleware 1844, or an application 1846.

The input device 1850 may receive a command or data to be used by other component (e.g., the processor 1820) of the electronic device 1801, from the outside (e.g., a user) of the electronic device 1801. The input device 1850 may include, for example, a microphone, a mouse, a keyboard, or a digital pen (e.g., a stylus pen).

The sound output device 1855 may output sound signals to the outside of the electronic device 1801. The sound output device 1855 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 1860 may visually provide information to the outside (e.g., a user) of the electronic device 1801. The display device 1860 may include, for example, a display, a hologram device, or a projector and control circuitry to control a corresponding one of the display, hologram device, and projector. According to an embodiment, the display device 1860 may include touch circuitry adapted to detect a touch, or sensor circuitry (e.g., a pressure sensor) adapted to measure the intensity of force incurred by the touch.

The audio module 1870 may convert a sound into an electrical signal and vice versa. According to an embodiment, the audio module 1870 may obtain the sound via the input device 1850, or output the sound via the sound output device 1855 or a headphone of an external electronic device (e.g., an electronic device 1802) directly (e.g., wiredly) or wirelessly coupled with the electronic device 1801.

The sensor module 1876 may detect an operational state (e.g., power or temperature) of the electronic device 1801 or an environmental state (e.g., a state of a user) external to the electronic device 1801, and then generate an electrical signal or data value corresponding to the detected state. According to an embodiment, the sensor module 1876 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 1877 may support one or more specified protocols to be used for the electronic device 1801 to be coupled with the external electronic device (e.g., the electronic device 1802) directly (e.g., wiredly) or wirelessly. According to an embodiment, the interface 1877 may include, for example, a high definition multimedia interface (HDMI), a universal serial bus (USB) interface, a secure digital (SD) card interface, or an audio interface.

A connecting terminal 1878 may include a connector via which the electronic device 1801 may be physically connected with the external electronic device (e.g., the electronic device 1802). According to an embodiment, the connecting terminal 1878 may include, for example, a HDMI connector, a USB connector, a SD card connector, or an audio connector (e.g., a headphone connector).

The haptic module 1879 may convert an electrical signal into a mechanical stimulus (e.g., a vibration or a movement) or electrical stimulus which may be recognized by a user via his tactile sensation or kinesthetic sensation. According to an embodiment, the haptic module 1879 may include, for example, a motor, a piezoelectric element, or an electric stimulator.

The camera module 1880 may capture a still image or moving images. According to an embodiment, the camera module 1880 may include one or more lenses, image sensors, image signal processors, or flashes.

The power management module 1888 may manage power supplied to the electronic device 1801. According to one embodiment, the power management module 1888 may be implemented as at least part of, for example, a power management integrated circuit (PMIC).

The battery 1889 may supply power to at least one component of the electronic device 1801. According to an embodiment, the battery 1889 may include, for example, a primary cell which is not rechargeable, a secondary cell which is rechargeable, or a fuel cell.

The communication module 1890 may support establishing a direct (e.g., wired) communication channel or a wireless communication channel between the electronic device 1801 and the external electronic device (e.g., the electronic device 1802, the electronic device 1804, or the server 1808) and performing communication via the established communication channel. The communication module 1890 may include one or more communication processors that are operable independently from the processor 1820 (e.g., the application processor (AP)) and supports a direct (e.g., wired) communication or a wireless communication. According to an embodiment, the communication module 1890 may include a wireless communication module 1892 (e.g., a cellular communication module, a short-range wireless communication module, or a global navigation satellite system (GNSS) communication module) or a wired communication module 1894 (e.g., a local area network (LAN) communication module or a power line communication (PLC) module). A corresponding one of these communication modules may communicate with the external electronic device via the first network 1898 (e.g., a short-range communication network, such as Bluetooth™, wireless-fidelity (Wi-Fi) direct, or infrared data association (IrDA)) or the second network 1899 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 1892 may identify and authenticate the electronic device 1801 in a communication network, such as the first network 1898 or the second network 1899, using subscriber information (e.g., international mobile subscriber identity (IMSI)) stored in the subscriber identification module 1896.

The antenna module 1897 may transmit or receive a signal or power to or from the outside (e.g., the external electronic device) of the electronic device 1801. According to an embodiment, the antenna module 1897 may include an antenna including a radiating element composed of a conductive material or a conductive pattern formed in or on a substrate (e.g., PCB). According to an embodiment, the antenna module 1897 may include a plurality of antennas. In such a case, at least one antenna appropriate for a communication scheme used in the communication network, such as the first network 1898 or the second network 1899, may be selected, for example, by the communication module 1890 (e.g., the wireless communication module 1892) from the plurality of antennas. The signal or the power may then be transmitted or received between the communication module 1890 and the external electronic device via the selected at least one antenna. According to an embodiment, another component (e.g., a radio frequency integrated circuit (RFIC)) other than the radiating element may be additionally formed as part of the antenna module 1897.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 1801 and the external electronic device 1804 via the server 1808 coupled with the second network 1899. Each of the electronic devices 1802 and 1804 may be a device of a same type as, or a different type, from the electronic device 1801. According to an embodiment, all or some of operations to be executed at the electronic device 1801 may be executed at one or more of the external electronic devices 1802, 1804, or 1808. For example, if the electronic device 1801 should perform a function or a service automatically, or in response to a request from a user or another device, the electronic device 1801, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 1801. The electronic device 1801 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 1840) including one or more instructions that are stored in a storage medium (e.g., internal memory 1836 or external memory 1838) that is readable by a machine (e.g., the electronic device 1801). For example, a processor (e.g., the processor 1820) of the machine (e.g., the electronic device 1801) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a housing including a first plate, a second plate facing a direction opposite the first plate, and a side member surrounding a space between the first plate and the second plate;

an antenna structure including:

a substrate including a plurality of dielectric layers, the substrate perpendicular to the first plate and parallel to the side member;

a first antenna array comprising conductive plates arranged along the side member in the substrate and configured to radiate beams in a first direction perpendicular to the first plate;

a second antenna array comprising conductive plates arranged along the side member in the substrate, spaced from the first antenna array, and configured to radiate beams in a second direction opposite to the first direction, wherein the second antenna array is farther from the first plate than the first antenna array;

a third antenna array comprising conductive plates arranged along the side member in the substrate and at least partially overlapping the first antenna array when viewed from above the substrate; and at least one ground plane positioned on at least one of the dielectric layers and interposed between the first antenna array and the second antenna array, when viewed from above the side member; and a wireless communication circuit electrically connected to the first antenna array, the second antenna array, and the third antenna array, the wireless communication circuit configured to transmit and/or receive a radio frequency signal using at least one of the first antenna array, the second antenna array, or the third antenna array.

2. The electronic device of claim 1, wherein:

the first antenna array is a dipole antenna array, each of dipole antenna includes two conductive plates, and one of the two conductive plates is electrically connected to the at least one ground plane.

3. The electronic device of claim 2, wherein the antenna structure further includes a fourth antenna array arranged along the side member in the substrate and at least partially overlapping the second antenna array, and the wireless communication circuit is electrically connected to the fourth antenna array and is further configured to transmit and/or receive a radio frequency signal having the second polarization characteristic using the fourth antenna array.

4. The electronic device of claim 3, wherein the at least one ground plane is positioned between the third antenna array and the fourth antenna array when viewed above from the substrate.

5. The electronic device of claim 3, wherein the wireless communication circuit is configured to:

transmit and/or receive a radio frequency (RF) signal of a first polarization characteristic using at least one of the first antenna array or the second antenna array; and/or transmit and/or receive a RF signal having of a second polarization characteristic different from the first polarization characteristic using at least one of the third antenna array or the fourth antenna array.

6. The electronic device of claim 1, wherein the third antenna array is a patch antenna array.

7. The electronic device of claim 1, wherein the wireless communication circuit is positioned at the substrate.

8. The electronic device of claim 1, wherein the side member includes a metal frame.

9. The electronic device of claim 1, further comprising:

a display exposed to the outside through the first plate, wherein the antenna structure is interposed between the display and the side member, when viewed from above the first plate.

10. The electronic device of claim 1, wherein the RF signal is transmitted in a frequency band in a range of 20 GHz to 100 GHz.

11. The electronic device of claim 1, wherein each of the first antenna array of the conductive plates extends towards the first plate, and each of the second antenna array of the conductive plates extends towards the second plate.

12. The electronic device of claim 11, wherein each of the third antenna array of the conductive plates is positioned to face the side member.

13. The electronic device of claim 12, wherein the each of the third antenna array of the conductive plates at least partially overlaps the each of the first antenna array of the conductive plates.

* * * * *